US006585491B2

(12) United States Patent
Taneya et al.

(10) Patent No.: US 6,585,491 B2
(45) Date of Patent: Jul. 1, 2003

(54) LIQUID DISCHARGE APPARATUS HAVING A HEATING ELEMENT

(75) Inventors: Yoichi Taneya, Yokohama (JP); Sadayuki Sugama, Tsukuba (JP); Hiroyuki Ishinaga, Tokyo (JP); Hiroyuki Sugiyama, Sagamihara (JP); Satoshi Shimazu, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/984,482

(22) Filed: Oct. 30, 2001

(65) Prior Publication Data

US 2002/0039530 A1 Apr. 4, 2002

Related U.S. Application Data

(62) Division of application No. 09/362,225, filed on Jul. 28, 1999, now Pat. No. 6,386,832.

(30) Foreign Application Priority Data

| | | |
|---|---|---|
| Jul. 28, 1998 | (JP) | 10-212718 |
| Aug. 21, 1998 | (JP) | 10-236113 |
| Aug. 21, 1998 | (JP) | 10-236114 |
| Aug. 21, 1998 | (JP) | 10-236115 |
| Aug. 21, 1998 | (JP) | 10-236116 |
| Aug. 21, 1998 | (JP) | 10-236118 |
| Aug. 21, 1998 | (JP) | 10-236119 |
| Aug. 21, 1998 | (JP) | 10-236121 |
| Aug. 21, 1998 | (JP) | 10-236126 |

(51) Int. Cl.[7] ..... F04B 19/24

(52) U.S. Cl. ..... 417/52; 417/207; 417/208; 347/65

(58) Field of Search ..... 417/52, 207, 208, 417/209; 347/65, 63, 94

(56) References Cited

U.S. PATENT DOCUMENTS

| | | | | |
|---|---|---|---|---|
| 4,723,129 A | 2/1988 | Endo et al. | ..... | 346/1.1 |
| 5,278,585 A | 1/1994 | Karz et al. | ..... | 346/140 R |
| 5,485,186 A | 1/1996 | Ishinaga et al. | ..... | 347/65 |
| 5,821,962 A | 10/1998 | Kudo et al. | ..... | 347/65 |

(List continued on next page.)

FOREIGN PATENT DOCUMENTS

| | | |
|---|---|---|
| EP | 0 436 047 | 7/1991 |
| EP | 0 721 841 | 1/1996 |
| EP | 0 745 479 | 5/1996 |
| EP | 0721841 A2 | 7/1996 |
| EP | 0 816 088 | 10/1996 |
| EP | 0745479 A2 | 12/1996 |
| EP | 0 816 087 | 7/1997 |
| EP | 0 819 530 | 7/1997 |
| EP | 0816087 A2 | 1/1998 |
| EP | 0819530 A2 | 1/1998 |
| JP | 6-31918 | 2/1994 |
| JP | 9-48127 | 2/1997 |
| JP | 9-323420 | 12/1997 |
| JP | 10-24588 | 1/1998 |

*Primary Examiner*—Timothy S. Thorpe
*Assistant Examiner*—William H. Rodriguez
(74) *Attorney, Agent, or Firm*—Fitzpatrick, Cella, Harper & Scinto

(57) ABSTRACT

A liquid discharge head is provided having a heating member for generating thermal energy to create a bubble in liquid, a discharge port adapted to discharge the liquid, and a liquid flow path communicated with the discharge port having a bubble generating area for enabling the liquid to create the bubble. A movable member is arranged in the bubble generating area to be displaced along with the development of the bubble. A regulating portion regulates the displacement of the movable member within a desired range, and by means of energy at the time of bubble creation, the liquid being discharged from the discharge port. The regulating portion is arranged to face the bubble generating area in the liquid flow path. A support member is directly connected to the movable member. The bubble development causes the movable member and the regulating portion to be in contact forming an essentially closed space with the exception of the discharge port.

14 Claims, 22 Drawing Sheets

U.S. PATENT DOCUMENTS

| | | | | |
|---|---|---|---|---|
| 5,841,448 | A | 11/1998 | Moriyama et al. | 347/19 |
| 5,943,074 | A | 8/1999 | Kashino et al. | 347/54 |
| 5,992,984 | A | 11/1999 | Imanaka et al. | 347/65 |
| 6,007,187 | A | 12/1999 | Kashino et al. | 347/65 |
| 6,062,671 | A | 5/2000 | Kanda et al. | 347/30 |
| 6,062,680 | A | 5/2000 | Yoshihira et al. | 347/65 |
| 6,095,639 | A | 8/2000 | Uetsuki et al. | 347/65 |
| 6,095,640 | A | 8/2000 | Ishinaga et al. | 347/65 |
| 6,102,529 | A | 8/2000 | Okazaki et al. | 347/65 |
| 6,113,224 | A | 9/2000 | Sugama et al. | 347/65 |
| 6,142,613 | A | 11/2000 | Asakawa et al. | 347/65 |
| 6,168,264 | B1 | 1/2001 | Yoshihira et al. | 347/65 |
| 6,199,972 | B1 | 3/2001 | Ishinaga et al. | 347/65 |

LIQUID DISCHARGE APPARATUS HAVING A HEATING ELEMENT

This application is a division of application Ser. No. 09/362,225, filed on Jul. 28, 1999 (Now U.S. Pat. No. 6,386,832).

BACKGROUND OF THE INVENTION

1. Field of the Invention

The present invention relates to a liquid discharge head that discharges a desired liquid by the bubbles created by the application of thermal energy acting upon the liquid, and also, relates to the head cartridge and the liquid discharge apparatus using such liquid discharge head. More particularly, the invention relates to a liquid discharge head provided with the movable member which is displaceable by the utilization of the creation of bubbles, as well as to a head cartridge and a liquid discharge apparatus using such liquid discharge head.

Also, the present invention is applicable to a printer capable of recording on a recording medium, such as paper, thread, textile, cloth, leather, metal, plastic, glass, wood, and ceramics, among some others. the invention is also applicable to a copying machine, a facsimile equipment having communication systems, and an apparatus, such as a wordprocessor, which is provided with a printer. The invention is also applicable to a recording system for industrial use arranged complexly in combination with various processing apparatuses.

Here, in the specification of the present invention, the term "record" means not only the provision of characters, graphics, and other meaningful images, but also, it means the provision of patterns or other images which do not present any particular meaning.

2. Related Background Art

There has been known the ink jet recording method, that is, the so-called bubble jet recording method in which the energy, such as heat, is given to ink to cause the change of states of ink which is accompanied by the abrupt voluminal changes (creation of bubbles), and ink is discharged from the discharge ports by the acting force based on this change of states, and then, the discharged ink is allowed to adhere to a recording medium for the formation of images. The recording apparatus using this bubble jet recording method is generally provided with the discharge ports for discharging ink; the ink flow paths communicated with the discharge ports; and the electrothermal transducing devices (elements) each arranged in each of the ink flow paths, serving as means for generating energy used for discharging ink as disclosed in the specifications of U.S. Pat. No. 4,723,129, and others.

In accordance with a recording method of the kind, it is possible to record high quality images at higher speeds in a lesser amount of noises. At the same time, with the head whereby to execute this recording method, it becomes possible to arrange the discharge ports for discharging ink in higher density, among many other advantages, hence obtaining recorded images in higher resolution with a smaller apparatus, and obtaining images in colors with ease as well. In recent years, therefore, the bubble jet recording method is widely utilized for many kinds of office equipment, such as printer, copying machine, facsimile equipment, and further, utilized for the textile printing system and others for the industrial use.

Now, along with the wider utilization of the bubble jet technologies and techniques for the products currently in use in many fields, there have been various demands increasingly more in recent years as given below.

In order to obtain images in higher quality, the driving condition is proposed anew so that the liquid discharge method or the like should be arranged to perform good ink discharges on the basis of the stabilized creation of bubbles that enables ink to be discharged at higher speeds. Also, from the viewpoint of the higher recording, there has been proposed the improved configuration of flow paths so as to obtain the liquid discharge head which is capable of performing in the liquid flow paths the higher refilling for the liquid that has been discharged.

Besides a head of the kind, an invention is disclosed in the specification of Japanese Patent Application Laid-Open No. 6-31918 (particularly, FIG. 3) in which attention is given to the back waves (the pressure directed in the direction opposite to the one toward the discharge ports) which are generated along with the creation of bubbles, and then, the structure is arranged to prevent such back waves because the back waves result in the energy loss in performing discharges. In accordance with the invention disclosed in the specification thereof, the triangle portion of a triangular plate member is arranged to face each heater that creates bubbles. The invention can suppress the back waves temporarily and slightly by means of such plate member thus arranged. However, there is no reference at all as to the correlations between the development of bubbles and the triangular portion nor any idea is disclosed as to dealing with such correlations. Therefore, this invention still present the problems as given below.

In other words, the invention thus disclosed is designed to locate the heaters on the bottom of a recessed portion, thus making it difficult to provide the condition where the heaters can be communicated with the discharge ports on the straight line. As a result, each liquid droplet is not stabilized in keeping its shape uniformly. At the same time, since the development of each bubble is allowed to take place beginning with the circumference of each apex of the triangular portions, the bubble is developed from one side of the triangular plate member to the opposite side entirely. Consequently, the development of each bubble is completed in the liquid as has been usually effectuated as if there were no presence of the triangular plate members. Here, as to the bubble development, therefore, the presence of the plate members has no bearing at all. On the contrary, the entire body of each plate member is embraced by each bubble, and in the stage where the bubble is contracted, this condition may bring about the disturbance in the refilling flow to each of the heaters located in the recessed portion. As a result, fine bubbles are accumulated in the recessed portion, which may disturb the principle itself with which to perform discharges on the basis of the development of bubbles.

Meanwhile, in accordance with the EP-A 436047, an invention has been proposed to alternately open and close a first shut off valve arranged between the area in the vicinity of discharge ports and the bubble generating portion, and a second valve which is arranged between the bubble generating portion and the ink supply portion in order to shut them off completely (as shown in FIGS. 4 to 9 of the EP-A 436047). However, this invention inevitably partitions each of the three chambers into two, respectively. As a result, the ink that follows the liquid droplet presents a great trailing at the time of discharge, which creates a considerable amount of satellite dots as compared with the usual discharge method where the development, contraction, and extinction are performed for each of bubbles (presumably, there is no way to effectively utilize the resultant retraction of meniscus in the process of the bubble disappearing). Also, at the time of refilling, liquid should be supplied to the bubble generating portion following the disappearing of each bubble. However, since it is impossible to supply liquid to the vicinity of the discharge ports until the next bubbling takes place, not only each size of discharge liquid droplets varies greatly, but also, the frequency of discharge responses becomes extremely smaller. Therefore, this proposed invention is far from being practical.

On the other hand, the applicant hereof has proposed a number of inventions that may contribute to the performance of effective discharges of liquid droplets, which use the movable member (the plate member or the like that has its free end on the discharge port side of its fulcrum unlike the conventional art). Of the inventions thus proposed, the one disclosed in the specification of Japanese Patent Application Laid-Open No. 9-48127 is such as to regulate the upper limit of the displacement of the movable member in order to prevent even a slight disturbance of the behavior of the movable member disclosed in the specification of Japanese Patent Application Laid-Open No. 9-323420. Also, in the specification of Japanese Patent Application Laid-Open No. 9-323420, there is the disclosure of an invention that the position of the common liquid chamber on the upstream of the aforesaid movable member is arranged to be shiftable to the downstream side, that is the free end side of the movable member, by the utilization of the advantage presented by the movable member so as to enhance the refilling capability. However, for these inventions, no attention has been given not only to each individual element of bubbling as a whole which is concerned with the formation of the liquid droplet, but also, to the correlations between each of them, because in the premises set forth for the designing the invention, the mode has been adopted so that the bubble is released to the discharge port side at once from the state where the development of the bubble is temporarily embraced by the movable member.

Then, in the next stage to follow in this respect, the applicant hereof has disclosed in Japanese Patent Application Laid-Open No. 10-24588 the invention that a part of the bubble generation area is released from the movable member as a new devise (acoustic waves) with the attention given to the development of bubble by the application of the propagation of pressure waves, which constitutes the element related to the liquid discharges. However, for this invention, too, the attention is given only to the development of each bubble at the time of liquid discharges. As a result, each individual element related to the formation of the liquid droplet itself, with which bubbling is concerned as a whole, nor the correlations between each of them is taken into consideration in giving such attention. Although it has been known that the front portion (edge shooter type) of the bubble created by means of the film boiling exerts a great influence on the discharges, there is no invention in which attention has ever been given to this portion so as to make it effectively contributive to the formation of discharge liquid droplet. The inventors hereof have ardently studied this portion in order to elucidate it technically when designing this invention.

From the viewpoint of the formation of discharge liquid droplets, the precise analyses are made as to the processes from the creation of each bubble to the disappearing thereof. Then, a number of inventions are designed as a result of such precise analyses. The present invention is one of them thus devised for the reduction of the satellites which are characteristic of ink jetting, and which tend to lower the quality of prints, and also, cause the apparatus itself and the recording medium to be stained. As compared with the conventional art, the present invention makes it possible to attain an extremely high technical standard with respect to the stabilization of the image quality in the execution of the continuous discharge operation.

SUMMARY OF THE INVENTION

The main objectives of the present invention are as follows:

A first object of the invention is to provide an extremely novel liquid discharge principle under which the created bubbles and the liquid on the discharge port side thereof, as well as the liquid on the supply side, are suppressed by the movable members and the structure of the entire liquid flow paths.

A second object of the invention is to provide a liquid discharge method and a liquid discharge head with which to design the reduction of satellites by controlling the discharge liquid droplet forming process, and at the same time, to substantially eliminate the satellites in the discharge operation.

A third object is to lighten the system load of the structure needed for the recording apparatus to make it possible to remove the drawbacks resulting from the presence of satellites and the fluctuation of meniscus.

In order to achieve these objects of the present invention, the liquid discharge head comprises a heating member for generating thermal energy to create bubble in liquid; a discharge port forming the portion to discharge the liquid; a liquid flow path communicated with the discharge port and having a bubble generating area for enabling liquid to create bubbles; a movable member arranged in the bubble generating area to be displaced along with the development of the bubble; and a regulating portion to regulate the displacement of the movable member within a desired range, and with energy at the time of bubble creation, the liquid being discharged from the discharge port. For this liquid discharge head, the regulating portion is arranged to face the bubble generating area in the liquid flow path, and then, with the essential contact between the displaced movable member and the regulating portion, the liquid flow path having the bubble generating area becomes an essentially closed space with the exception of the discharge port.

Also, the liquid discharge method of the invention that uses a liquid discharge head provided with a heating member for generating thermal energy to create bubble in liquid; a discharge port forming the portion to discharge the liquid; a liquid flow path communicated with the discharge port and having a bubble generating area for enabling liquid to create bubble; a movable member arranged in the bubble generating area to be displaced along with the development of the bubble; and a regulating portion to regulate the displacement of the movable member within a desired range, and with energy at the time of bubble creation, the liquid being discharged from the discharge port, comprises the step of placing the movable member to be in contact with the regulating portion before the bubble being bubbled to the maximum to make the liquid flow path having the bubble generating area essentially closed spaces with the exception of the discharge port.

Also, the liquid discharge method of the invention that uses a liquid discharge head provided with a heating member for generating thermal energy to create bubble in liquid; a discharge port forming the portion to discharge the liquid; and a liquid flow path communicated with the discharge port having a bubble generating area for enabling liquid to create bubble, and with energy at the time of bubble creation, the liquid being discharged from the discharge port, comprises the steps of discharging the liquid from the discharge port in the state of the liquid column by creating the bubble in the liquid by the application of the thermal energy; making the amount of liquid shift to the bubble generating area larger on the downstream side than the upstream side in the bubble generating area in the earlier stage of bubble disappearing before the liquid column is separated; and drawing the meniscus into the discharge port to separate the liquid column for the formation of the liquid droplet.

Also, in order to achieve the objectives discussed above, the liquid discharge heads of the invention are designed as follows:

A liquid discharge head comprises heating members for generating thermal energy to create bubbles in liquid; discharge ports forming the portions to discharge the liquid; liquid flow paths communicated with the discharge ports, at the same time, having bubble generating areas for enabling liquid to create bubbles; movable members arranged in the bubble generating areas to be displaced along with the development of the bubbles; and regulating portions to regulate the displacement of each of the movable members within a desired range, and with energy at the time of bubble creation, the liquid being discharged from the discharge ports. Then, the area connecting the range from the end of the heating member on the discharge port side to be central portion with the center of the discharge port is in the linearly communicated state where only the liquid can be present, and the free end of the movable member is positioned to face the central portion of the bubble generating area when the movable member is on standby, and then, with the essential contact of the free end with the regulating portion, the component of the maximum bubble on the upstream side is formed substantially in a uniform state by producing the maximum flow path resistance of the flow path on the upstream side of the bubble generating area.

Also, a liquid discharge head comprises a heating member for generating thermal energy to create bubble in liquid; a discharge port forming the portion to discharge the liquid; a liquid flow path communicated with the discharge port and having a bubble generating area for enabling liquid to create bubble; a movable member arranged in the bubble generating area to be displaced along with the development of the bubble; and a regulating portion to regulate the displacement of the movable member within a desired range, and with energy at the time of bubble creation, the liquid being discharged from the discharge port. Then, for this liquid discharge head, the regulating portion is arranged above the bubble generating area in the liquid flow path, and bubble carrying mechanism is provided to carry bubble in the liquid flow path by creating liquid flow from the gap between the movable member and the regulating portion along the liquid flow path facing the heating member in the disappearing process of the bubble.

Also, a liquid discharge head comprises a heating member for generating thermal energy to create bubble in liquid; a discharge port forming the portion to discharge the liquid; a liquid flow path communicated with the discharge port and having a bubble generating area for enabling liquid to create bubble; a movable member arranged in the bubble generating area to be displaced along with the development of the bubble; and a regulating portion to regulate the displacement of the movable member within a desired range, and with energy at the time of bubble creation, the liquid being discharged from the discharge port. Then, with the essential contact of the movable member with the regulating portion, the liquid flow path having the bubble generating area of this liquid discharge head become essentially closed space with the exception of the discharge port, and when the movable member opens the essentially closed spaces, liquid flows in the bubble generating areas, and the flowing-in liquid join the liquid shifting to the heating member side along with disappearing in the area between the discharge port and the heating member.

Also, a liquid discharge head comprises a heating member for generating thermal energy to create bubble in liquid; a discharge port forming the portion to discharge the liquid; a liquid flow path communicated with the discharge port and having a bubble generating area for enabling liquid to create bubble; a movable member arranged in the bubble generating area to be displaced along with the development of the bubble; and a regulating portion to regulate the displacement of the movable member within a desired range, and with energy at the time of bubble creation, the liquid being discharged from the discharge port. For this liquid discharge head, preliminary displacing means is provided for displacing the movable member independent of the development of the bubble, and the regulating portion is arranged to face the bubble generating area in the liquid flow path, and with the essential contact of the movable member with the regulating portion, the liquid flow path having the bubble generating area become essentially closed space with the exception of the discharge port, and when the movable member opens the essentially closed space.

Also, a liquid discharge head comprises a heating member for heating liquid in a liquid flow path to create bubble in the liquid; a discharge port communicated with the downstream side of the liquid flow path for discharging the liquid by the pressure along with the development of the bubble; a movable member arranged in the liquid flow path in a cantilever fashion supporting one end thereof with the free end positioned on the discharge port side; a regulating portion to regulate the displacement of the movable member by being essentially in contact with the movable member when the movable member is displaced along with the development of the bubble to close the upstream side of the liquid flow path substantially; and controlling means for controlling the driving of the heating members. For this liquid discharge head, the controlling means performs the driving of the heating member for the next liquid discharge during the movable member is displaced in the direction toward the displaced state before the vibrations of the movable member is settled completely in being restored from the displaced state subsequent to the last liquid discharge when liquid is discharged from the same liquid path continuously.

Also, a liquid discharge head comprises a heating member for heating liquid in a liquid flow path to create bubble in the liquid; a discharge port communicated with the downstream side of the liquid flow path for discharging the liquid by the pressure along with the development of the bubble; a movable member arranged in the liquid flow path in a cantilever fashion supporting one end thereof with the free end positioned on the discharge port side; regulating portions to regulate the displacement of the movable member by being essentially in contact with the movable member when the movable member is displaced along with the development of the bubble to close the upstream side of the liquid flow path substantially; and controlling means for controlling the driving of the heating member. For this liquid discharge head, the controlling means performs the driving of the heating member for the next liquid discharge during the movable member is displaced in the direction toward the initial state before the vibrations of the movable member is settled completely in being restored from the displaced state subsequent to the last liquid discharge when liquid is discharged from the same liquid path continuously.

Also, a liquid discharge head comprises a discharge port for discharging liquid; a liquid flow path communicated with the discharge port and having a bubble generating area for enabling liquid to create bubble; a movable member arranged in the liquid flow path to face the bubble generating area, having a free end on the downstream side with respect to the liquid flow in the direction toward the discharge port; and a fluid control portion arranged in the vicinity of upstream side end or on the more upstream than the upstream side end of the bubble generating area facing the bubble generating means in the liquid flow paths to control the liquid flow from the discharge ports toward the bubble generating area, and the movable member being essentially in contact with the fluid control portion by the displacement of the movable member along with the development of bubble in the bubble generating area.

Also, in order to achieve the objectives discussed above, the liquid discharge methods of the invention are as follows:

A liquid discharge method that uses a liquid discharge head provided with a heating member for generating thermal energy to create bubble in liquid; a discharge port forming the portion to discharge the liquid; a liquid flow path communicated with the discharge port and having a bubble generating area for enabling liquid to create bubble; a movable member arranged in the bubble generating area to be displaced along with the development of the bubble; and a regulating portion to regulate the displacement of the movable member within a desired range, and with energy at the time of bubble creation, the liquid being discharged from the discharge port. For this liquid discharge method, the area connecting the range of the heating member from the discharge side end to the central portion with the center of the discharge port is in the linearly communicated state where only liquid can be present, and the movable member having the free end positioned to face the central portion of the bubble generating area when the movable member is on standby, and with the free end being essentially in contact with the regulating portion, the maximum flow path resistance is formed in the flow path on the upstream side to discharge the liquid in the state of the component of the maximum bubble on the upstream side being uniformalized substantially.

Also, a liquid discharge method that uses a liquid discharge head provided with a heating member for generating thermal energy to create bubble in liquid; a discharge port forming the portion to discharge the liquid; a liquid flow path communicated with the discharge port and having a bubble generating area for enabling liquid to create bubble; a movable member arranged in the bubble generating area to be displaced along with the development of the bubble; and a regulating portion to regulate the displacement of the movable members within a desired range, and with energy at the time of bubble creation, the liquid being discharged from the discharge port, and also, the regulating portion being arranged above the bubble generating area in the liquid flow path, comprises the step of shifting the bubble in the liquid flow path by creating the liquid flow from the gap between the movable member and the regulating member along the plane facing the heating member at the time of disappearing the bubble.

Also, a liquid discharge method that uses a liquid discharge head provided with: a heating member for generating thermal energy to create bubble in liquid; a discharge port forming the portion to discharge the liquid; a liquid flow path communicated with the discharge port and having a bubble generating area for enabling liquid to create bubble; a movable member arranged in the bubble generating area to be displaced along with the development of the bubbles; and a regulating portion to regulate the displacement of the movable member within a desired range, and with energy at the time of bubble creation, the liquid being discharged from the discharge port, comprises the steps of forming substantially closed space in the liquid flow path having the bubble generating area therein with the exception of the discharge port when the movable member is essentially in contact with the regulating portion before the bubble is bubbled to the maximum; enabling liquid to flow into the bubble generating area when the movable member opens the substantially closed space; and joining the flowing-in liquid with liquid shifting to the heating member side along with disappearing bubble in the area between the discharge port and the heating member.

Also, a liquid discharge method that uses a liquid discharge head provided with a heating member for generating thermal energy to create bubble in liquid; a discharge port forming the portion to discharge the liquid; and a liquid flow path communicated with the discharge port and having a bubble generating area for enabling liquid to create bubble, and with energy at the time of bubble creation, the liquid being discharged from the discharge port, comprises the step of joining fluid shifting from the discharge port side to the heating member side along with the disappearing of the bubble with fluid shifting from the upstream side of the heating member to the discharge port side between the discharge port and the heating member.

Also, a liquid discharge method that uses a liquid discharge head provided with a heating member for generating thermal energy to create bubble in liquid; a discharge port forming the portion to discharge the liquid; a liquid flow path communicated with the discharge port and having a bubble generating area for enabling liquid to create bubble; a movable member arranged in the bubble generating area to be displaced along with the development of the bubble; and a regulating portion to regulate the displacement of the movable member within a desired range, and with energy at the time of bubble creation, the liquid being discharged from the discharge port, comprises the steps of providing preliminary displacing means for the liquid discharge head for displacing the movable member independent of the development of bubble, and displacing the movable member using the preliminary displacing means before the development of bubble; and placing the movable member to be in contact with the regulating portion before the bubble being bubbled to the maximum to make the liquid flow path having the bubble generating area essentially closed space with the exception of the discharge port.

Also, a liquid discharge method comprises the steps of heating liquid in a liquid flow path to create bubble in the liquid for the development thereof; displacing a movable member in a cantilever fashion supporting one end thereof in the liquid flow path from the initial state thereof along with the development of bubble; closing the upstream side of the liquid flow path with the movable member when the bubble presents the maximum volume thereof, and discharging the liquid from the discharge port by pressure along with the development of bubble; and restoring the movable member to the initial state from the displaced state along with the disappearing of the bubble after the discharge of liquid. For this liquid discharge method, the driving of the heating member is initiated for the next liquid discharge during the movable member is displaced in the direction toward the displaced state before the vibrations of the movable member is settled completely in being restored from the displaced state subsequent to the last liquid discharge when liquid is discharged from the same liquid path continuously.

Also, a liquid discharge method comprises the steps of heating liquid in a liquid flow path to create bubble in the liquid for the development thereof; displacing a movable member in a cantilever fashion supporting one end thereof in the liquid flow path from the initial state thereof along with the development of bubble; closing the upstream side of the liquid flow path with the movable member when the bubble presents the maximum volume thereof, and discharging the liquid from the discharge port by pressure along with the development of bubble; and restoring the movable member to the initial state from the displaced state along with the disappearing of the bubble after the discharge of liquid. For this liquid discharge method, the driving of the heating member is initiated for the next liquid discharge during the movable member is displaced in the direction toward the initial state before the vibrations of the movable member is settled completely in being restored from the displaced state subsequent to the last liquid discharge when liquid is discharged from the same liquid path continuously.

Also, a liquid discharge method comprises the steps of using a liquid discharge head having the fluid controlling portion as referred to in the preceding paragraph; and dispersing the flow of liquid on the upstream side of the fluid control portion in the bubble disappearing process when the movable member parts from the fluid control portion.

Also, in order to achieve the objectives discussed above, the liquid discharge apparatus of the invention comprises a liquid discharge head as referred to in any one of the preceding paragraphs of this summary in which the liquid discharge head of the present invention is particularly described; and means for carrying a recording medium to carry the recording medium that receives liquid discharged from the liquid discharge head.

With the valve mechanism of the movable members of the liquid discharge head of the present invention, it possible to suppress the back waves, that is, the liquid shift in the upstream direction along with the pressure waves in the direction toward the upstream side, and at the same time, with the meniscus which is drawn into the discharge port rapidly, it becomes possible to prevent the satellites, hence stabilizing the discharge amount of liquid for the enhancement of the quality of prints.

Particularly, with the structure designed for the present invention where the trailing portion that forms the liquid column by being connected with the discharged liquid droplet is cut off from the meniscus quickly, the stabilization of the liquid droplet formation can be attained, hence making the higher quality recording possible.

Other objectives and advantages besides those discussed above will be apparent to those skilled in the art from the description of a preferred embodiment of the invention which follows. In the description, reference is made to accompanying drawings, which form a part hereof, and which illustrate an example of the invention. Such example, however, is not exhaustive of the various embodiments of the invention, and therefore reference is made to the claims which follow the description for determining the scope of the invention.

In this respect, the term "upstream" and the term "downstream" used in the description of the present invention relates to the direction of the liquid flow toward the discharge ports from the supply source of the liquid by way of each of the bubble generation areas (or each of the movable members) or represented as expressions related to the structural directions.

Also, the terms "downstream side" related to the bubble itself means the downstream side in the flow direction described above or in the structural directions described above, or it means the bubble created in the area on the downstream side of the area center of each heating member. Likewise, the term "upstream side" related to the bubble itself means the upstream side in the flow direction described above or in the structural directions described above, or it means the bubble created in the area on the upstream side of the area center of each heating member.

Also, the expression "essentially in contact" between each of the movable members and the regulating portions used for the present invention may be the approaching state where liquid of approximately several $\mu$m exists between each of them or the state where each of the movable members and the regulating portions are directly in contact.

BRIEF DESCRIPTION OF THE DRAWINGS

FIG. 17A shows the one having a protection film. FIG. 17B shows the one having no protection film.

DETAILED DESCRIPTION OF THE PREFERRED EMBODIMENTS

Figure 1A:
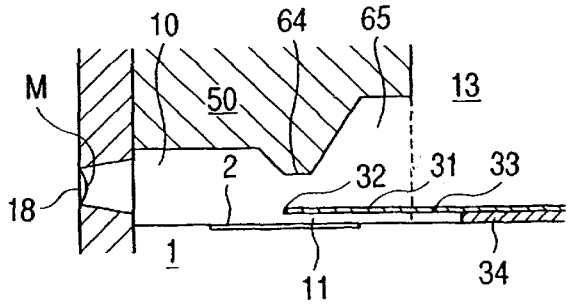
FIGS. 1A, 1B, 1C, 1D, 1E and 1F are cross-sectional views which illustrate the liquid discharge head in accordance with one embodiment of the present invention, taken along in the liquid flow path direction, and which illustrate the characteristic phenomena in the liquid flow paths by dividing the process into FIGS. 1A, 1B, 1C, 1D, 1E and 1F.

Hereinafter, with reference to the accompanying drawings, the description will be made of the embodiments in accordance with the present invention.

FIGS. 1A to 1F are cross-sectional views which illustrate the liquid discharge head in accordance with one embodiment of the present invention, taken along in the liquid flow path direction, and which illustrate the characteristic phenomena in the liquid flow paths by dividing the process into FIGS. 1A to 1F.

For the liquid discharge head of the present embodiment, the heating members 2 are arranged on a flat and smooth elemental substrate 1 to enable thermal energy to act upon liquid as discharge energy generating elements to discharge liquid. Then, on the elemental substrate 1, liquid flow paths 10 are arranged corresponding to the heating members 2, respectively. The liquid flow paths 10 are communicated with the discharge ports 18, and at the same time, communicated with the common liquid chamber 13 to supply liquid to a plurality of liquid flow paths 10, hence receiving from the common liquid chamber 13 an amount of liquid that correspond to that of the liquid which has been discharged from each of the discharge ports 18. A reference mark M designates the meniscus formed by the discharge liquid. The meniscus M is balanced in the vicinity of the discharge ports 18 with respect to the inner pressure of the common liquid chamber 13 which is usually negative by means of the capillary force generated by each of the discharge ports 18 and the inner wall of the liquid flow path 10 communicated with it.

The liquid flow paths 10 are structured by bonding the elemental substrate 1 provided with the heating members 2, and the ceiling plate 50, and in the area near the plane at which the heating members 2 and discharge liquid are in contact, the bubble generation area 11 is present where the heating members 2 are rapidly heated to enable the discharge liquid to form bubbles. For each of the liquid flow paths 10 having the bubble generation area 11, respectively, the movable member 31 is arranged so that at least a part thereof is arranged to face the heating member 2. The movable member 31 has its free end 32 on the downstream side toward the discharge port 18, and at the same time, it is supported by the supporting member 34 arranged on the upstream side. Particularly, in accordance with the present embodiment, the free end 32 is arranged on the central portion of the bubble generation area 11 in order to suppress the development of a half of the bubble on the upstream side which exerts influences on the back waves toward the upstream side and the inertia of the liquid. Then, along with the development of the bubble created in the bubble generation area 11, the movable member 31 can be displaced with respect to the supporting member 34. The fulcrum 33 for this displacement is the supporting portion of the movable member 31 by the supporting member 34.

Above the central portion of the bubble generation area 11, the stopper (regulating portion) 64 is positioned to regulate the displacement of the movable member 31 within a certain range in order to suppress the development of a half of the bubble on the upstream side. In the flow from the common liquid chamber 13 to the discharge port 18, there is arranged a lower flow path resistance area 65, which presents the relatively lower flow path resistance than the liquid flow path 10, on the upstream side with the stopper 64 as the boundary. The flow path structure in the area 65 is such as to provide no upper wall or to make the flow path sectional area larger, hence making the resistance that liquid receives from the flow path smaller when the liquid moves.

With the structure arranged as above, the head structure is proposed, which is characterized in that unlike the conventional art, each of the liquid flow paths 10 having the bubble generation area 11 becomes an essentially closed space by the contact between the displaced movable member 31 and the stopper 64 with the exception of each of the discharge ports 18.

Now, detailed description will be made of the discharge operation of the liquid discharge head in accordance with the present embodiment.

FIG. 1A shows the state before the energy, such as the electric energy, is applied to the heating member 2, which illustrates the state before the heating member generates heat. What is important here is that the movable member 31 is positioned to face a half of the bubble on the upstream side for each of the bubbles created by the heating of the heating member 2, and the stopper 64 that regulates the displacement of the movable member 31 is arranged above on the central portion of the bubble generation area 11. In other words, with the structure of the flow paths and arrangement position of each of the movable members, a half of the bubble on the upstream side is held down to the movable member 31.

Figure 1B:
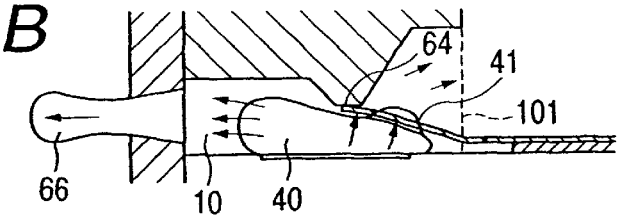

FIG. 1B shows the state in which a part of the liquid filled in the bubble generation area 11 is heated by the heating member 2 so that the bubble 40 is developed almost to the maximum following the film boiling. At this juncture, the pressure waves generated by the creation of the bubble 40 are propagated in the liquid flow path 10, and along with it, the liquid moves to the downstream side and the upstream side with the central area of the bubble generation area as its boundary. Then, on the upstream side, the movable member 31 is displaced by the flow of liquid along with the development of the bubble 40. On the downstream side, the discharged liquid droplet 66 is being discharged from the discharge port 18. Here, the movement of liquid on the upstream side, that is, toward the common liquid chamber 13, becomes a greater flow by the presence of the lower flow path resistance area 65 where the liquid can move easily because of the lower resistance of the flow path than the downstream side with respect to the movement of the liquid. However, when the movable member 31 is displaced as close as to the vicinity of the stopper 64 or to be in contact with the stopper, any further displacement is regulated. Then, the movement of the liquid toward the upstream is restricted greatly, hence the development of the bubble 40 to the upstream side is also restricted accordingly by the movable member 31. In this way, the maximum flow path resistance is formed on the upstream side rather than in the bubble generation area on the flow path to make it possible to almost uniformalize the development of the bubble on the upstream side. With the structure thus arranged, the formation of the discharge liquid droplets is made more stably, at the same time, improving the characteristic itself which is dependent on the response frequency.

Also, at this juncture, the shifting force of the liquid is greater in the upstream direction to cause the movable member 31 to receive a greater stress in the form of being pulled toward the upstream side. Further, a part of the bubble 40 whose development is restricted by the movable member 31 passes the slight gaps between the sides of the movable member 31 and the walls on both sides formed by each of the liquid flow paths 10 to be extruded to the upper side of the movable member 31. The bubble thus being extruded is termed as the "extruded bubble 41" in the specification hereof.

In this state, the entire configuration of the liquid flow paths to the discharge port side is made wider from the upstream side to the downstream side as its structure that contains the movable member 31.

In accordance with the present invention, the straight flow path structure is kept between the portion of the bubble 40 on the discharge port side, and the discharge port, that is, the structure is in the "linearly communicated state" as shown in FIGS. 11A to 11E. More preferably, this state is made such as to enable the propagating direction of the pressure waves generated at the time of bubble creation to be in agreement linearly with the flow direction of the liquid, as well as with the discharge direction thereof, following the pressure waves thus generated. It is desirable to attain the ideal state in this manner so as to stabilize at an extremely high level the discharge condition of the discharged liquid droplets 66, such as the discharge direction and the discharge speed thereof. For the present invention, it should be good enough as one of the definitions to attain this ideal state or approximate the structure to be in the ideal state if only the structure is arranged to directly connect on the straight line the discharge port 18 with the heating member 2 (particularly, with the heating member on the discharge port side (on the downstream side) which is more influential on bubbling). The state thus obtained can be observed from the outside of the discharge port if no liquid is present in the flow path. Particularly, the downstream side of the heating member is made observable in this state. Also, among such structures, it is more preferable from the viewpoint of the stabilization of discharge direction to arrange the structure so that the extended line of the discharge axis of the discharge port intersects the center of the heating member.

On the other hand, as described earlier, the displacement of the movable member 31 is regulated by the presence of the stopper 64 for the portion of the bubble 40 on the upstream side. Therefore, this portion of the bubble is made smaller just to be in the state where it stays to charge the stress by the movable member 31 which is bent to be extruded toward the upstream side by the inertia of the liquid flow to the upstream side. For this portion as a whole, the amount which enters the area on the upstream side by means of the stopper, the liquid flow path partition walls 101, the movable member 31, and the fulcrum 33 is made almost zero (however, each of the gaps between the movable member 31 and the liquid flow path partition walls 101 is made allowable to create the bubble which is partly extruded through the space of 10 $\mu$m or less each).

In this way, the liquid flow to the upstream side is largely regulated to prevent the liquid cross talks with the adjacent nozzles and the reversed liquid flow in the supply system which may impede the higher refilling to be described later, as well as to prevent pressure vibrations.

Figure 1C:
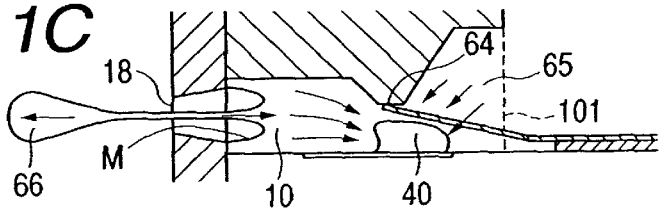

FIG. 1C shows the state where the contraction of the bubble 40 begins when the negative pressure in the interior of the bubble has overcome the shifting of the liquid to the downstream side in the liquid flow path subsequent to the film boiling described earlier. At this juncture, the force of the liquid which is exerted by the development of the bubble still remains largely in the upstream side. Therefore, the movable member 31 is still in contact with the stopper 64 for a specific period after the contraction of the bubble 40 has begun, and the most of the contracted bubble 40 exerts the shifting force of liquid in the upstream direction from the discharge port 18. In the state shown in FIG. 1B, since the movable member 31 is in the condition to charge the extrusive stress which is bent to the upstream side, the movable member itself exerts the force to make it concave in the upstream direction by drawing the liquid flow from the side where the stress is released, that is, the upstream side as shown in FIG. 1C. As a result, at a certain point, the force that draws the movable member back in direction from the upstream side overcomes the shifting force of liquid in the upstream side as described earlier to make it possible to begin, although slightly, to flow from the upstream side to the discharge port side. Then, the bending of the movable member 31 is reduced to begin effectuating the displacement to be in concave in the upstream direction. In other words, the imbalanced condition takes place for the bubble 40 on the upstream side and the downstream side, which creates one-way flow of the liquid as a whole temporarily in the direction towards the discharge port in the liquid flow path.

At the timing immediately after that, the displaced movable member 31 is still in contact with the stopper 64 in the interior of the flow path as a whole. Therefore, the liquid flow path 10 having the bubble generation area 11 in it is essentially in the closed space with the exception of the discharge port 18. Then, the energy exerted by the contraction of the bubble 40 is allowed to act strongly as a force in terms of the total balance thereof, and to enable the liquid in the vicinity of the discharge port 18 to shift in the upstream direction. Consequently, the meniscus M is largely drawn back from the discharge port 18 to the interior of the liquid flow path 10 to quickly cut off the liquid column which is connected with the discharged liquid droplet 66. Then, as shown in FIG. 1D, the resultant satellite (sub-droplets) 67 becomes smaller, which remains on the outer side of the discharge port 18.

Figure 1D:
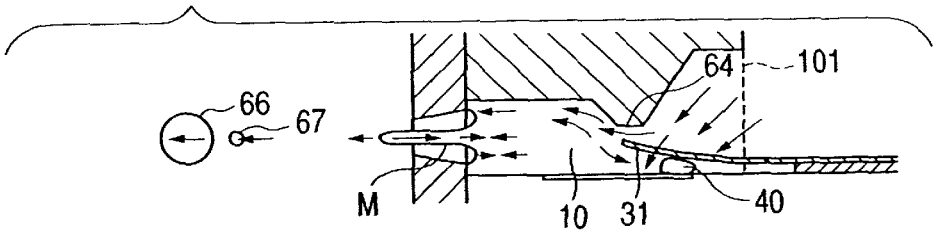

FIG. 1D shows the state where the meniscus M and the discharged liquid droplet 66 are cut off when the disappearing process is almost completed. In the lower flow path resistance area 65, the movable member 31 begins to be displaced downward. Also the flow begins to run in the downstream direction in the lower flow path resistance area 65 following such displacement of the movable member due to the resiliency of the movable member 31 against the shifting force of liquid in the upstream direction, and the contracting force exerted by the disappearing bubble 40 as well. Then, the close approach or the contact between the movable member 31 and the stopper 64 begin to be released. Along with this, the flow in the downstream direction in the lower flow path resistance area 65, which has a smaller flow path resistance, becomes a larger flow rapidly, and flows into the liquid flow path 10 through the stopper 64 portion. As a result, the flow that causes the meniscus M to be drawn into the interior of the liquid flow path 10 is reduced abruptly. The meniscus M begins to return in a comparatively slow speed to the position at which the bubbling is originated, while drawing the liquid column, which remains outside the discharge port 18 or which is extruded in the discharge port 18 direction, without cutting it off as much as possible. Particularly, by the returning flow for the meniscus M and the refilling flow from the upstream, which are joined together, the area having almost zero flow rate is formed between the discharge port 18 and the heating member 2, hence making the settling performance of meniscus better. This performance depends on the viscosity and the surface tension of ink, but in accordance with the present invention, it becomes possible to drastically reduce the satellites which are separated from the liquid column to degrade the quality of images when adhering to a printed object or to produce adverse effects on the discharge direction to cause the disabled discharge when adhering to the circumference of the orifices.

Also, the meniscus M itself begins to be restored before it is largely drawn into the interior of liquid flow path. Therefore, the restoration is completed within a short period of time despite the speed of liquid shift itself which is not very high. As a result, the overshooting of the meniscus, that is, the amount thereof which is extruded outside the discharge port 18 without stopping at the discharge port 18, is reduced. Then, in an extremely short period of time, it becomes possible to eliminate the phenomenon of the attenuating vibrations having its settling point at the discharge port 18 from which the overshooting is made. This phenomenon of the attenuating vibrations also produces adverse effects on the print quality. With the quicker elimination of this phenomenon, the present invention is designed to contribute significantly to the implementation of the stabilized higher printing. Also, in the liquid flow path 10 of the liquid discharge head, a dissolved bubble or a bubble yet to be defoamed after bubbling may remain residing in the liquid like a bubble 68 in some cases (see FIGS. 3A to 3F). If this bubble 68 should be developed to occupy a large volume in the liquid flow path 10, the reduction of the discharge amount or disabled discharge may take place. In some cases, there is a fear that energy is continuously applied to the heating member 2 without the presence of liquid, and that the breakage of lines to the heating member 2 is invited ultimately. For the liquid discharge heat of the present embodiment, however, the stopper 64 is arranged to suppress the flow in the liquid flow path 10 to the ceiling side when the meniscus M is restored. Also, with the displaced movable member 31 displaced to the ceiling side in the liquid flow path 10, the liquid begins to shift radially from the stopper 64 in the direction toward the discharge port 18. Hence, the liquid flow begins along the ceiling (the plane that faces the heating member 2) of the liquid flow path 10.

In this way, there is provided the bubble shifting mechanism for the liquid discharge head of the present embodiment, which is arranged to shift the bubble in the liquid flow path 10 by generating the liquid flow along the plane that faces the heating member 2 in the liquid flow path 10 from the gap between the stopper 64 and the movable member 31 when the bubble 40 is in the disappearing process.

As shown in FIG. 1D, the flow into the liquid flow path 10 through the gap between the movable member 31 and the stopper 64 makes the flow rate faster on the wall face on the ceiling plate 50 side. As a result, the residual fine bubbles on this portion is made extremely smaller, which significantly contributes to the implementation of the stabilized discharges.

On the other hand, among those satellites 67 residing immediately after the discharged liquid droplet 66, there are some which are extremely close to the discharged liquid droplet due to the rapid meniscus drawing as shown in FIG. 1C. Here, the so-called slip stream phenomenon is created, which causes the satellite, which closely follows the discharged liquid droplet, to be attracted to it due to the eddy current occurring behind the flying discharged liquid droplet 66.

Now, this phenomenon will be described precisely. With the conventional liquid discharge head, the liquid droplet is not in the spherical form the moment liquid is discharged from the discharge port of the liquid discharge head. The liquid droplet is discharged almost in the form of a liquid column having it spherical part on the leading end thereof. Thus, the trailing portion is tensioned both by the main droplet and the meniscus, and when it is cut off from the meniscus, the satellite dots are formed with the trailing portion. Here, it is known that the satellites fly to a recording medium together with the main droplet. The satellites fly behind the main droplet, and also, the satellites are drawn by the meniscus. Therefore, the discharge speed thereof is slower to that extent to cause its impacted position to be deviated from that of the main droplet. This inevitably degrades the quality of prints. In accordance with the liquid discharge head of the present invention, the force that draws back the meniscus is much greater than the conventional liquid discharge head as described earlier. Thus, the drawing force given to the trailing portion is stronger after the main droplet has been discharged. The force with which the trailing portion is cut from the meniscus becomes stronger accordingly to make its timing faster. As a result, the satellite dots which are formed from the trailing portion become much smaller, and the distance between the main droplet and satellite dots is also made shorter. Further, since the trailing portion is not drawn by meniscus continuously for a longer period, the discharge speed does not become slower. Hence, the satellites 67 are drawn to the main droplet by the slip stream phenomenon occurring behind the discharged liquid droplet 66.

Figure 1E:
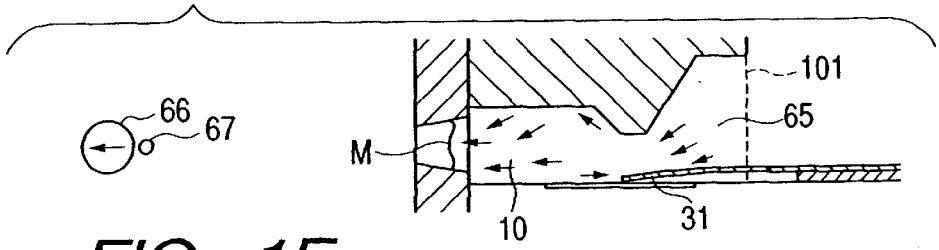

FIG. 1E shows the condition where the state illustrated in FIG. 1D has further advanced. Here, the satellite 67 is still closer to the discharged liquid droplet 66, at the same time, being drawn to it. Then, the drawing force exerted by the slip stream phenomenon becomes greater. On the other hand, the liquid shift from the upstream side in the direction toward the discharge port 18 is displaced downward more than the initial position due to the completion of the disappearing process of the bubble 40 and the displacement overshoot of the movable member 31. Then, the resultant phenomenon takes place to draw liquid from the upstream side and push out liquid in the direction toward the discharge port 18. Further, by the expansion of the sectional area of the liquid flow path due to the presence of the stopper 64, the liquid flow is increased in the direction toward the discharge port 18 to enhance the restoring speed of the meniscus M to the discharge port 18. In this manner, the refilling characteristic of the present embodiment is drastically improved.

Also, since the movable member 31 is displaced downward when the cavitation occurs with the disappearing bubble, the disappearing point and the discharge port 18 are separated. Thus, the movable member 31 absorbs much of the impulsive waves created by the cavitation without being transferred directly to the discharge port 18. There is almost no possibility that the ultrafine droplets called "microdots" are created from the meniscus when the impulsive waves of the cavitation reaches the meniscus. Therefore, the quality of printed images is not lowered by the adhesion of the microdots or the phenomenon that the unstabilized discharged is caused by the adhesion thereof to the circumference of the discharge port 18 is drastically eliminated.

Further, the point where the cavitation occurs due to disappearing is deviated to the fulcrum 33 side by the presence of the movable member 31. As a result, damages to the heating member 2 become smaller. Also, the overviscose ink is compulsorily shifted from the closed area between the movable member 31 and the heating member 2 for its removal, hence enhancing the discharge durability. At the same time, it becomes possible to reduce the adhesion of the burnt ink on the heating member due to this phenomenon in this area, hence enhancing the stability of discharges.

Figure 1F:
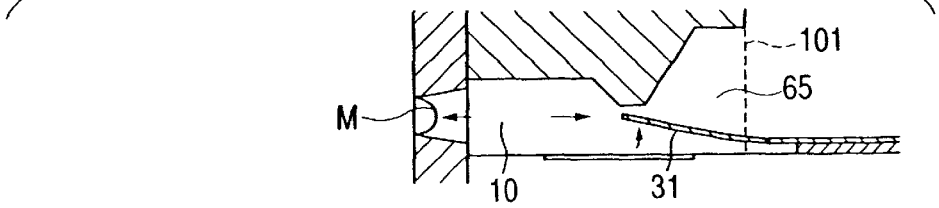

FIG. 1F shows the condition in which the state illustrated in FIG. 1E has further advanced, and the satellite 67 is caught into the discharged liquid droplet 66. The combined body of the discharged liquid droplet 66 and the satellite 67 is not necessarily the phenomenon that should occur under any circumstances per discharge for other embodiments. Depending on conditions, such phenomenon takes place or it does not take place at all. However, by eliminating the satellites or at least by reducing the amount of satellites, there is almost no deviation between the impact positions of the main droplet and the satellite dots on the recording medium so as to minimize the adverse effect that may be produced on the quality of prints. In other words, the sharpness of printed images is enhanced to improve the quality of prints, and at the same time, it becomes possible to avoid making them mists and reduce the occurrence of the damage that the mist thus created may stain the printing medium or the interior of the recording apparatus.

In the meantime, the movable member 31 is again displaced in the direction toward the stopper 64 due to the reaction of its overshooting. This displacement is suspended at the initial position lastly, because it is settled by the attenuating vibrations determined by the configuration of the movable member 31, the Young's modulus, the viscosity of liquid in the liquid flow path, and the gravity.

With the upward displacement of the movable member 31, the flow of liquid is controlled in the direction toward the discharge port 18 from the common liquid chamber 13 side. Then, the movement of the meniscus M is quickly settled on the circumference of the discharge port. As a result, it becomes possible to significantly reduce the factors that may degrade the quality of prints due to the overshooting phenomenon of the meniscus or the like that may unstabilize the condition of discharges.

Now, the description will be made more of the effects characteristic of the present embodiment.

Figure 2:
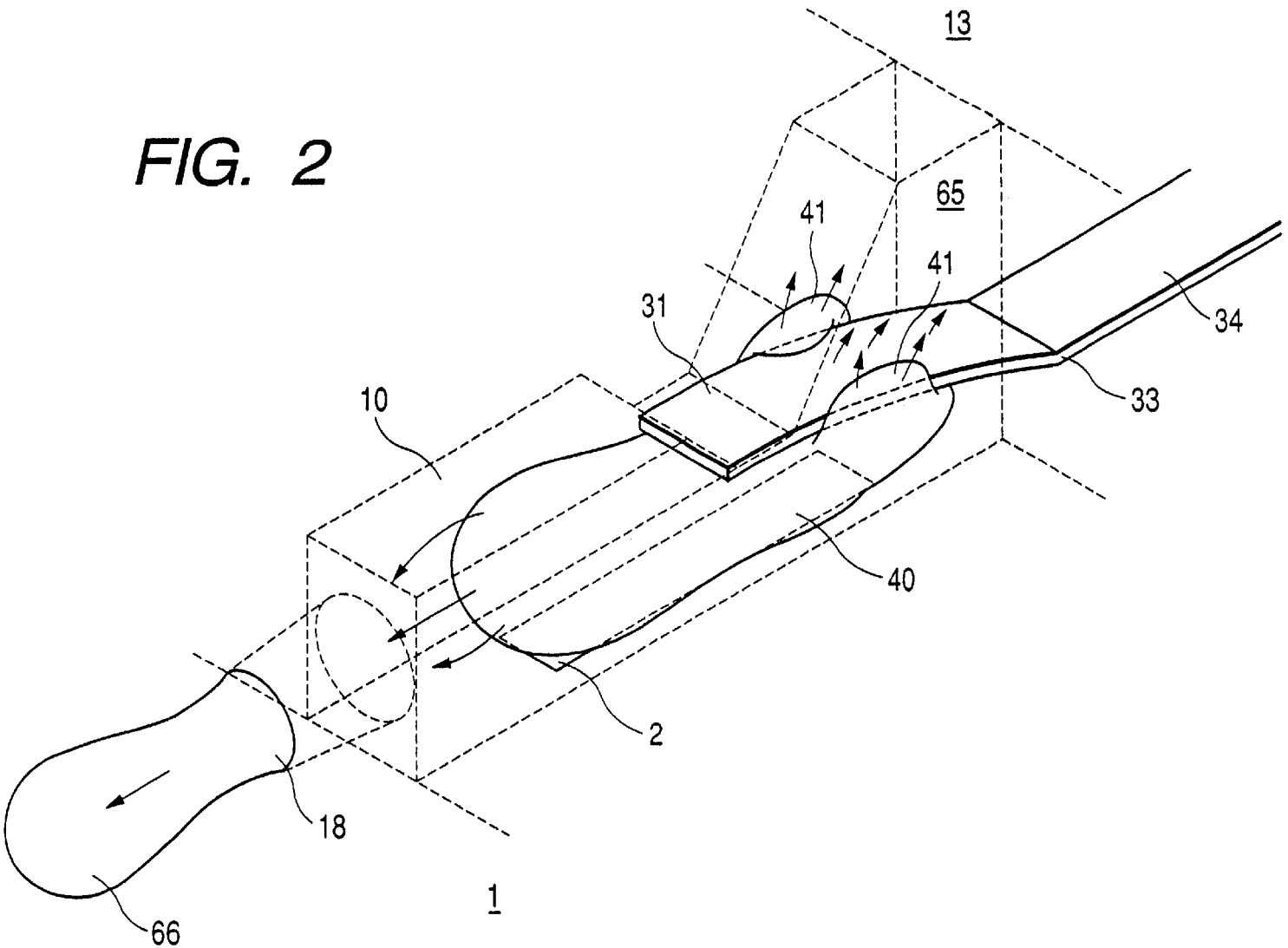
FIG. 2 is a perspective view which shows a part of the head represented in FIG. 1B.
Figure 3A:
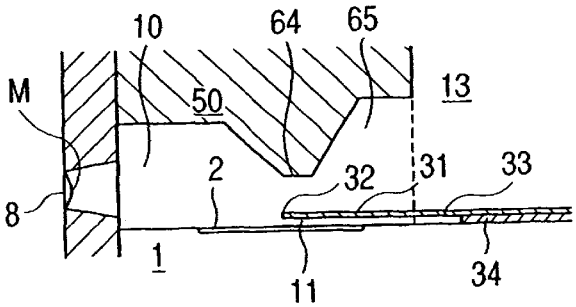
FIGS. 3A, 3B, 3C, 3D, 3E and 3F are cross-sectional views which illustrate the liquid discharge head in accordance with one embodiment of the present invention, taken along in the liquid flow path direction, and which illustrate the characteristic phenomena in the liquid flow paths by dividing the process into FIGS. 3A, 3B, 3C, 3D, 3E and 3F.
Figure 3B:
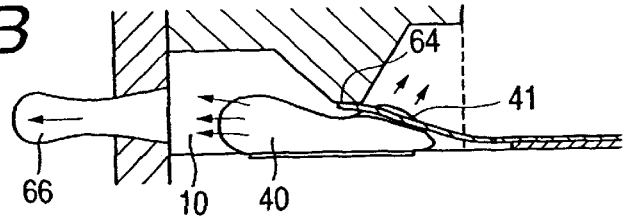
Figure 3C:
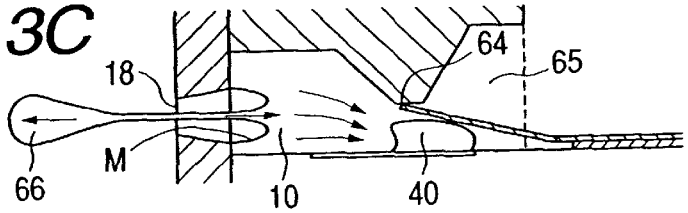
Figure 3D:
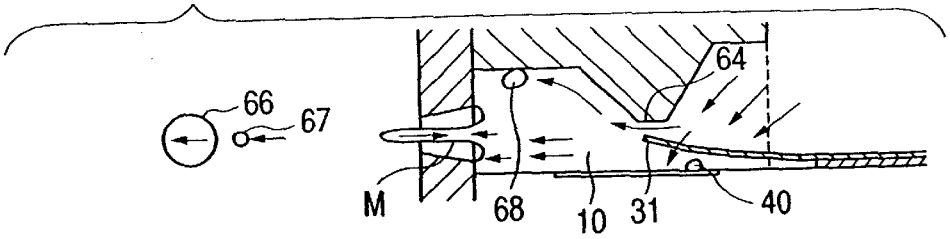
Figure 3E:
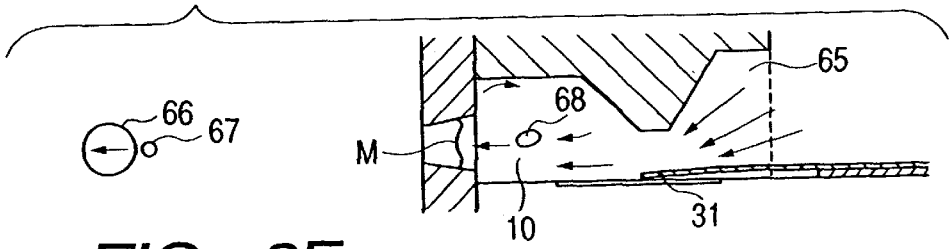
Figure 3F:
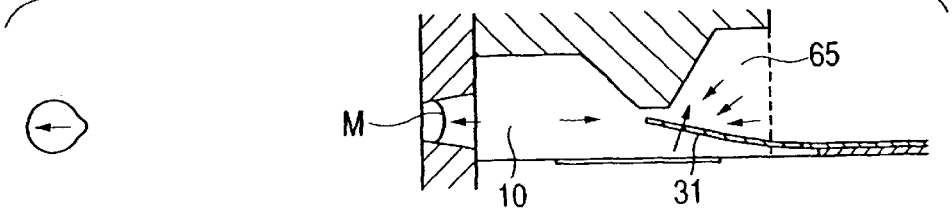

FIG. 2 is a perspective view which shows a part of the head represented in FIG. 1B, and which shows fundamentally the same state as that of FIG. 1B with the exception of the nozzle perspectively indicated by broken lines. In accordance with the present embodiment, there are slight clearances between both side faces of the wall that constitutes the liquid flow path 10 and both side portions of the movable member 31, hence making it possible to displace the movable member 31 smoothly. Further, in the development process of bubble by means of the heating member 2, the bubble 40 enables the movable member 31 to be displaced, and at the same time, the bubble is allowed to entire the lower flow path resistance area 65 slightly by being extruded to the upper face side of the movable member 31 through the aforesaid clearances. The extruded bubble 41 enters this area around the back of the movable member 31 (the surface opposite to the bubble generation area 11) so as to suppress the blurring of the movable member 31 for the stabilization of the discharge characteristics.

Further, in the disappearing process of the bubble 40, the extruded bubble 41 promotes the liquid flow from the lower flow path resistance area 65 to the bubble generation area 11 to complete the disappearing quickly in corporation with the high speed meniscus drawing from the discharge port 18 side as described earlier. Particularly, by the liquid flow which is created by means of the extruded bubble 41, there is almost no possibility that bubbles are allowed to reside on the corners of the movable member 31 and the liquid flow path 10.

With the liquid discharge head structured as described above, the discharged liquid droplet is almost in the form of the liquid column having the spherical portion at the leading end thereof the moment it is discharged from the discharge port by the creation of the bubble. This condition is the same as that of the head which is structured conventionally. However, in accordance with the present invention, the removable member is displaced by the development process of the bubble, and then, when the movable member thus displaced is in contact with the regulating member, an essentially closed space is formed for the liquid flow path having the bubble generation area in it with the exception of the discharge port. Therefore, if the bubble is defoamed in this state, the closed space is kept as it is until when the movable member is allowed by the disappearing to part from the regulating member. Thus, most of the disappearing energy of the bubble is allowed to act upon shifting the liquid in the vicinity of the discharge port in the upstream direction. as a result, immediately after the beginning of the bubble disappearing, the meniscus is rapidly drawn into the interior of the liquid flow path, and then, with the stronger force than the meniscus, it becomes possible to quickly cut off the trailing portion which forms the liquid column by being connected with the discharged liquid droplet outside the discharge port. In this manner, the satellite dots which are each formed by the trailing portion are made smaller, hence contributing to the enhancement of the quality of prints.

Further, since the trailing portion is not continuously drawn by the meniscus for a long time, the discharge speed is not affected to become slower. Also, the distance between the discharged liquid droplet and each of the satellite dots is made shorter so that the satellite is drawn closer to the discharged liquid droplet by the so-called slip stream phenomenon which takes place behind the flying droplet. As a result, the jointed body of the discharged liquid droplet and the satellite dots may be formed to make it possible to provide the liquid discharge head which may create almost no satellite dots.

Moreover, the present invention is characterized in that the movable member is arranged to suppress only the bubble which is developed in the upstream direction with respect to the liquid flow toward the discharge port of the aforesaid head. It is more preferable to position the free end of the movable member essentially on the central portion of the bubble generation area. With the structure thus arranged, it becomes possible to suppress the back waves to the upstream side and the inertia of the liquid by the development of the bubble, which is not directly related to the liquid discharges. At the same time, it becomes possible to direct the development component of the bubble on the downstream side easily in the direction toward the discharge port.

Further, the present invention is characterized in that for the aforesaid head, the flow path resistance of the liquid flow path on the side opposite to the discharge port is made lower with the aforesaid regulating member as the boundary. With the structure thus arranged, the liquid shifting in the upstream direction by the development of the bubble becomes a greater flow by the presence of the liquid flow path whose flow path resistance is made lower. As a result, when the displaced movable member is in contact with the regulating member, the movable member receives the stress which tends to draw it in the upstream direction. Therefore, if the disappearing begins in this state, the shifting force of liquid in the upstream direction by the development of the bubble still remains greatly to make it possible to keep the aforesaid closed space during a specific period until the resiliency of the movable member overcomes this force exerted by the liquid shift. In other words, with the structure thus arranged, it becomes more reliable to perform the high speed meniscus drawing. Also, when the disappearing process advances to enable the resiliency of the movable member to overcome the force of liquid shift in the upstream direction by the development of the bubble, the movable member is displaced downward in order to be restored to the initial state, hence creating the flow in the downstream direction along with this even in the lower flow path resistance area. Now that the flow in the downstream direction in the lower flow path resistance area has a smaller flow path resistance, this flow becomes a greater flow rapidly and flows in the liquid flow path through the regulating portion. As a result, by the flow shift in the downstream direction toward the discharge port, the meniscus drawing is abruptly suspended to settle the vibrations of the meniscus very quickly.

Second Embodiment

Hereinafter, with reference to the accompanying drawings, the description will be made of the present embodiment in accordance with the present invention.

FIGS. 4A to 4G are cross-sectional views which illustrate the liquid discharge head in accordance with a second embodiment of the present invention, taken along in the liquid flow path direction, and which illustrate the characteristic phenomena in the liquid flow paths by dividing the process into FIGS. 4A to 4G.

For the liquid discharge head of the present embodiment, the heating members 2 are arranged on a flat and smooth elemental substrate 1 to enable thermal energy to act upon liquid as discharge energy generating elements to discharge liquid. Then, on the elemental substrate 1, liquid flow paths 10 are arranged corresponding to the heating members 2, respectively. The liquid flow paths 10 are communicated with the discharge ports 18, and at the same time, communicated with the common liquid chamber 13 to supply liquid to a plurality of liquid flow paths 10, hence receiving from the common liquid chamber 13 an amount of liquid that correspond to that of the liquid which has been discharged from each of the discharge ports 18. A reference mark M designates the meniscus formed by the discharged liquid. The meniscus M is balanced in the vicinity of the discharge ports 18 with respect to the inner pressure of the common liquid chamber 13 which is usually negative by means of the capillary force generated by each of the discharge ports 18 and the inner wall of the liquid flow path 10 communicated with it.

The liquid flow paths 10 are structured by bonding the elemental substrate 1 provided with the heating members 2, and the ceiling plate 50, and in the area near the plane at which the heating members 2 and discharge liquid are in contact, the bubble generation area 11 is present where the heating members 2 are rapidly heated to enable the discharge liquid to form bubbles. For each of the liquid flow paths 10 having the bubble generation area 11, respectively, the movable member 31 is arranged so that at least a part thereof is arranged to face the heating member 2. The movable member 31 has its free end 32 on the downstream side toward the discharge port 18, and it is supported on the upstream side by the supporting member 33 and the piezo-element 35 arranged on the elemental substrate 1. The piezo-element 35 supports the end portion of the movable member 31 on the side opposite to the free end 32 through the fulcrum 33. Particularly, in accordance with the present embodiment, the free end 32 is arranged on the central portion of the bubble generation area 11 in order to suppress the development of a half of the bubble on the upstream side which exerts influences on the back waves toward the upstream side and the inertia of the liquid. Then, along with the development of the bubble created in the bubble generation area 11 or the shrinking deformation of the piezo-element 35, the movable member 31 can be displaced with respect to the supporting member 33.

Above the central portion of the bubble generation area 11, the stopper (regulating portion) 64 is positioned to regulate the displacement of the movable member 31 within a certain range in order to suppress the development of a half of the bubble on the upstream side. In the flow from the common liquid chamber 13 to the discharge port 18, there is arranged a lower flow path resistance area 65, which presents the relatively lower flow path resistance than the liquid flow path 10, on the upstream side with the stopper 64 as the boundary. The flow path structure in the area 65 is such as to provide no upper wall or to make the flow path sectional area larger, hence making the resistance that liquid receives from the flow path smaller when the liquid moves.

With the structure arranged as above, the head structure is formed, which is characterized in that unlike the conventional art, each of the liquid flow paths 10 having the bubble generation area 11 becomes an essentially closed space by the contact between the displaced movable member 31 and the stopper 64 with the exception of each of the discharge ports 18.

Now, detailed description will be made of the discharge operation of the liquid discharge head in accordance with the present embodiment.

Figure 4A:
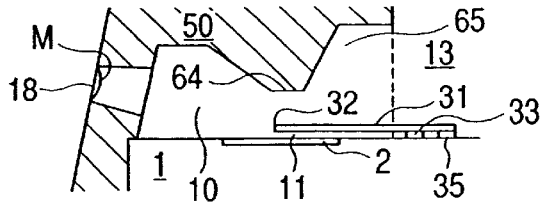
FIGS. 4A, 4B, 4C, 4D, 4E, 4F and 4G are cross-sectional views which illustrate the liquid discharge head in accordance with a second embodiment of the present invention, taken along in the liquid flow path direction, and which illustrate the characteristic phenomena in the liquid flow paths by dividing the process into FIGS. 4A, 4B, 4C, 4D, 4E, 4F and 4G.

FIG. 4A shows the state before the energy, such as the electric energy, is applied to the heating member 2, which illustrates the state before the heating member generates heat. What is important here is that the movable member 31 is positioned to face a half of the bubble on the upstream side for each of the bubbles created by the heating of the heating member 2, and the stopper 64 that regulates the displacement of the movable member 31 is arranged above on the central portion of the bubble generation area 11. In other words, with the structure of the flow paths and arrangement position of each of the movable members, a half of the bubble on the upstream side is held down to the movable member 31.

Figure 4B:
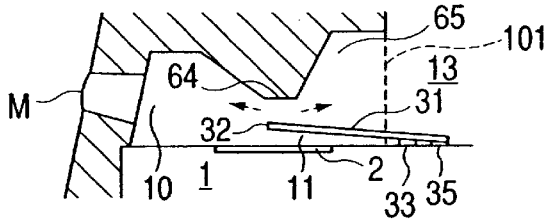

FIG. 4B shows the state in which the piezo-element 35, that is, preliminarily displacing means, is driven to displace the movable member 31 upward. With the shrinkage of the piezo-element 35 to the substrate 1 side, the movable member 31 is displaced upward by the leverage principle centering on the fulcrum 33. The driving of the piezo-element 35 and the displacement of the movable member 31 are slight so that liquid on the circumference of the bubble generation area 11 is caused to shift slightly to the upstream side and the downstream side, but the discharge liquid droplet is not caused to be discharged from the discharge port 18.

Figure 4C:
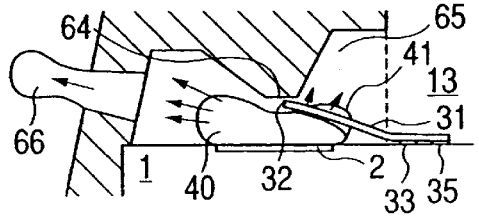

FIG. 4C shows the state where the bubble 40 has developed almost to its maximum along with the film boiling when a part of the liquid filled in the bubble generation area 11 is heated by the heating member 2 in the state that the movable member 31 is displaced upward as illustrated in FIG. 4B. At this juncture, the pressure waves based upon the creation of the bubble 40 are propagated in the liquid flow path 10, and along with this, the liquid in the liquid flow path 10 shifts to the downstream side and the upstream side with the central portion of the bubble generation area as the boundary. Then, on the upstream side, the movable member 31 is displaced by the liquid flow that follows the development of the bubble 40, and on the downstream side, the discharge liquid droplet 66 is being discharged from the discharge port 18. Here, the liquid shift to the upstream side, that is, toward the common liquid chamber 13, becomes a large flow by means of the lower flow path resistance area 65 which is the area where the liquid can easily flow because of the lower resistance that the liquid receives from the flow path than the resistance on the downstream side when it flows. However, when the movable member 31 has displaced until it approaches the stopper 64 or it is in contact with the stopper, any further displacement thereof is regulated, hence restricting the liquid shift to the upstream side largely at that point. Nevertheless, since the shifting force of the liquid in the direction toward the upstream side is great, the movable member 31 receives the stress in the form that it is pulled in the upstream direction. Further, a part of the bubble 40 whose development is restricted by the movable member 31 passes the slight gaps between the sides of the movable member 31 and the walls on both sides formed by each of the liquid flow paths 10 to be extruded to the upper side of the movable member 31. The bubble thus being extruded is termed as the "extruded bubble 41" in the specification hereof.

In this state, the entire configuration of the liquid flow paths to the discharge port side is made wider from the upstream side to the downstream side as its structure that contains the movable member 31.

Figure 23:
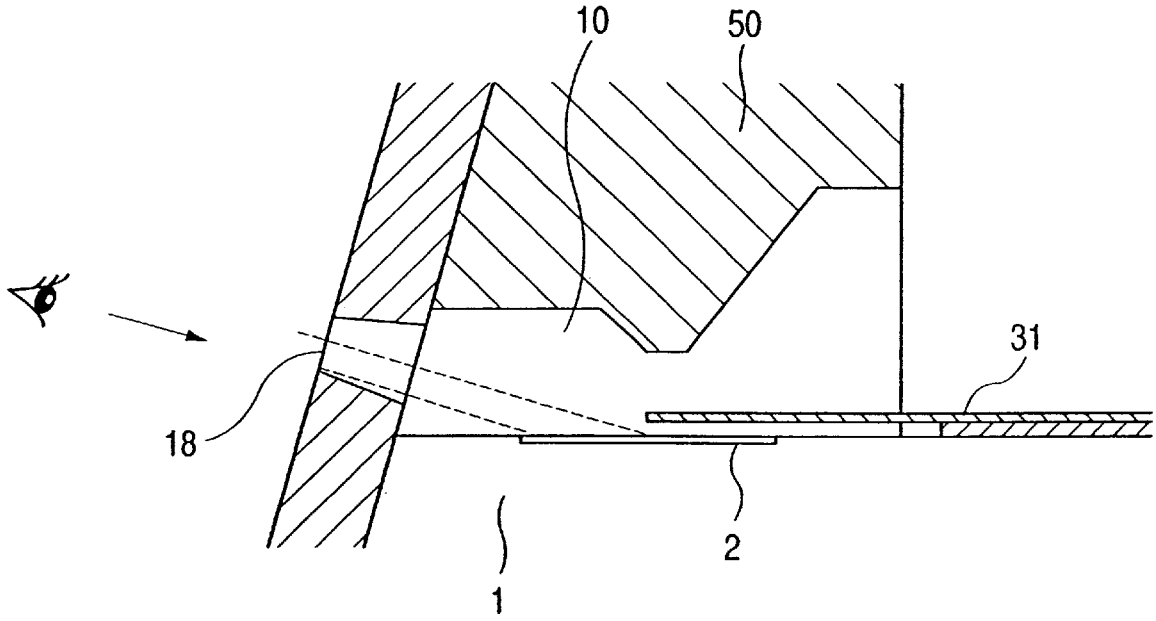
FIG. 23 is a cross-sectional view which shows the flow path for the illustration of the "linearly communicated state" of the liquid discharge head of the present invention.

In accordance with the present invention, the straight flow path structure is kept between the portion of the bubble 40 on the discharge port side, and the discharge port, that is, the structure is in the "linearly communicated state" as shown in FIG. 23. More preferably, this state is made such as to enable the propagating direction of the pressure waves generated at the time of bubble creation to be in agreement linearly with the flow direction of the liquid, as well as with the discharge direction thereof, following the pressure waves thus generated. It is desirable to attain the ideal state in this manner so as to stabilize at an extremely high level the discharge condition of the discharged liquid droplets 66, such as the discharge direction and the discharge speed thereof. For the present invention, it should be good enough as one of the definitions to attain this ideal state or approximate the structure to be in the ideal state if only the structure is arranged to directly connect on the straight line the discharge port 18 with the heating member 2 (particularly, with the heating member on the discharge port side (on the downstream side) which is more influential on bubbling). The state thus obtained can be observed from the outside of the discharge port if no liquid is present in the flow path. Particularly, the downstream side of the heating member is made observable in this state.

On the other hand, as described earlier, the displacement of the movable member 31 is regulated by the presence of the stopper 64 for the portion of the bubble 40 on the upstream side. Therefore, this portion of the bubble is made smaller just to be in the state where it stays to charge the stress by the movable member 31 which is bent to be extruded toward the upstream side by the inertia of the liquid flow to the upstream side. For this portion as a whole, the amount which enters the area on the upstream side by means of the stopper, the liquid flow path partition walls 101, the movable member 31, and the fulcrum 33 is made almost zero (however, each of the gaps between the movable member 31 and the liquid flow path partition walls 101 is made allowable to create the bubble which is partly extruded through the space of 10 $\mu$m or less each).

In this way, the liquid flow to the upstream side is largely regulated to prevent the liquid cross talks with the adjacent nozzles and the reversed liquid flow in the supply system which may impede the higher refilling to be described later, as well as to prevent pressure vibrations.

Figure 4D:
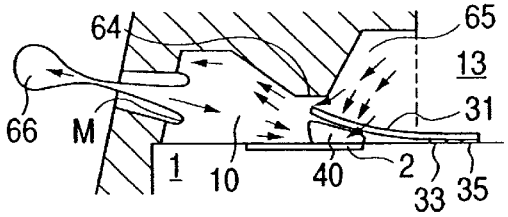

FIG. 4D shows the state where the contraction of the bubble 40 begins when the negative pressure in the interior of the bubble has overcome the shifting of the liquid to the downstream side in the liquid flow path subsequent to the film boiling described earlier. At this juncture, the force of the liquid which is exerted by the development of the bubble still remains largely in the upstream side. Therefore, the movable member 31 is still in contact with the stopper 64 for a specific period after the contraction of the bubble 40 has begun, and the most of the contracted bubble 40 exerts the shifting force of liquid in the upstream direction from the discharge port 18. In the state shown in FIG. 4C, since the movable member 31 is in the condition to charge the extrusive stress which is bent to the upstream side, the movable member itself exerts the force to concave it in the upstream direction by drawing the liquid flow from the side where the stress is released, that is, the upstream side as shown in FIG. 4D. As a result, at a certain point, the force that draws the movable member back in direction from the upstream side overcomes the shifting force of liquid in the upstream side as described earlier to make it possible to begin, although slightly, to flow from the upstream side to the discharge port side. Then, the bending of the movable member 31 is reduced to begin effectuating the displacement to be in concave in the upstream direction. In other words, the imbalanced condition takes place for the bubble 40 on the upstream side and the downstream side, which creates one-way flow of the liquid as a whole temporarily in the direction towards the discharge port in the liquid flow path.

Figure 4E:
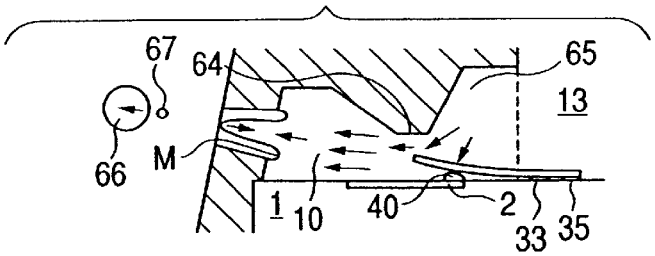

At the timing immediately after that, the displaced movable member 31 is still in contact with the stopper 64 in the interior of the flow path as a whole. Therefore, the liquid flow path 10 having the bubble generation area 11 in it is essentially in the closed space with the exception of the discharge port 18. Then, the energy exerted by the contraction of the bubble 40 is allowed to act strongly as a force in terms of the total balance thereof, and to enable the liquid in the vicinity of the discharge port 18 to shift in the upstream direction. Consequently, the meniscus M is largely drawn back from the discharge port 18 to the interior of the liquid flow path 10 to quickly cut off the liquid column which is connected with the discharged liquid droplet 66. Then, as shown in FIG. 4E, the resultant liquid droplet or satellite (sub-droplets) 67 becomes smaller, which remains on the outer side of the discharge port 18.

Particularly, in this case, unlike the usual bubbling from the steady-state, the bubbling takes place with the movable member 31 being displaced upward in the same way as in the state of continuous discharges. Therefore, in the process shown in FIG. 4C, the temporal deviation becomes smaller between the maximum development of the bubble and the maximum displacement of the movable member 31. The temporal deviation between the contraction of the bubble and the downward displacement of the movable member to follow is made smaller accordingly. In other words, the capability of the movable member to follow the condition of the bubble is improved here. In accordance with the present invention, since the meniscus quickly draws in the trailing portion which becomes the liquid column by being connected with the discharged liquid droplet 66 with a strong force, this trailing portion is made thinner and longer. However, with the improved follow-up capability of the movable member with respect to the bubble status as described above, the time required for drawing in the meniscus is made shorter than that required for bubbling from the steady-state. Then, the resultant shape of the trailing portion is such that only the portion behind the discharged liquid droplet becomes thinner. Consequently, the satellite dots remaining outside the discharge port 18 are reduced extremely.

Figure 6A:
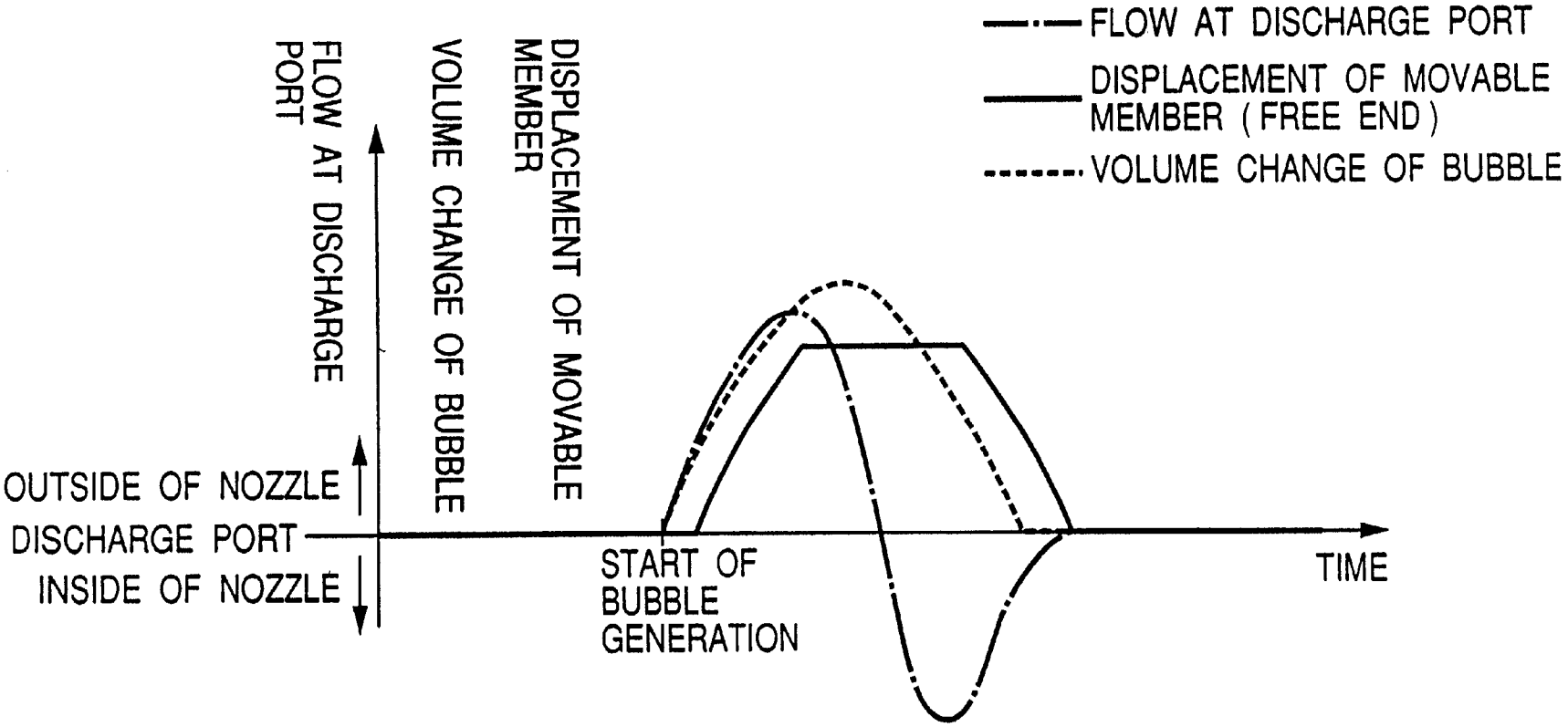
FIGS. 6A and 6B are views which illustrate the correlations between the displacement of the movable member, the voluminal changes of the bubble, and the flow (including liquid and gas) at the discharge port.
Figure 6B:
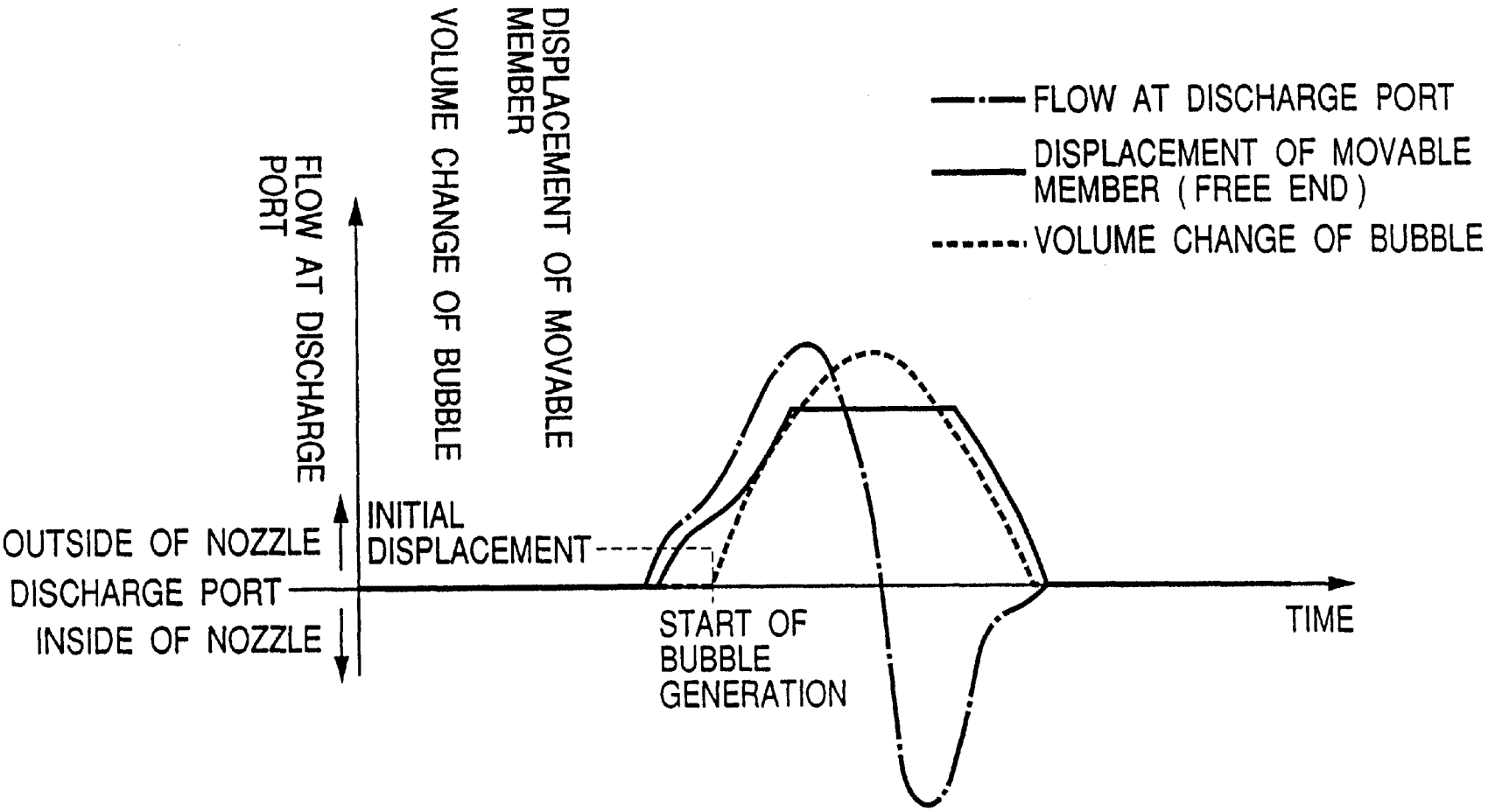

Now, in conjunction with FIGS. 6A and 6B, the description will be made of the displacing status of the movable member following the development and contraction of the bubble. FIGS. 6A and 6B are views which illustrate the correlations between the displacement of the movable member, the voluminal changes of the bubble, and the flow at the discharge port (including liquid and gas): FIG. 6A shows the bubbling when the movable member in the normal state; FIG. 6B shows the bubbling when the movable member is displaced upward.

In FIG. 6A, the bubbling begins by the rapid heating of the heating member. Then, the bubble is caused to be developed largely, and then, it should push up the movable member. As a result, the movable member begins to be displaced slightly behind the development of the bubble. Also, in the disappearing process, the movable member is still on the upward shift due to inertia. Thus, it begins to be displaced downward behind the disappearing of the bubble. In FIG. 6B, on the other hand, the bubbling is initiated in condition that the movable member is displaced upward by use of preliminary displacing means. Therefore, unlike the case shown in FIG. 6A, there is no need for the bubble to push up the movable member when it is developed. As a result, the temporal deviation between the maximum bubbling and the maximum displacement of the movable member becomes smaller. Further, since such temporal deviation is smaller, the timing of the downward displacement of the movable member becomes quicker in the disappearing process to make the temporal deviation between the downward displacement of the movable member and the disappearing bubble is made smaller accordingly.

Then, in continuation, FIG. 4E shows the state where the meniscus M and the discharged liquid droplet 66 are cut off when the disappearing process is almost completed. In the lower flow path resistance area 65, the movable member 31 begins to be displaced downward. Also the flow begins to run in the downstream direction in the lower flow path resistance area 65 following such displacement of the movable member due to the resiliency of the movable member 31 against the shifting force of liquid in the upstream direction, and the contracting force exerted by the disappearing bubble 40 as well. Then, the close approach or the contact between the movable member 31 and the stopper 64 begin to be released. Along with this, the flow in the downstream direction in the lower flow path resistance area 65, which has a smaller flow path resistance, becomes a larger flow rapidly, and flows into the liquid flow path 10 through the stopper 64 portion. As a result, the flow that causes the meniscus M to be drawn into the interior of the liquid flow path 10 is reduced abruptly. The meniscus M begins to return in a comparatively slow speed to the position at which the bubbling is originated, while drawing the liquid column, which remains outside the discharge port 18 or which is extruded in the discharge port 18 direction, without cutting it off as much as possible. Here, in particular, by the returning flow for the meniscus M and the refilling flow from the upstream, which are joined together, the area having almost zero flow rate is formed between the discharge port 18 and the heating member 2, hence making the settling performance of meniscus better. This performance depends on the viscosity and the surface tension of ink, but in accordance with the present invention, it becomes possible to drastically reduce the satellites which are separated from the liquid column to degrade the quality of images when adhering to a printed object or to produce adverse effects on the discharge direction to cause the disabled discharge when adhering to the circumference of the orifices.

Also, the meniscus M itself begins to be restored before it is largely drawn into the interior of liquid flow path. Therefore, the restoration is completed within a short period of time despite the speed of liquid shift itself which is not very high. As a result, the overshooting of the meniscus, that is, the amount thereof which is extruded outside the discharge port 18 without stopping at the discharge port 18, is reduced. Then, in an extremely short period of time, it becomes possible to eliminate the phenomenon of the attenuating vibrations having its settling point at the discharge port 18 from which the overshooting is made. This phenomenon of the attenuating vibrations also produces adverse effects on the print quality. With the quicker elimination of this phenomenon, the present invention is designed to contribute significantly to the implementation of the stabilized higher printing.

As shown in FIG. 4E, the flow into the liquid flow path 10 through the gap between the movable member 31 and the stopper 64 makes the flow rate faster on the wall face on the ceiling plate 50 side. As a result, the residual fine bubbles on this portion is made extremely smaller, which significantly contributes to the implementation of the stabilized discharges.

On the other hand, among those satellites 67 residing immediately after the discharged liquid droplet 66, there are some which are extremely close to the discharged liquid droplet due to the rapid meniscus drawing as shown in FIG. 4D. Here, the so-called slip stream phenomenon is created, which causes the satellite, which follows the discharged liquid droplet, to be attracted to it due to the eddy current occurring behind the flying discharged liquid droplet 66.

Now, this phenomenon will be described precisely. With the conventional liquid discharge head, the liquid droplet is not in the spherical form the moment liquid is discharged from the discharge port of the liquid discharge head. The liquid droplet is discharged almost in the form of a liquid column having it spherical part on the leading end thereof. Thus, the trailing portion is tensioned both by the main droplet and the meniscus, and when it is cut off from the meniscus, the satellite dots are formed with the trailing portion. Here, it is known that the satellites fly to a recording medium together with the main droplet. The satellites fly behind the main droplet, and also, the satellites are drawn by the meniscus. Therefore, the discharge speed thereof is slower to that extent to cause its impacted position to be deviated from that of the main droplet. This inevitably degrades the quality of prints. In accordance with the liquid discharge head of the present invention, the force that draws back the meniscus is much greater than the conventional liquid discharge head as described earlier. Thus, the drawing force given to the trailing portion is stronger after the main droplet has been discharged. The force with which the trailing portion is cut from the meniscus becomes stronger accordingly to make its timing faster. As a result, the satellite dots which are formed from the trailing portion become much smaller, and the distance between the main droplet and satellite dots is also made shorter. Further, since the trailing portion is not drawn by meniscus continuously for a longer period, the discharge speed does not become slower. Hence, the satellites 67 are drawn to the main droplet by the slip stream phenomenon occurring behind the discharged liquid droplet 66.

Figure 4F:
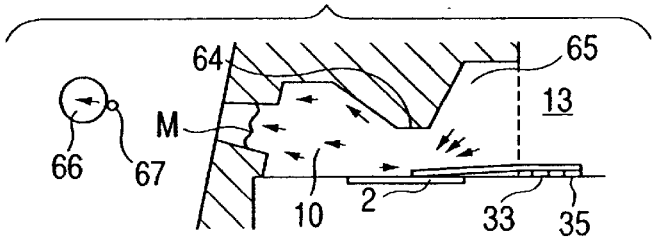

FIG. 4F shows the condition where the state illustrated in FIG. 4E has further advanced. Here, the satellite 67 is still closer to the discharged liquid droplet 66, at the same time, being drawn to it. Then, the drawing force exerted by the slip stream phenomenon becomes greater. On the other hand, the liquid shift from the upstream side in the direction toward the discharge port 18 is displaced downward more than the initial position due to the completion of the disappearing process of the bubble 40 and the displacement overshoot of the movable member 31. Then, the resultant phenomenon takes place to draw liquid from the upstream side and push out liquid in the direction toward the discharge port 18. Further, by the expansion of the sectional area of the liquid flow path due to the presence of the stopper 64, the liquid flow is increased in the direction toward the discharge port 18 to enhance the restoring speed of the meniscus M to the discharge port 18. In this manner, the refilling characteristic of the present embodiment is drastically improved.

Also, since the movable member 31 is displaced downward when the cavitation occurs with the disappearing bubble, the disappearing point and the discharge port 18 are separated. Thus, the movable member 31 absorbs much of the impulsive waves created by the cavitation without being transferred directly to the discharge port 18. There is almost no possibility that the ultrafine droplets called "microdots" are created from the meniscus when the impulsive waves of the cavitation reaches the meniscus. Therefore, the quality of printed images is not lowered by the adhesion of the microdots or the phenomenon that the unstabilized discharged is caused by the adhesion thereof to the circumference of the discharge port 18 is drastically eliminated.

Further, the point where the cavitation occurs due to disappearing is deviated to the fulcrum side 33 by the presence of the movable member 31. As a result, damages to the heating member 2 become smaller. Also, the overviscose ink is compulsorily shifted from the closed area between the movable member 31 and the heating member 2 for its removal, hence enhancing the discharge durability. At the same time, it becomes possible to reduce the adhesion of the burnt ink on the heating member due to this phenomenon in this area, hence enhancing the stability of discharges.

Figure 4G:
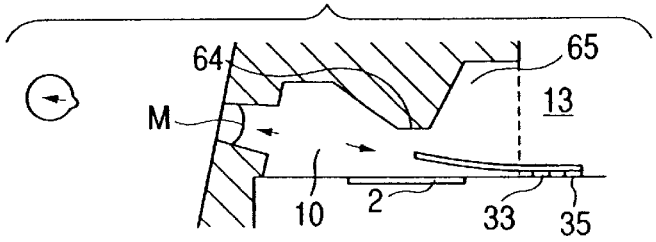

FIG. 4G shows the condition in which the state illustrated in FIG. 4F has further advanced, and the satellite 67 is caught into the discharged liquid droplet 66. The combined body of the discharged liquid droplet 66 and the satellite 67 is not necessarily the phenomenon that should occur under any circumstances per discharge for other embodiments. Depending on conditions, such phenomenon takes place or it does not take place at all. However, by eliminating the satellites or at least by reducing the amount of satellites, there is almost no deviation between the impact positions of the main droplet and the satellite dots on the recording medium so as to minimize the adverse effect that may be produced on the quality of prints. In other words, the sharpness of printed images is enhanced to improve the quality of prints, and at the same time, it becomes possible to avoid making them mists and reduce the occurrence of the damage that the mist thus created may stain the printing medium or the interior of the recording apparatus.

In the meantime, the movable member 31 is again displaced in the direction toward the stopper 64 due to the reaction of its overshooting. This displacement is suspended at the initial position lastly, because it is settled by the attenuating vibrations determined by the configuration of the movable member 31, the Young's modulus, the viscosity of liquid in the liquid flow path, and the gravity.

With the upward displacement of the movable member 31, the flow of liquid is controlled in the direction toward the discharge port 18 from the common liquid chamber 13 side. Then, the movement of the meniscus M is quickly settled on the circumference of the discharge port. As a result, it becomes possible to significantly reduce the factors that may degrade the quality of prints due to the overshooting phenomenon of the meniscus or the like that may unstabilize the condition of discharges.

Preliminary Displacing Means for the Movable Member

Figure 5A:
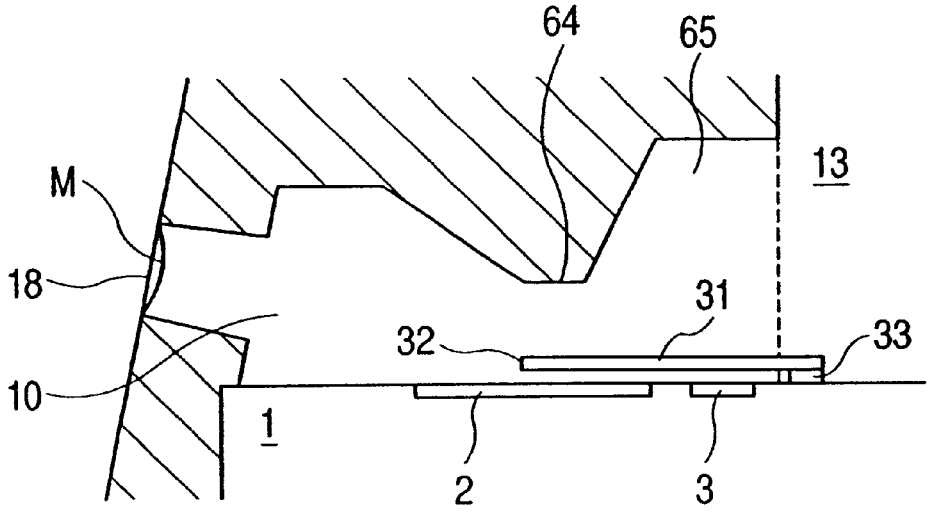
FIGS. 5A and 5B are cross-sectional views which illustrate the variational example of preliminary displacing means of the movable member of the liquid discharge head represented in FIGS. 4A, 4B, 4C, 4D, 4E, 4F and 4G.
Figure 5B:
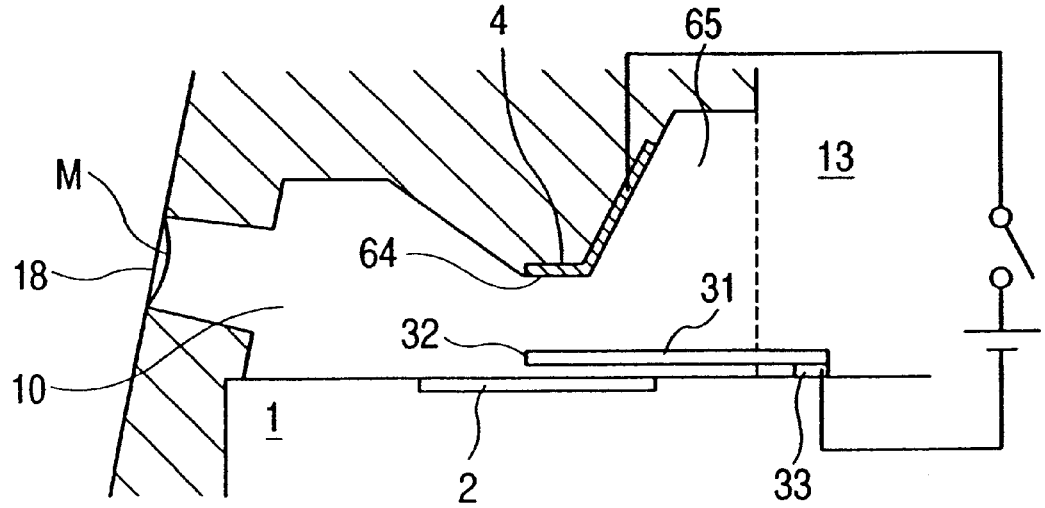

FIGS. 5A and 5B are cross-sectional views which illustrate the variational example of the preliminary displacing means of the movable member of the liquid discharge head shown in FIGS. 4A to 4G: FIG. 5A shows the example in which small heating members (small heaters) are provided as preliminary displacing means of the movable member; FIG. 5B shows the example in which the electrodes are arranged on the upper surface of nozzles to displace the movable members by the application of electrostatic force.

As shown in FIG. 5A, a small heating member 3 having a smaller area than that of the heating member 2 which bubbles liquid for discharging is arranged in the vicinity of the fulcrum 33 of the movable member 31 on the elemental substrate 1 as preliminary displacing means that displaces the movable member 31 upward before bubbling. By heating of this small heating member 3, bubble is developed on the small heating member 3 to displace the movable member 31 upward with the leverage set at the fulcrum 33.

Also, as shown in FIG. 5B, the electrode 4 is arranged as another example on the surface of the flow path wall which includes the stopper 64 that regulates the displacement of the movable member 31. Then, it is arrange to be able to apply voltage across the electrode 4 and the movable member 31. In this way, when voltage is applied across the electrode 4 and the movable member 31, the movable member 31 is drawn to the electrode 4 by the application of electrostatic force, and at the same time, it is displaced upward with the leverage set at the fulcrum 33.

Third Embodiment

Hereinafter, with reference to the accompanying drawings, the description will be made of the present embodiment in accordance with the present invention.

FIGS. 7A to 7F and FIGS. 8A to 8E are cross-sectional views which illustrate the liquid discharge head in accordance with a third embodiment of the present invention, taken along in the liquid flow path direction, and which illustrate the characteristic phenomena in the liquid flow paths by dividing the process into FIGS. 7A to 7F and FIGS. 8A to 8E.

For the liquid discharge head of the present embodiment, the heating members 2 are arranged on a flat and smooth elemental substrate 1 to enable thermal energy to act upon liquid as discharge energy generating elements to discharge liquid. Then, on the elemental substrate 1, liquid flow paths 10 are arranged corresponding to the heating members 2, respectively. The liquid flow paths 10 are communicated with the discharge ports 18, and at the same time, communicated with the common liquid chamber 13 to supply liquid to a plurality of liquid flow paths 10, hence receiving from the common liquid chamber 13 an amount of liquid that correspond to that of the liquid which has been discharged from each of the discharge ports 18. A reference mark M designates the meniscus formed by the discharged liquid. The meniscus M is balanced in the vicinity of the discharge ports 18 with respect to the inner pressure of the common liquid chamber 13 which is usually negative by means of the capillary force generated by each of the discharge ports 18 and the inner wall of the liquid flow path 10 communicated with it.

The liquid flow paths 10 are structured by bonding the elemental substrate 1 provided with the heating members 2, and the ceiling plate 50, and in the area near the plane at which the heating members 2 and discharge liquid are in contact, the bubble generation area 11 is present where the heating members 2 are rapidly heated to enable the discharge liquid to form bubbles. For each of the liquid flow paths 10 having the bubble generation area 11, respectively, the movable member 31 is arranged so that at least a part thereof is arranged to face the heating member 2. The movable member 31 has its free end 32 on the downstream side toward the discharge port 18, and at the same time, it is arranged in a cantilever fashion where its one end is supported by the supporting member 31 arranged on the upstream side of the liquid flow path 10. Particularly, in accordance with the present embodiment, the free end 32 is arranged on the central portion of the bubble generation area 11 in order to suppress the development of a half of the bubble on the upstream side which exerts influences on the back waves toward the upstream side and the inertia of the liquid. Then, along with the development of the bubble created in the bubble generation area 11, the movable member 31 can be displaced with respect to the supporting member 34. In this displacement, the fulcrum 33 becomes the supporting portion of the supporting member 34 to support the movable member 31.

Above the central portion of the bubble generation area 11, the stopper (regulating portion) 64 is positioned to regulate the displacement of the movable member 31 within a certain range in order to suppress the development of a half of the bubble on the upstream side. In the flow from the common liquid chamber 13 to the discharge port 18, there is arranged a lower flow path resistance area 65, which presents the relatively lower flow path resistance than the liquid flow path 10, on the upstream side with the stopper 64 as the boundary. The flow path structure in the area 65 is such as to provide no upper wall or to make the flow path sectional area larger, hence making the resistance that liquid receives from the flow path smaller when the liquid moves.

With the structure arranged as above, the head structure is formed, which is characterized in that unlike the conventional art, each of the liquid flow paths 10 having the bubble generation area 11 becomes an essentially closed space by the contact between the displaced movable member 31 and the stopper 64 with the exception of each of the discharge ports 18.

Now, detailed description will be made of the discharge operation of the liquid discharge head in accordance with the present embodiment. Here, FIGS. 7A to 7F represent the first liquid discharge. FIGS. 8A to 8E represent the second liquid discharge which follows the first one. FIG. 9 is a graph which shows the volumes of the bubble at the time of driving, and the displacements of the movable member.

Figure 7A:
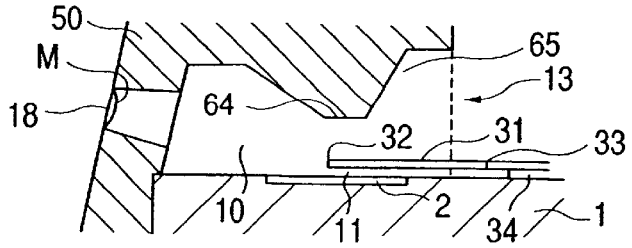
FIGS. 7A, 7B, 7C, 7D, 7E and 7F are cross-sectional views which illustrate the liquid discharge head in accordance with a third embodiment of the present invention, taken along in the liquid flow path direction, and which illustrate the first liquid discharge operation by dividing it into FIGS. 7A, 7B, 7C, 7D, 7E and 7F.
Figure 8A:
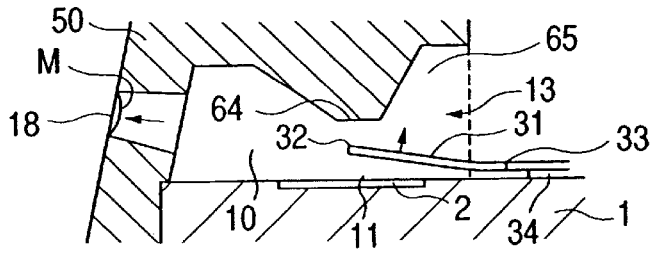
FIGS. 8A, 8B, 8C, 8D and 8E are cross-sectional views which illustrate the second liquid discharge operation following those shown in FIGS. 7A, 7B, 7C, 7D, 7E and 7F by dividing it into FIGS. 8A, 8B, 8C, 8D and 8E.
Figure 8B:
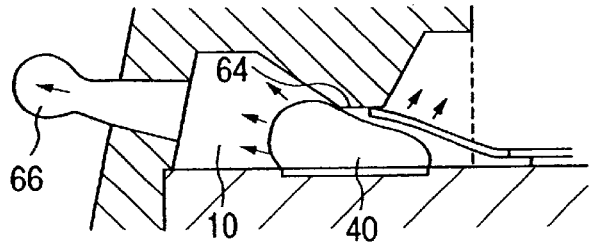
Figure 8C:
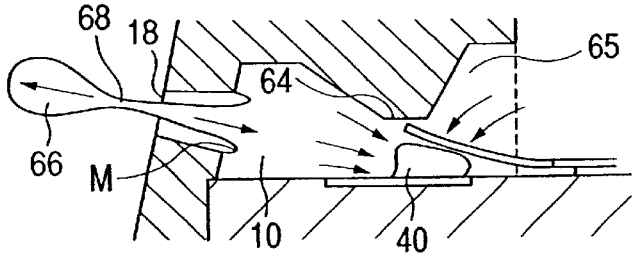

FIG. 7A shows the state before the energy, such as the electric energy, is applied to the heating member 2, which illustrates the state before the heating member generates heat. What is important here is that the movable member 31 is positioned to face a half of the bubble on the upstream side for each of the bubbles created by the heating of the heating member 2 (in the initial state), and the stopper 64 that regulates the displacement of the movable member 31 is arranged above on the central portion of the bubble generation area 11. In other words, with the structure of the flow paths and arrangement position of each of the movable members, a half of the bubble on the upstream side is held down to the movable member 31. If electric pulses are applied to the heating member at the time T=0 as shown in FIG. 9, a part of liquid filled in the bubble generation area 11 is heated by the heating member 2 to create bubble along with film boiling. Then, as the time elapses, the bubble is developed to make its volume larger. Here, at this juncture, the displacement of the movable member begins later than the voluminal changes of the bubble due to the repellent force of the movable member (at the time A indicated in FIG. 9).

Figure 7B:
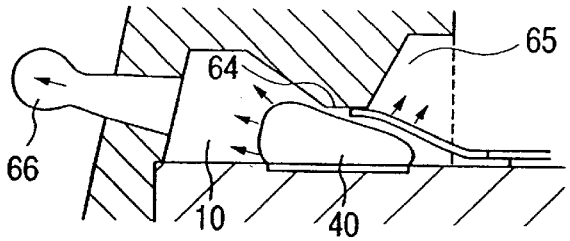

As shown in FIG. 9, with the development of the bubble, the shift of the flow in the direction toward the upstream side, that is, toward the common liquid chamber 13, becomes the large flow by the presence of the lower flow path resistance area 65. However, when the movable member 31 is displaced in the vicinity of the stopper 64 or to be in contact with it, any further displacement is regulated (at the time B in FIG. 9). As a result, the liquid shift in the direction toward the upstream is largely restricted there. In other words, with the displaced movable member 31 in this state, the upstream side of the liquid flow path 10 (at least the upstream side of the center of the bubble generation area 11) is substantially closed. As a result, the distribution of the liquid and bubble is essentially cut off between the liquid flow path 10 and the common liquid chamber 13 positioned on the upstream thereof. In this manner, the development of the bubble 40 to the upstream side is restricted by the movable member 31. Nevertheless, since the shifting force of the liquid in the direction toward the upstream side is great, the movable member 31 receives the stress in the form that it is pulled in the upstream direction, and held in such state. During this period, the bubble is developed to present the maximum volume as described earlier (at the time C in FIG. 9). FIG. 7B shows the state where the bubble is developed to the maximum in the bubble generation area 11. At this juncture, the liquid in the liquid flow path 10 is shifted to the downstream side and the upstream side by the pressure exerted by the creation of the bubble 40. On the upstream side, the movable member 31 is displaced by the development of the bubble 40, and on the downstream side, the discharge liquid droplet 66 is caused to fly out from the discharge port 18.

In accordance with the present invention, the straight flow path structure is kept between the portion of the bubble 40 on the discharge port side, and the discharge port, that is, the structure is in the "linearly communicated state" as shown in FIGS. 23. More preferably, this state is made such as to enable the propagating direction of the pressure waves generated at the time of bubble creation to be in agreement linearly with the flow direction of the liquid, as well as with the discharge direction thereof, following the pressure waves thus generated. It is desirable to attain the ideal state in this manner so as to stabilize at an extremely high level the discharge condition of the discharged liquid droplets 66, such as the discharge direction and the discharge speed thereof. For the present invention, it should be good enough as one of the definitions to attain this ideal state or approximate the structure to be in the ideal state if only the structure is arranged to directly connect on the straight line the discharge port 18 with the heating member 2 (particularly, with the heating member on the discharge port side (on the downstream side) which is more influential on bubbling). The state thus obtained can be observed from the outside of the discharge port if no liquid is present in the flow path. Particularly, the downstream side of the heating member is made observable in this state.

Figure 7C:
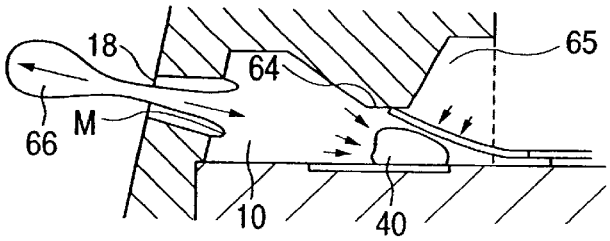

After that, as shown in FIG. 7C, the contraction of the bubble 40 begins when the negative pressure in the interior of the bubble has overcome the shifting of the liquid to the downstream side in the liquid flow path subsequent to the film boiling described earlier, At this juncture, the force of the liquid which is exerted by the development of the bubble still remains largely in the upstream side. Therefore, the movable member 31 is still in contact with the stopper 64 for a specific period after the contraction of the bubble 40 has begun, and the most of the contracted bubble 40 exerts the shifting force of liquid in the upstream direction from the discharge port 18. In other words, immediately after the stage shown in FIG. 7B, the upstream side of the liquid flow path 10 is closed by the displaced movable member 31 which is in contact with the stopper 64, hence making the liquid flow path 10 having the bubble generation area 11 in it an essentially closed space with the exception of the discharge port 18. Therefore, the contracting energy of the bubble 40 acts as a force to shift the liquid in the vicinity of the discharge port 10 in the upstream direction. Consequently, the meniscus M is largely drawn back from the discharge port 18 to the interior of the liquid flow path 10 to quickly cut off the liquid column which is connected with the discharged liquid droplet 66. Then, as shown in FIG. 7D, the resultant liquid droplet or satellite (sub-droplets) 67 becomes smaller, which remains on the outer side of the discharge port 18.

Figure 7D:
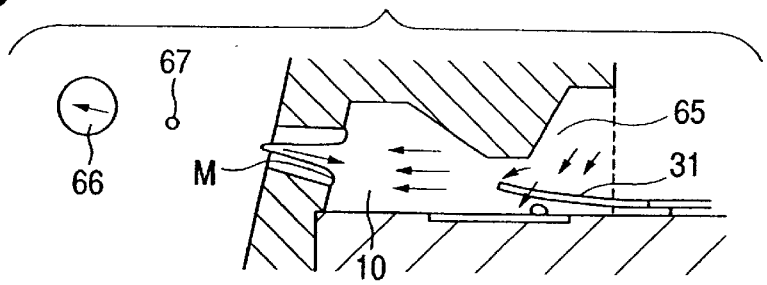

FIG. 7D shows the state where the discharge liquid droplet 66 whose disappearing process is completed, and the meniscus M are cut off. At first, in the lower flow path resistance area 65, the resiliency of the movable member 31 overcomes the shifting force of the liquid in the upstream direction. Then, the movable member 31 begins its downward displacement (from the displaced state to the initial state). Along with this, the flow in the lower flow path resistance area 65 begins in the downstream direction (at the time D in FIG. 9). Here, at the same time, since the flow in the downstream direction of the lower flow path resistance area 65 has a smaller flow path resistance, the flow becomes larger and flows into the liquid flow path 10 through the stopper 64 portion. As a result, the flow that causes the meniscus M to be drawn into the interior of the liquid flow path 10 is reduced abruptly. Then, the meniscus M begins to return in a comparatively slow speed to the position at which the bubbling is originated, while drawing the liquid column, which remains outside the discharge port 18. Thus, it becomes possible to settle the vibrations of the meniscus at a high speed.

On the other hand, the discharged liquid droplet 66 and the satellite 67 residing immediately after the discharged liquid droplet are extremely close to each other due to the rapid meniscus drawing as shown in FIG. 7C. Here, the so-called slip stream phenomenon is created, which causes the satellite, which closely follows the discharged liquid droplet, to be attracted to it due to the eddy current occurring behind the flying discharged liquid droplet 66.

Now, this phenomenon will be described precisely. With the conventional liquid discharge head, the liquid droplet is not in the spherical form the moment liquid is discharged from the discharge port of the liquid discharge head. The liquid droplet is discharged almost in the form of a liquid column having it spherical part on the leading end thereof. Thus, the trailing portion is tensioned both by the main droplet and the meniscus, and when it is cut off from the meniscus, the satellite dots are formed with the trailing portion. Here, it is known that the satellites fly to a recording medium together with the main droplet. The satellites fly behind the main droplet, and also, the satellites are drawn by the meniscus. Therefore, the discharge speed thereof is slower to that extent to cause its impacted position to be deviated from that of the main droplet. This inevitably degrades the quality of prints. In accordance with the liquid discharge head of the present invention, the force that draws back the meniscus is much greater than the conventional liquid discharge head as described earlier. Thus, the drawing force given to the trailing portion is stronger after the main droplet has been discharged. The force with which the trailing portion is cut from the meniscus becomes stronger accordingly to make its timing faster. As shown in FIG. 7C, with the stronger and faster force with which the meniscus is drawn back, the trailing portion between the main droplet and the meniscus is quickly pulled to make this portion of the liquid column thinner than the conventual one. The liquid column can be easily cut off at this thinner portion. As a result, the satellite dots which are formed from the trailing portion become much smaller, and the distance between the main droplet and satellite dots is also made shorter. Further, since the trailing portion is not drawn by meniscus continuously for a longer period, the discharge speed does not become slower. Hence, the satellites 67 are drawn to the main droplet by the slip stream phenomenon occurring behind the discharged liquid droplet 66.

In this respect, the reason why the meniscus can be drawn quickly to make the trailing portion thinner is that whereas the bubble 40 is contracted, the liquid is not drawn from the upstream side, because the upstream side of the liquid flow path 10 is closed, and the liquid is drawn only form the downstream side (near the discharge port). This state appears only between the time at C in FIG. 9 (that is, the bubble 40 presents the maximum volume, and the disappearing begins) and the time at D (that is, the movable member 31 begins to be restored).

Figure 7E:
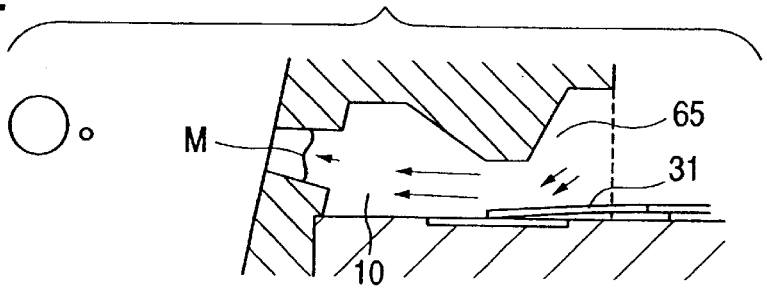

FIG. 7E shows the condition where the state illustrated in FIG. 7D has further advanced. Here, the satellite 67 is still closer to the discharged liquid droplet 66, at the same time, being drawn to it. Then, the drawing force exerted by the slip stream phenomenon becomes greater. On the other hand, the liquid shift from the upstream side in the direction toward the discharge port 18 creates the phenomenon that the liquid is drawn from the upstream side, and the liquid is pushed out in the discharge port 18 direction, because the overshoot displacement of the movable member 31 causes it to be displaced lower than the initial position (at the time E in FIG. 9). Further, by the expansion of the sectional area of the liquid flow path due to the presence of the stopper 64, the liquid flow is increased in the direction toward the discharge port 18 to enhance the restoring speed of the meniscus M to the discharge port 18. In this manner, the refilling characteristic of the present embodiment is drastically improved.

Figure 7F:
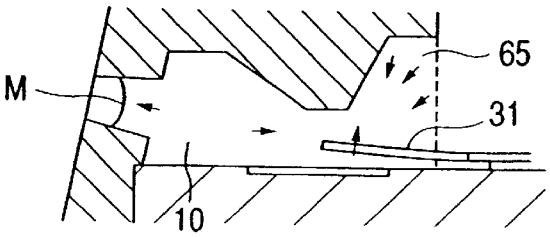

FIG. 7F shows the condition in which the state illustrated in FIG. 7E has further advanced, and the satellite 67 is caught into the discharged liquid droplet 66. The combined body of the discharged liquid droplet 66 and the satellite 67 is not necessarily the phenomenon that should occur under any circumstances per discharge for other embodiments. Depending on conditions, such phenomenon takes place or it does not take place at all. However, by eliminating the satellites or at least by reducing the amount of satellites, there is almost no deviation between the impact positions of the main droplet and the satellite dots on the recording medium so as to minimize the adverse effect that may be produced on the quality of prints. In other words, the sharpness of printed images is enhanced to improve the quality of prints, and at the same time, it becomes possible to avoid making them mists and reduce the occurrence of the damage that the mist thus created may stain the printing medium or the interior of the recording apparatus.

In the meantime, the movable member 31 is again displaced in the direction toward the stopper 64 due to the reaction of its overshooting. Then, the attenuating vibrations, which are determined by the configuration of the movable member 31, the Young's modulus, the viscosity of liquid in the liquid flow path, and the gravity, are performed. Before the attenuating vibrations are settled, the second liquid discharge operation is executed. In other words, in accordance with the present embodiment, if liquid is discharged from the same discharge port 18 twice in succession, the next driving pulses are supplied to the heating member 2 (at the time F in FIG. 9) when the movable member 31 is being displaced upward (toward the stopper 64 side) as shown in FIG. 8A before the vibrations of the movable member 31 are settled following the completion of the previous liquid discharge. Then, while the movable member 31 is being displaced upward, the bubble 40 is developed on the bubble generation area 11. Since the movable member 31 is provided with the preliminary upward acceleration, the displacement initiation is not delayed due to the robustness of the movable member with respect to the development of the bubble 40. It can be displaced almost simultaneously with the voluminal changes of the bubble 40. At the time G in FIG. 9, the movable member 31 is in contact with the stopper 64 to close the upstream side of the liquid flow path 10. The bubble generation area 11 is essentially in the closed state with the exception of the discharge port 18. At the time H in FIG. 9, the bubble presents the maximum volume as shown in FIG. 8B. At this juncture, the discharge liquid droplet 66 is being discharged from the discharge port 18.

Now, the disappearing process begins. In the earlier stage of the disappearing of the bubble 40, its contraction causes the liquid shift from the discharge port to draw in the meniscus largely. Thus, the liquid column connected with the discharged liquid droplet is cut off. At the time H and on, the movable member 31 is in the displaced state and in contact with the stopper as in FIG. 7C. The upstream side of the liquid flow path 10 is essentially closed so that the suction force exerted by the contraction of the bubble 40 mainly acts upon drawing in the liquid from the meniscus. The retracting force of the meniscus becomes stranger and faster accordingly. As a result, as described earlier, the trailing portion between the main droplet and the meniscus becomes extremely thinner. However, at the time J in FIG. 9, the movable member 31 begins to be displaced downward, hence initiating the flow in the downstream direction (the direction toward the discharge port) from the lower flow path resistance area 65. At this juncture, as shown in FIG. 8C, the liquid in the lower flow path resistance area 65 is allowed to flow into the vicinity of the bubble generation area at once along with the releasing of the regulation by the movable member 31, thus creating the strong liquid flow from the upstream side to the downstream side in the liquid flow path 10. This liquid flow acts upon the flow that enables the meniscus to be drawn rapidly. Then, the retracting speed of the meniscus becomes slower rapidly to make the liquid column on the trailing portion thicker.

As described earlier, the trailing portion becomes thinner during the period from the time at which the bubble 40 presents the maximum volume, that is, the initiation of disappearing, to the time at which the movable member 31 begins its restoration. Here, it is the period between the time H to the time J in FIG. 9. Then, in accordance with the present embodiment, the heating member 2 is driven while the movable member 31 is displaced upward. Therefore, the deviation of timing becomes smaller between the movable member and the voluminal changes of the bubble 40 at the time F and on. The movable member is displaced downward almost following the voluminal shrinkage of the bubble 40. Consequently, the time lag from the time H to the time J in FIG. 9 is small with the result that the thinner portion 68 of the liquid column connected with the main droplet is present to be extremely short in its length, and then, the thicker portion to follow is extended to the meniscus as shown in FIG. 8C.

Figure 8D:
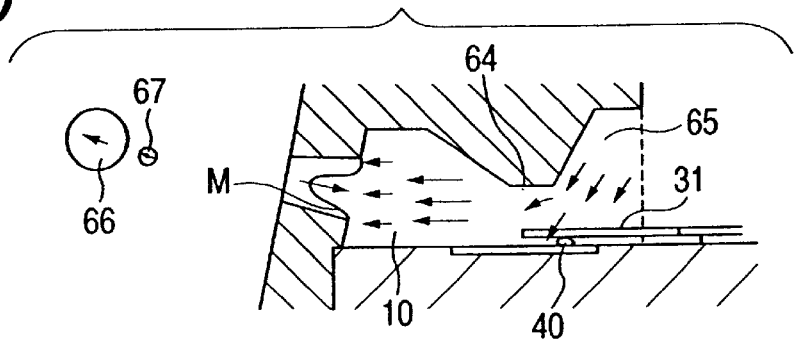
Figure 9:
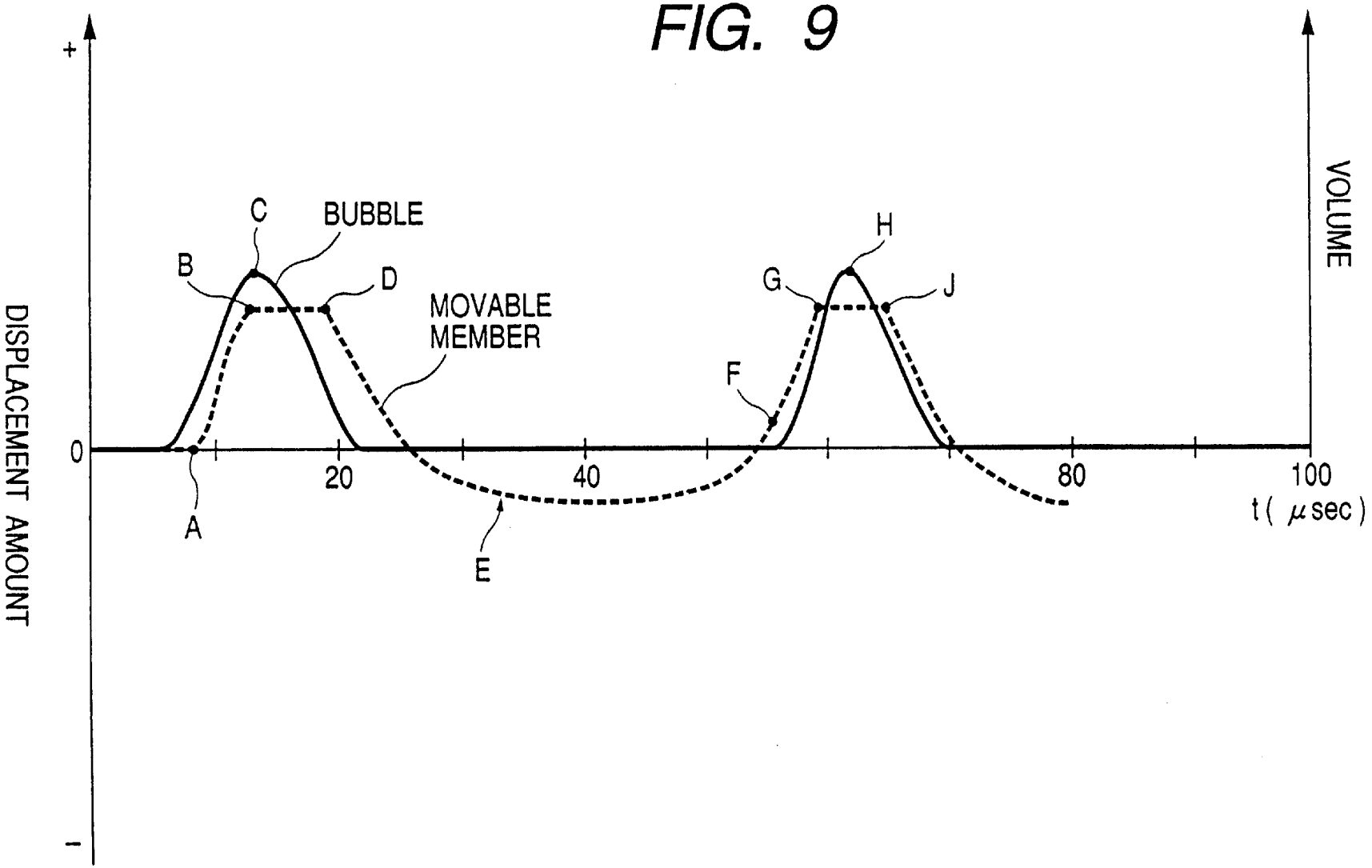
FIG. 9 is a graph which shows the relationship between the displacement of the movable member and the development of bubble in accordance with the third embodiment.

Subsequently, as shown in FIG. 8D, the discharge liquid droplet which is discharged externally and the meniscus which is drawn into the liquid flow path 10 are separated. As described earlier, since the thinner portion 68 is present on the trailing portion between the discharged liquid droplet and the meniscus, this thinner portion 68 is cut off to separate them. Moreover, this thinner portion 68 is extremely short in its length, hence making it easier to cut at one place reliably. On the other hand, the liquid column is thick with the exception of this thinner portion 68. As a result, the liquid column is not separated outside the discharge port. In most case, it is drawn into the discharge port without leaving liquid droplets on the outer side of the discharge port, that is, the satellites become smaller.

Figure 8E:
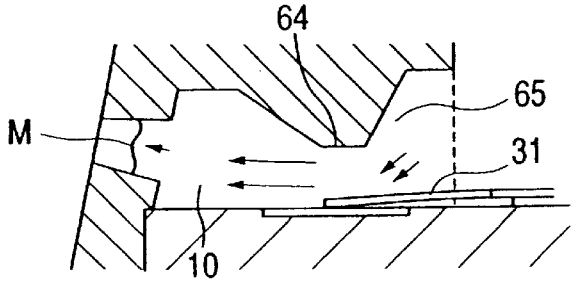

FIG. 8E shows the state where the movable member has been overshot to the heating member side than its initial position. The liquid shift in the direction from the upstream to the discharge port is displaced downward more than the initial position. Then, the resultant phenomenon takes place to draw liquid from the upstream side and push out liquid in the direction toward the discharge port. At the same time, by the expansion of the sectional area of the liquid flow path, the liquid flow is increased in the direction toward the discharge port, hence accelerating the restoring speed of the meniscus to the discharge port. In this manner, the refilling characteristic of the present embodiment is drastically improved.

As described above, the driving pulses are applied to the heating member in the state that the movable member is being displaced upward (to the stopper side) to make the deviation smaller between the voluminal changes of the bubble 40 and the displacements of the movable member. Then, with the completion of the downward displacement of the movable member in a shorter period of time, the satellites are made smaller. Also, the speed of the satellites becomes faster to facilitate the contact with the main droplet in its flight to be integrated with it.

Fourth Embodiment

Hereinafter, with reference to the accompanying drawings, the description will be made of the present embodiment in accordance with the present invention.

FIGS. 10A to 10F and FIGS. 11A to 11E are cross-sectional views which illustrate the liquid discharge head in accordance with a fourth embodiment of the present invention, taken along in the liquid flow path direction, and which illustrate the characteristic phenomena in the liquid flow paths by dividing the process into FIGS. 10A to 10F and FIGS. 11A to 11E.

For the liquid discharge head of the present embodiment, the heating members 2 are arranged on a flat and smooth elemental substrate 1 to enable thermal energy to act upon liquid as discharge energy generating elements to discharge liquid. Then, on the elemental substrate 1, liquid flow paths 10 are arranged corresponding to the heating members 2, respectively. The liquid flow paths 10 are communicated with the discharge ports 18, and at the same time, communicated with the common liquid chamber 13 to supply liquid to a plurality of liquid flow paths 10, hence receiving from the common liquid chamber 13 an amount of liquid that correspond to that of the liquid which has been discharged from each of the discharge ports 18. A reference mark M designates the meniscus formed by the discharged liquid. The meniscus M is balanced in the vicinity of the discharge ports 18 with respect to the inner pressure of the common liquid chamber 13 which is usually negative by means of the capillary force generated by each of the discharge ports 18 and the inner wall of the liquid flow path 10 communicated with it.

The liquid flow paths 10 are structured by bonding the elemental substrate 1 provided with the heating members 2, and the ceiling plate 50, and in the area near the plane at which the heating members 2 and discharge liquid are in contact, the bubble generation area 11 is present where the heating members 2 are rapidly heated to enable the discharge liquid to form bubbles. For each of the liquid flow paths 10 having the bubble generation area 11, respectively, the movable member 31 is arranged so that at least a part thereof is arranged to face the heating member 2. The movable member 31 has its free end 32 on the downstream side toward the discharge port 18, and at the same time, it is arranged in a cantilever fashion where its one end is supported by the supporting member 34 arranged on the upstream side of the liquid flow path 10. Particularly, in accordance with the present embodiment, the free end 32 is arranged on the central portion of the bubble generation area 11 in order to suppress the development of a half of the bubble on the upstream side which exerts influences on the back waves toward the upstream side and the inertia of the liquid. Then, along with the development of the bubble created in the bubble generation area 11, the movable member 31 can be displaced with respect to the supporting member 34. In this displacement, the fulcrum 33 becomes the supporting portion of the supporting member 34 to support the movable member 31.

Above the central portion of the bubble generation area 11, the stopper (regulating portion) 64 is positioned to regulate the displacement of the movable member 31 within a certain range in order to suppress the development of a half of the bubble on the upstream side. In the flow from the common liquid chamber 13 to the discharge port 18, there is arranged a lower flow path resistance area 65, which presents the relatively lower flow path resistance than the liquid flow path 10, on the upstream side with the stopper 64 as the boundary. The flow path structure in the area 65 is such as to provide no upper wall or to make the flow path sectional area larger, hence making the resistance that liquid receives from the flow path smaller when the liquid moves.

With the structure arranged as above, the head structure is formed, which is characterized in that unlike the conventional art, each of the liquid flow paths 10 having the bubble generation area 11 becomes an essentially closed space by the contact between the displaced movable member 31 and the stopper 64 with the exception of each of the discharge ports 18.

Now, detailed description will be made of the discharge operation of the liquid discharge head in accordance with the present embodiment. Here, FIGS. 10A to 10F represent the first liquid discharge. FIGS. 11A to 11E represent the second liquid discharge which follows the first one. FIG. 12 is a graph which shows the volumes of the bubble at the time of driving, and the displacements of the movable member.

Figure 10A:
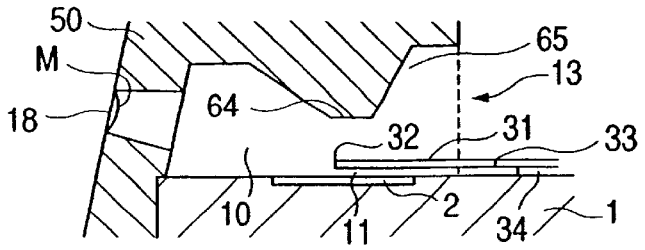
FIGS. 10A, 10B, 10C, 10D, 10E and 10F are cross-sectional views which illustrate the liquid discharge head in accordance with a fourth embodiment of the present invention, taken along in the liquid flow path direction, and which illustrate the first liquid discharge operation by dividing it into FIGS. 10A, 10B, 10C, 10D, 10E and 10F.
Figure 11A:
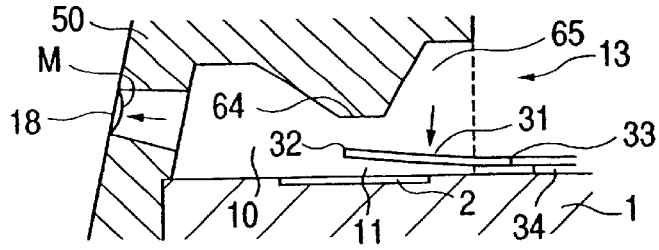
FIGS. 11A, 11B, 11C, 11D and 11E are cross-sectional views which illustrate the second liquid discharge operation following those shown in FIGS. 10A, 10B, 10C, 10D, 10E and 10F by dividing it into FIGS. 11A, 11B, 11C, 11D and 11E.

FIG. 10A shows the state before the energy, such as the electric energy, is applied to the heating member 2, which illustrates the state before the heating member generates heat. What is important here is that the movable member 31 is positioned to face a half of the bubble on the upstream side for each of the bubbles created by the heating of the heating member 2 (in the initial state), and the stopper 64 that regulates the displacement of the movable member 31 is arranged above on the central portion of the bubble generation area 11. In other words, with the structure of the flow paths and arrangement position of each of the movable members, a half of the bubble on the upstream side is held down to the movable member 31. If electric pulses are applied to the heating member at the time T=0 as shown in FIG. 12, a part of liquid filled in the bubble generation area 11 is heated by the heating member 2 to create bubble 40 along with film boiling. Then, as the time elapses, the bubble 40 is developed to make its volume larger. Here, at this juncture, the displacement of the movable member begins later than the voluminal changes of the bubble 40 due to the repellent force of the movable member (at the time A indicated in FIG. 12).

Figure 10B:
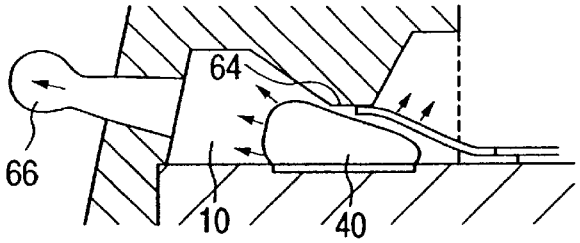

As shown in FIG. 12, with the development of the bubble 40, the shift of the flow in the direction toward the upstream side, that is, toward the common liquid chamber 13, becomes the large flow by the presence of the lower flow path resistance area 65. However, when the movable member 31 is displaced in the vicinity of the stopper 64 or to be in contact with it, any further displacement is regulated (at the time B in FIG. 12). As a result, the liquid shift in the direction toward the upstream is largely restricted there. In other words, with the displaced movable member 31 in this state, the upstream side of the liquid flow path 10 (at least the upstream side of the center of the bubble generation area 11) is substantially closed. As a result, the distribution of the liquid and bubble 40 is essentially cut off between the liquid flow path 10 and the common liquid chamber 13 positioned on the upstream thereof. In this manner, the development of the bubble 40 to the upstream side is restricted by the movable member 31. Nevertheless, since the shifting force of the liquid in the direction toward the upstream side is great, the movable member 31 receives the stress in the form that it is pulled in the upstream direction, and held in such state. During this period, the bubble 40 is developed to present the maximum volume as described earlier (at the time C in FIG. 12). FIG. 10B shows the state where the bubble 40 is developed to the maximum in the bubble generation area 11. At this juncture, the liquid in the liquid flow path 10 is shifted to the downstream side and the upstream side by the pressure exerted by the creation of the bubble 40. On the upstream side, the movable member 31 is displaced by the development of the bubble 40, and on the downstream side, the discharge liquid droplet 66 is caused to fly out from the discharge port 18.

In accordance with the present invention, the straight flow path structure is kept between the portion of the bubble 40 on the discharge port side, and the discharge port, that is, the structure is in the "linearly communicated state" as shown in FIG. 23. More preferably, this state is made such as to enable the propagating direction of the pressure waves generated at the time of bubble creation to be in agreement linearly with the flow direction of the liquid, as well as with the discharge direction thereof, following the pressure waves thus generated. It is desirable to attain the ideal state in this manner so as to stabilize at an extremely high level the discharge condition of the discharged liquid droplets 66, such as the discharge direction and the discharge speed thereof. For the present invention, it should be good enough as one of the definitions to attain this ideal state or approximate the structure to be in the ideal state if only the structure is arranged to directly connect on the straight line the discharge port 18 with the heating member 2 (particularly, with the heating member on the discharge port side (on the downstream side) which is more influential on bubbling). The state thus obtained can be observed from the outside of the discharge port if no liquid is present in the flow path. Particularly, the downstream side of the heating member is made observable in this state.

Figure 10C:
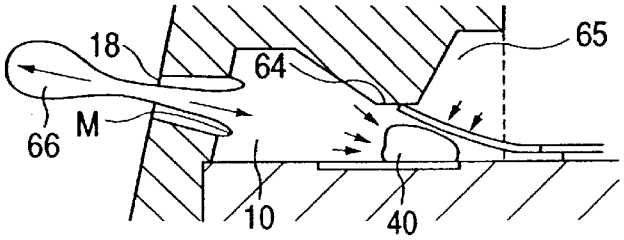

After that, as shown in FIG. 10C, the contraction of the bubble 40 begins when the negative pressure in the interior of the bubble has overcome the shifting of the liquid to the downstream side in the liquid flow path subsequent to the film boiling described earlier, At this juncture, the force of the liquid which is exerted by the development of the bubble still remains largely in the upstream side. Therefore, the movable member 31 is still in contact with the stopper 64 for a specific period after the contraction of the bubble 40 has begun, and the most of the contracted bubble 40 exerts the shifting force of liquid in the upstream direction from the discharge port 18. In other words, immediately after the stage shown in FIG. 10B, the upstream side of the liquid flow path 10 is closed by the displaced movable member 31 which is in contact with the stopper 64, hence making the liquid flow path 10 having the bubble generation area 11 in it an essentially closed space with the exception of the discharge port 18. Therefore, the contracting energy of the bubble 40 acts as a force to shift the liquid in the vicinity of the discharge port 18 in the upstream direction. Consequently, the meniscus M is largely drawn back from the discharge port 18 to the interior of the liquid flow path 10 to quickly cut off the liquid column which is connected with the discharged liquid droplet 66. Then, as shown in FIG. 10D, the resultant satellite (sub-droplets) 67 becomes smaller, which remains on the outer side of the discharge port 18.

Figure 10D:
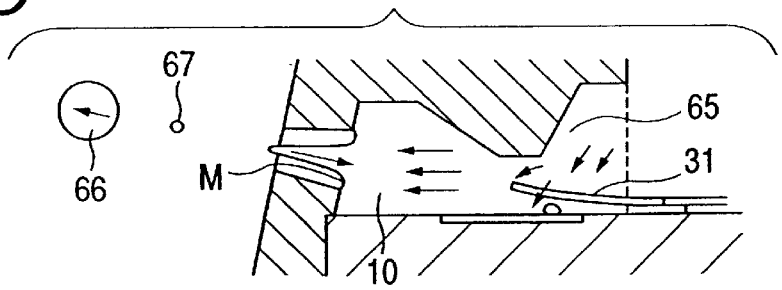

FIG. 10D shows the state where the discharge liquid droplet 66 whose disappearing process is completed, and the meniscus M are cut off. At first, in the lower flow path resistance area 65, the resiliency of the movable member 31 overcomes the shifting force of the liquid in the upstream direction. Then, the movable member 31 begins its downward displacement (from the displaced state to the initial state). Along with this, the flow in the lower flow path resistance area 65 begins in the downstream direction (at the time D in FIG. 12). Here, at the same time, since the flow in the downstream direction of the lower flow path resistance area 65 has a smaller flow path resistance, the flow becomes larger and flows into the liquid flow path 10 through the stopper 64 portion. As a result, the flow that causes the meniscus M to be drawn into the interior of the liquid flow path 10 is reduced abruptly. Then, the meniscus M begins to return in a comparatively slow speed to the position at which the bubbling is originated, while drawing the liquid column, which remains outside the discharge port 18. Thus, it becomes possible to settle the vibrations of the meniscus at a high speed.

On the other hand, the discharged liquid droplet 66 and the satellite 67 residing immediately after the discharged liquid droplet are extremely close to each other due to the rapid meniscus drawing as shown in FIG. 10C. Here, the so-called slip stream phenomenon is created, which causes the satellite, which closely follows the discharged liquid droplet, to be attracted to it due to the eddy current occurring behind the flying discharged liquid droplet 66.

Now, this phenomenon will be described precisely. With the conventional liquid discharge head, the liquid droplet is not in the spherical form the moment liquid is discharged from the discharge port of the liquid discharge head. The liquid droplet is discharged almost in the form of a liquid column having it spherical part on the leading end thereof. Thus, the trailing portion is tensioned both by the main droplet and the meniscus, and when it is cut off from the meniscus, the satellite dots are formed with the trailing portion. Here, it is known that the satellites fly to a recording medium together with the main droplet. The satellites fly behind the main droplet, and also, the satellites are drawn by the meniscus. Therefore, the discharge speed thereof is slower to that extent to cause its impacted position to be deviated from that of the main droplet. This inevitably degrades the quality of prints. In accordance with the liquid discharge head of the present invention, the force that draws back the meniscus is much greater than the conventional liquid discharge head as described earlier. Thus, the drawing force given to the trailing portion is stronger after the main droplet has been discharged. The force with which the trailing portion is cut from the meniscus becomes stronger accordingly to make its timing faster. As shown in FIG. 10C, with the stronger and faster force with which the meniscus is drawn back, the trailing portion between the main droplet and the meniscus is quickly pulled to make this portion of the liquid column thinner than the conventual one. The liquid column can be easily cut off at this thinner portion. As a result, the satellite dots which are formed from the trailing portion become much smaller, and the distance between the main droplet and satellite dots is also made shorter. Further, since the trailing portion is not drawn by meniscus continuously for a longer period, the discharge speed does not become slower. Hence, the satellites 67 are drawn to the main droplet by the slip stream phenomenon occurring behind the discharged liquid droplet 66.

In this respect, the reason why the meniscus can be drawn quickly to make the trailing portion thinner is that whereas the bubble 40 is contracted, the liquid is not drawn from the upstream side, because the upstream side of the liquid flow path 10 is closed, and the liquid is drawn only form the downstream side (near the discharge port). This state appears only between the time at C in FIG. 12 (that is, the bubble 40 presents the maximum volume, and the disappearing begins) and the time at D (that is, the movable member 31 begins to be restored).

Figure 10E:
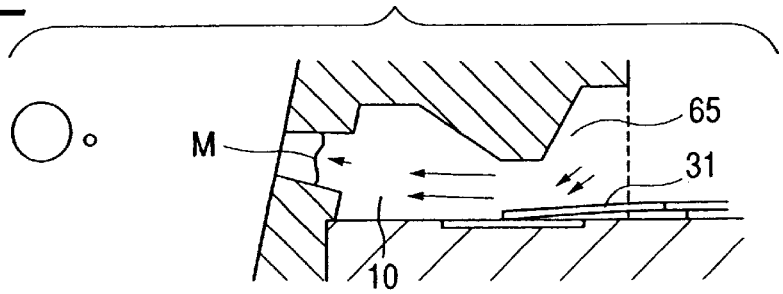

FIG. 10E shows the condition where the state illustrated in FIG. 10D has further advanced. Here, the satellite 67 is still closer to the discharged liquid droplet 66, at the same time, being drawn to it. Then, the drawing force exerted by the slip stream phenomenon becomes greater. On the other hand, the liquid shift from the upstream side in the direction toward the discharge port 18 creates the phenomenon that the liquid is drawn from the upstream side, and the liquid is pushed out in the discharge port 18 direction, because the overshoot displacement of the movable member 31 causes it to be displaced lower than the initial position (at the time E in FIG. 12). Further, by the expansion of the sectional area of the liquid flow path due to the presence of the stopper 64, the liquid flow is increased in the direction toward the discharge port 18 to enhance the restoring speed of the meniscus M to the discharge port 18. In this manner, the refilling characteristic of the present embodiment is drastically improved.

Figure 10F:
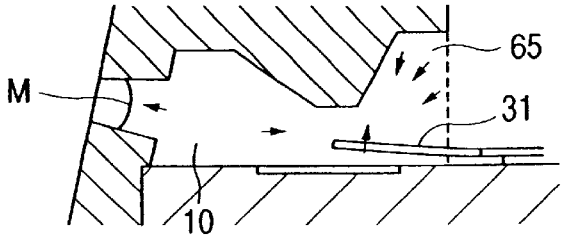

FIG. 10F shows the condition in which the state illustrated in FIG. 10E has further advanced, and the satellite 67 is caught into the discharged liquid droplet 66. The combined body of the discharged liquid droplet 66 and the satellite 67 is not necessarily the phenomenon that should occur under any circumstances per discharge for other embodiments. Depending on conditions, such phenomenon takes place or it does not take place at all. However, by eliminating the satellites or at least by reducing the amount of satellites, there is almost no deviation between the impact positions of the main droplet and the satellite dots on the recording medium so as to minimize the adverse effect that may be produced on the quality of prints. In other words, the sharpness of printed images is enhanced to improve the quality of prints, and at the same time, it becomes possible to avoid making them mists and reduce the occurrence of the damage that the mist thus created may stain the printing medium or the interior of the recording apparatus.

In the meantime, the movable member 31 is again displaced in the direction toward the stopper 64 due to the reaction of its overshooting. Then, the attenuating vibrations, which are determined by the configuration of the movable member 31, the Young's modulus, the viscosity of liquid in the liquid flow path, and the gravity, are performed. Before the attenuating vibrations are settled, the second liquid discharge operation is executed. In other words, in accordance with the present embodiment, if liquid is discharged from the same discharge port 18 twice in succession, the next driving pulses are supplied to the heating member 2 (at the time F in FIG. 12) when the movable member 31 is being displaced downward (the direction in which it parts from the stopper 64) as shown in FIG. 11A before the vibrations of the movable member 31 are settled following the completion of the previous liquid discharge.

Figure 11B:
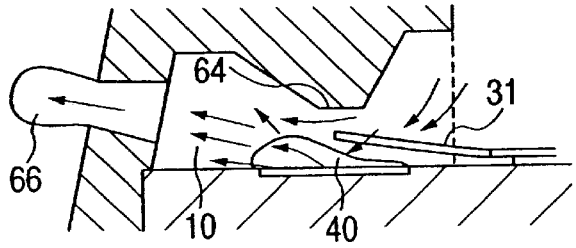
Figure 11C:
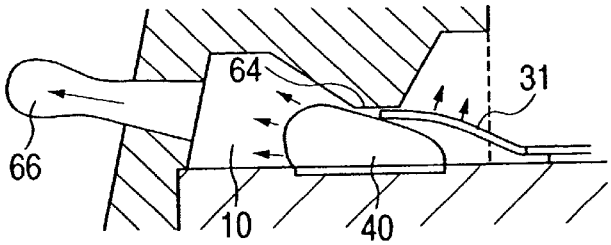
Figure 11D:
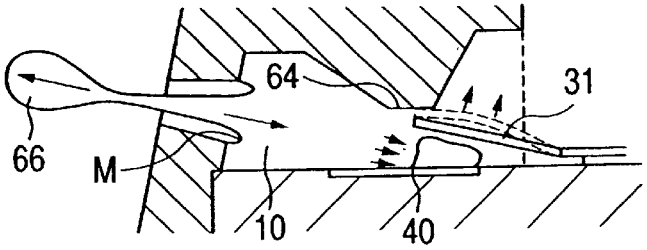
Figure 12:
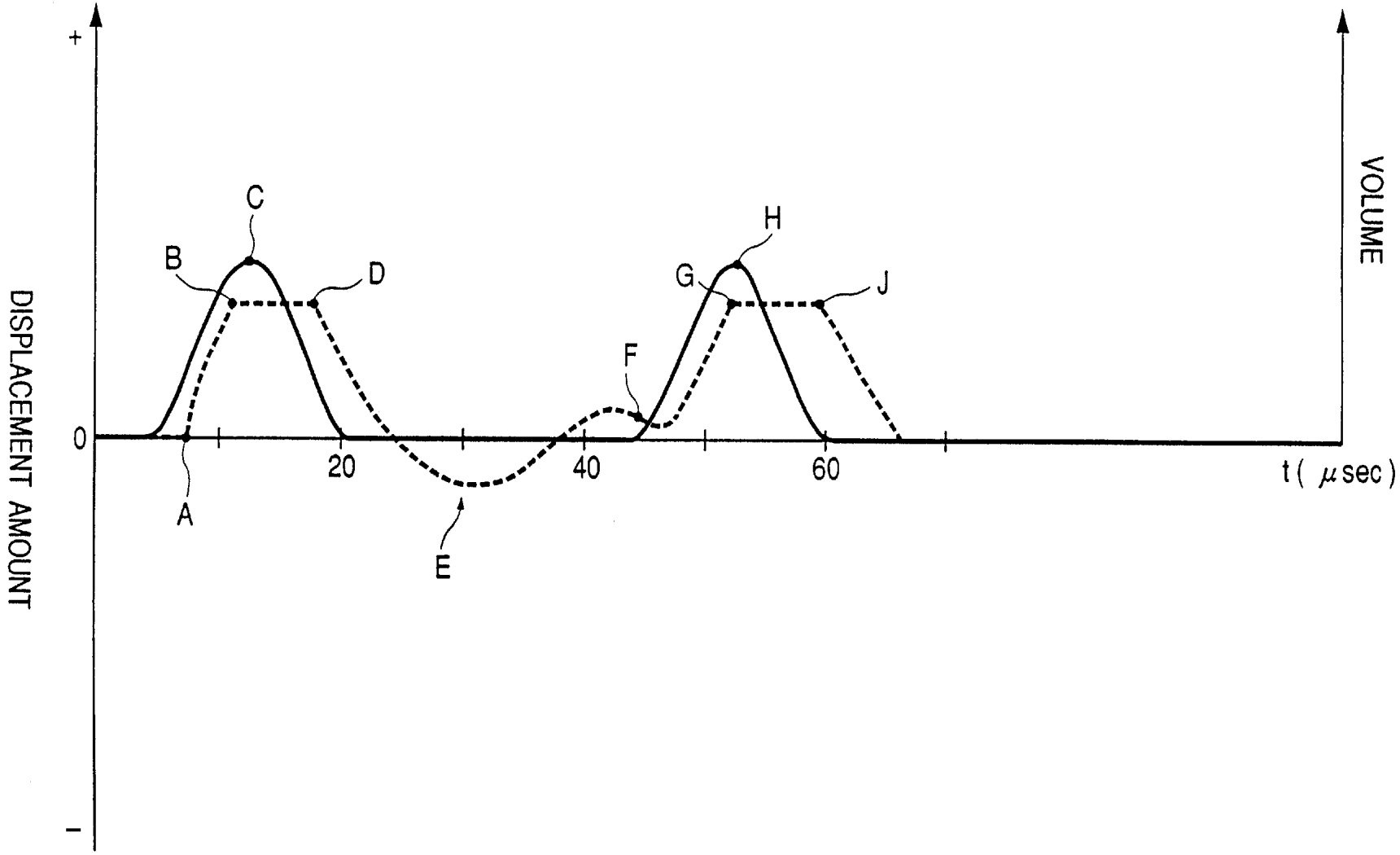
FIG. 12 is a graph which shows the relationship between the displacement of the movable member and the development of bubble in accordance with the fourth embodiment.

Then, as shown in FIG. 11B, while the movable member 31 is being displaced downward, the bubble 40 is created and developed on the bubble generation area 11. Since the movable member 31 is provided with the preliminary downward acceleration, the timing of the displacement of the movable member 31 is slow with respect to the creation and development of the bubble 40, and a comparatively large time lag takes place. At this juncture, the bubble 40 tends to be developed equally on the downstream side (the discharge port 18 side) and the upstream side (the common liquid chamber 13 side), but by the force exerted by the downward displacement of the movable member 31 (the direction in which it parts from the stopper 64), the development of the bubble 40 to the upstream side is suppressed. Then, to the extent that its development to the upstream side is suppressed, the development of the bubble 40 is promoted to the downstream side. The development of the bubble 40 to the upstream side becomes the energy that directly acts upon the liquid discharge.

At the time G in FIG. 12, the movable member 31 is in contact with the stopper 64 to close the upstream side of the liquid flow path 10. The bubble generation area 11 is essentially in the closed state with the exception of the discharge port 18. At the time H in FIG. 12, the bubble 40 presents the maximum volume as shown in FIG. 10C. At this juncture, the discharge liquid droplet 66 is being discharged from the discharge port 18.

Now, the disappearing process begins. In the earlier stage of the disappearing of the bubble 40, its contraction causes the liquid shift from the discharge port to draw in the meniscus largely. Thus, the liquid column connected with the discharged liquid droplet is cut off. At the time H and on, the movable member 31 is in the displaced state and in contact with the stopper as in FIG. 11D. The upstream side of the liquid flow path 10 is essentially closed so that the suction force exerted by the contraction of the bubble 40 mainly acts upon drawing in the liquid from the meniscus.

The retracting force of the meniscus becomes stranger and faster accordingly.

Figure 11E:
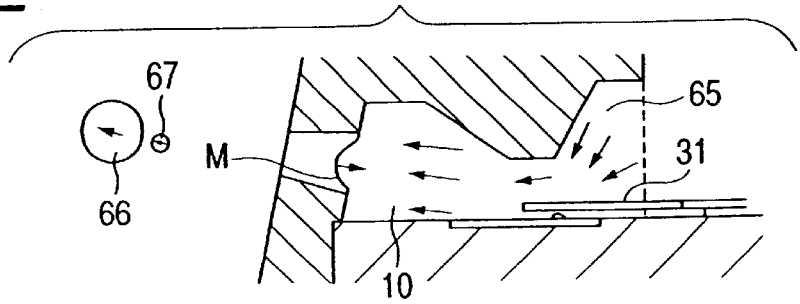

As described earlier, the trailing portion becomes thinner during the period from the time at which the bubble 40 presents the maximum volume, that is, the initiation of disappearing (the time H in FIG. 12) to the time at which the movable member 31 begins its restoration (the time J in FIG. 12). Then, in accordance with the present embodiment, the heating member 2 is driven while the movable member 31 is displaced downward. Therefore, the deviation of timing becomes larger between the movable member and the voluminal changes of the bubble 40 at the time F and on. Therefore, the time interval between the time H and the time J in FIG. 12 is great, thus drawing in the meniscus rapidly. Further, as described earlier, in accordance with the present embodiment, the forward development of the bubble is promoted so as to make the speed of the discharge liquid droplet faster. As a result, the difference in the relative speeds of the discharge liquid droplet to be discharged externally and the meniscus that is drawn internally becomes extremely large, which makes it easier to separate the trailing portion of the liquid column. With the easier separation, as shown in FIG. 11E, the discharged liquid droplet is cut in good condition, and at the same time, the satellites are absorbed by the discharged liquid droplet even if some of them are created slightly, because these satellites are located in the vicinity of the discharged liquid droplet and the slip stream phenomenon takes place to pull them in by the eddy current behind the flying discharge liquid droplet.

Lastly at the time J, the movable member 31 begins the downward displacement, and the flow begins in the downstream direction (toward the discharge port) in the lower flow path resistance area 65. At this juncture, the regulation of the movable member 31 is released. along with this, the liquid in the lower flow path resistance area 65 is allowed to flow in the vicinity of the bubble generation area at once, hence creating the strong flow from the upstream side to the downstream side in the liquid flow path 10. This liquid flow acts against the flow that draws in the meniscus rapidly to lower the retracting speed of the meniscus rapidly. As a result, the trailing portion of the liquid column becomes thicker. This thicker portion of the liquid column is not left outside the discharge port 18, but it is drawn into the interior of the discharge port slowly. Then, as shown in FIG. 1E, the movable member 31 is restored to the initial stage.

With the structure thus arranged, the liquid shift in the direction from the upstream to the discharge port is displaced downward more than the initial position. Then, the resultant phenomenon takes place to draw liquid from the upstream side and push out liquid in the direction toward the discharge port. At the same time, by the expansion of the sectional area of the liquid flow path, the liquid flow is increased in the direction toward the discharge port, hence accelerating the restoring speed of the meniscus to the discharge port. In this manner, the refilling characteristic of the present embodiment is drastically improved.

As described above, the driving pulses are applied to the heating member in the state that the movable member is being displaced downward (the direction in which it parts from the stopper). Hence, the direction of the development of the bubble 40 is controlled to implement the higher speed and efficiency of the liquid discharges. At the same time, the speed of the satellite becomes faster to make it easier to be in contact with the main droplet for the integration between them in flight. In this way, satellites are made smaller.

Fifth Embodiment

The description will be made of another structure of the liquid discharge head to which the bubble shifting mechanism, which is described earlier, is applied, although slightly different from the previous embodiment.

FIGS. 13A to 13E are cross-sectional views which illustrate the liquid discharge head in accordance with a fifth embodiment of the present invention, taken along in the liquid flow path direction, and which illustrate the characteristic phenomena in the liquid flow paths by dividing the process into FIGS. 13A to 13E.

For the liquid discharge head of the present embodiment, the heating members 2 are arranged on a flat and smooth elemental substrate 1 to enable thermal energy to act upon liquid as discharge energy generating elements to discharge liquid. Then, on the elemental substrate 1, liquid flow paths 10 are arranged corresponding to the heating members 2, respectively. The liquid flow paths 10 are communicated with the discharge ports 18, and at the same time, communicated with the common liquid chamber 13 to supply liquid to a plurality of liquid flow paths 10, hence receiving from the common liquid chamber 13 an amount of liquid that correspond to that of the liquid which has been discharged from each of the discharge ports 18. A reference mark M designates the meniscus formed by the discharged liquid. The meniscus M is balanced in the vicinity of the discharge ports 18 with respect to the inner pressure of the common liquid chamber 13 which is usually negative by means of the capillary force generated by each of the discharge ports 18 and the inner wall of the liquid flow path 10 communicated with it.

The liquid flow paths 10 are structured by bonding the elemental substrate 1 provided with the heating members 2, and the ceiling plate 50, and in the area near the plane at which the heating members 2 and discharge liquid are in contact, the bubble generation area 11 is present where the heating members 2 are rapidly heated to enable the discharge liquid to form bubbles. For each of the liquid flow paths 10 having the bubble generation area 11, respectively, the movable member 31 is arranged so that at least a part thereof is arranged to face the heating member 2. The movable member 31 has its free end 32 on the downstream side toward the discharge port 18, and at the same time, it is supported by the supporting member 34 arranged on the upstream side of the liquid flow path 10. Particularly, in accordance with the present embodiment, the free end 32 is arranged on the central portion of the bubble generation area 11 in order to suppress the development of a half of the bubble on the upstream side which exerts influences on the back waves toward the upstream side and the inertia of the liquid. Then, along with the development of the bubble created in the bubble generation area 11, the movable member 31 can be displaced with respect to the supporting member 34. In this displacement, the fulcrum 33 becomes the supporting portion of the supporting member 34 to support the movable member 31.

Above the end portion of the upstream side or above the upstream of the end portion of the upstream side of the bubble generation area 11, a fluid control portion 64 is positioned to control the flow of liquid in the liquid flow path 10, and at the same time, restrict the displacement of the movable member 31 within a certain range. The fluid control portion 64 is positioned on the upstream than the bubble generation area 11 to enable the free end 32 of the movable member 31 to be positioned on the downstream side of the fluid control portion 64.

With the structure arranged as above, the head structure is formed, which is characterized in that unlike the conventional art, each of the liquid flow paths 10 having the bubble generation area 11 becomes an essentially closed space by the contact between the displaced movable member 31 and the stopper 64 with the exception of each of the discharge ports 18.

Now, detailed description will be made of the discharge operation of the liquid discharge head in accordance with the present embodiment.

Figure 13A:
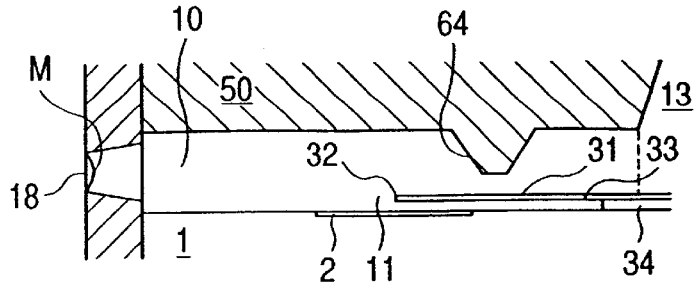
FIGS. 13A, 13B, 13C, 13D and 13E are cross-sectional views which illustrate the liquid discharge head in accordance with a fifth embodiment of the present invention, taken along in the liquid flow path direction, and which illustrate the characteristic phenomena in the liquid flow paths by dividing the process into FIGS. 13A, 13B, 13C, 13D and 13E.

FIG. 13A shows the state before the energy, such as the electric energy, is applied to the heating member 2, which illustrates the state before the heating member generates heat. What is important here is that the movable member 31 is positioned to face a half of the bubble on the upstream side for each of the bubbles created by the heating of the heating member 2, and the fluid control portion 64 that regulates the displacement of the movable member 31 is arranged on the upstream side of the bubble generation area 11. In other words, with the structure of the flow paths and arrangement position of each of the movable members, a half of the bubble on the upstream side is held down to the movable member 31.

Figure 13B:
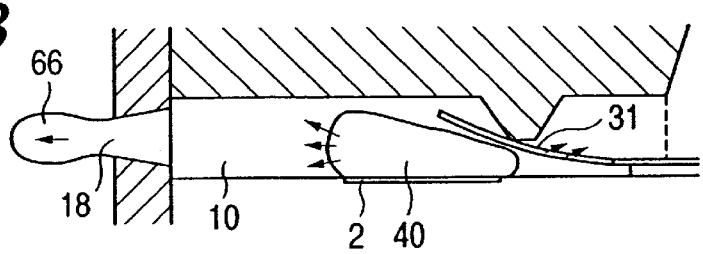

FIG. 13B shows the state where a part of the liquid filled in the bubble generation area 11 is heated by the heating member 2, and then, the bubble 40 is developed to the maximum along with the film boiling. At this juncture, the liquid in the liquid flow path 10 is shifted to the downstream side and the upstream side by the pressure exerted by the creation of the bubble 40. On the upstream side, the movable member 31 is displaced by the development of the bubble 40, and on the downstream side, the discharge liquid droplet 66 is caused to fly out from the discharge port 18. Here, the movable member 31 is displaced to the vicinity of the fluid control portion 64 or to be in contact with it, any further displacement is regulated. Then, the liquid, which flows in from the downstream side of the movable member 31 through the gap between the movable member 31 and the wall face of the liquid flow path 10, is restricted. Therefore, the liquid flow directed to the upstream side of the bubble generation area 11, that is, toward the common liquid chamber 13, is restricted. At the same time, the development of the bubble 40 to the upstream side is restricted by the movable member 31. Thus, the bubble 40 is developed to the downstream side which contributes to the performance of discharges. Further on the upstream side of the fluid control portion 64, the flow of the liquid toward the upstream side is largely restricted.

In accordance with the present invention, the straight flow path structure is kept between the portion of the bubble 40 on the discharge port side, and the discharge port, that is, the structure is in the "linearly communicated state". More preferably, this state is made such as to enable the propagating direction of the pressure waves generated at the time of bubble creation to be in agreement linearly with the flow direction of the liquid, as well as with the discharge direction thereof, following the pressure waves thus generated. It is desirable to attain the ideal state in this manner so as to stabilize at an extremely high level the discharge condition of the discharged liquid droplets 66, such as the discharge direction and the discharge speed thereof. For the present invention, it should be good enough as one of the definitions to attain this ideal state or approximate the structure to be in the ideal state if only the structure is arranged to directly connect on the straight line the discharge port 18 with the heating member 2 (particularly, with the heating member on the discharge port side (on the downstream side) which is more influential on bubbling). The state thus obtained can be observed from the outside of the discharge port if no liquid is present in the flow path. Here, in articular, the downstream side of the heating member is made observable in this state.

Figure 13C:
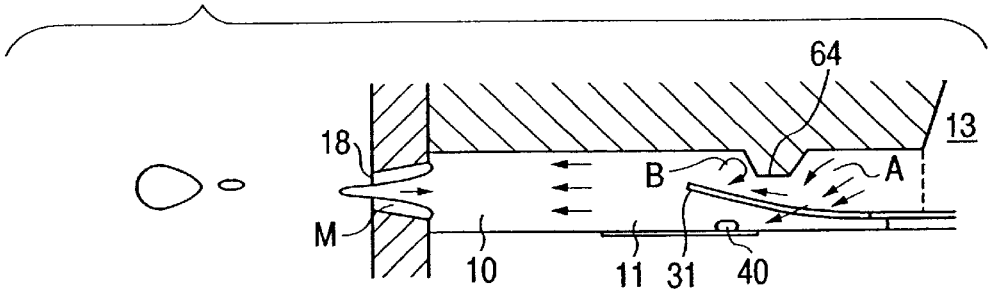

FIG. 13C shows the state where the contraction of the bubble 40 begins, and the discharged liquid droplet 66 and the meniscus M are cut off. Without the presence of the movable member 31, the rapid liquid flow created by the contraction of the bubble 40, which is directed from the upstream to the bubble generation area 11, may sometimes generate the liquid stagnation in the area A at the foot of the fluid control portion 64 and in the area B on the downstream side. However, if the movable member 31 is arranged, the fluid is allowed to flow to the downstream through the gap between the upper surface of the movable member 31 and the side end of the movable member 31, and the side walls of the liquid flow path 10 when the movable member 31 is displaced downward to leave the fluid control portion 64 along with the contraction of the bubble 40. Then, in the vicinity of the upstream side of the fluid control portion 64, the rapid flow in the direction toward the downstream side is dispersed. As a result, the liquid flow becomes slower once on the vicinity of the upstream of the fluid control portion 64 to make it possible even for the liquid in the area A to be provided with the velocity component in the direction toward the discharge port 18.

Also, the movable member 31 that begins the downward displacement due to the contraction of the bubble 40 causes the eddy current in the area B as shown in FIG. 13C. By this eddy current, the liquid on the area B is caught by the liquid flow in the direction toward the discharge port 18 from the common liquid chamber 13 side without creating the liquid stagnation, and then, flows toward the discharge port 18.

As described above, with the provision of the movable member 31 in the liquid flow path 10 with the fluid control portion 64, it becomes possible to allow the liquid in the vicinity of the fluid control portion 64 to flow in the direction toward the discharge port 18. Then, there is an effect that the residual bubble 40 in the liquid flow path 10 is exhausted to the outside from the discharge port 18. In this way, the unstable discharged due to the residual bubble in the liquid flow path 10 is reduced to make it possible to maintain the higher quality of prints.

Figure 13D:
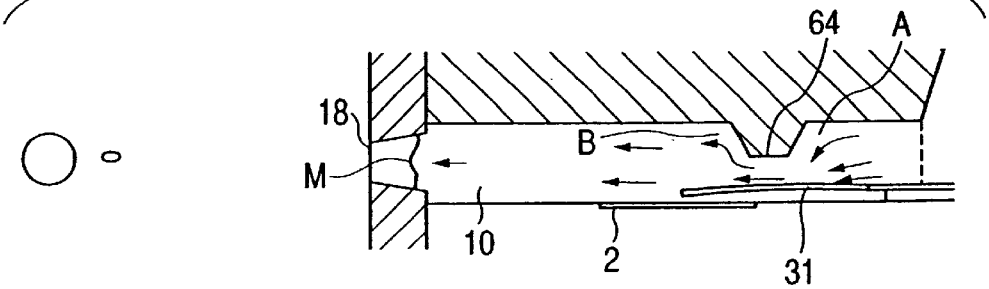

In FIG. 13D, the state represented in FIG. 13C has advanced to indicate that the movable member 31 has been overshot to the heating member 2 side than its initial position. The liquid shift in the direction from the upstream to the discharge port 18 creates the phenomenon that the liquid is drawn from the upstream side and push out liquid in the direction toward the discharge port 18 due to the downward displacement of the movable member 31 which is beyond the initial state, and further, by the expansion of the sectional area of the liquid flow path 10, where the fluid control portion 64 is present, the liquid flow is increased in the direction toward the discharge port 18, hence accelerating the restoring speed of the meniscus M to the discharge port 18. In this condition, there is no liquid stagnation in the area A in the vicinity of the fluid control portion 64 nor the eddy current in the area B, hence the liquid in the liquid flow path 10 being directed to the discharge port 18 uniformly. In this way, the refilling characteristic of the present embodiment is drastically improved.

Figure 13E:
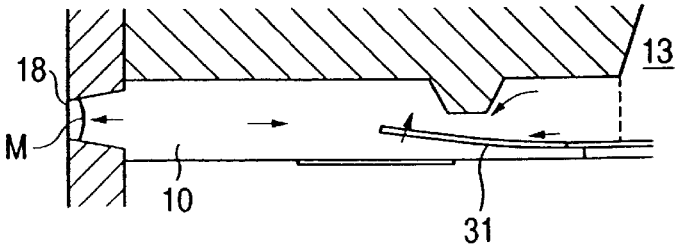

FIG. 13E shows the further advancement of the state represented in FIG. 13D, which illustrates the condition where the movable member 31 which has been overshot downward is overshot upward by its resiliency more than the normal status. At this juncture, the displacement of the movable member 31 is smaller than that shown in FIG. 13B. Therefore, it does not change the liquid flow in the liquid flow path 10 greatly. No liquid is discharged from the discharge port 18, either. After that, the movable member 31 is settled by the attenuating vibrations determined by the configuration of the movable member 31, the Young's modulus, the viscosity of liquid in the liquid flow path, and the gravity, and lastly comes to a stop in the initial position.

By the upward displacement of the movable member 31, the flow of liquid in the direction toward the discharge port 18 from the common liquid chamber 13 side is controlled so as to settle the movement of the meniscus M quickly in the vicinity of the discharge port 18. Therefore, it becomes possible to reduce the phenomenon of the meniscus M overshooting and others significantly, which may make discharge condition unstable to degrade the quality of prints.

Sixth Embodiment

FIGS. 14A to 14F are cross-sectional views which illustrate the liquid discharge head in accordance with a sixth embodiment of the present invention, taken along in the liquid flow path direction, and which illustrate the characteristic phenomena in the liquid flow paths by dividing the process into FIGS. 14A to 14F.

The liquid discharge head of the resent embodiment is different from the one described in conjunction with the fifth embodiment in that the leading end of the movable member 31 is made displaceable even after the movable member 31 is in contact with the fluid control portion 64 when it is displaced along with the development of the bubble 40. In other words, the fluid control portion 64 is positioned so that when the movable member 31 is displaced upward, it is in contact with this portion in the middle of the movable area of the movable member 31. All the other structures are the same as those of the first embodiment.

Figure 14A:
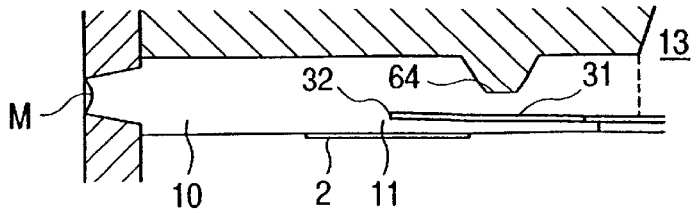
FIGS. 14A, 14B, 14C, 14D, 14E and 14F are cross-sectional views which illustrate the liquid discharge head in accordance with a sixth embodiment of the present invention, taken along in the liquid flow path direction, and which illustrate the characteristic phenomena in the liquid flow paths by dividing the process into FIGS. 14A, 14B, 14C, 14D, 14E and 14F.

FIG. 14A shows the state before the electric energy or the like is applied to the heating member 2, which shows the state before the heating member 2 generates heat.

Figure 14B:
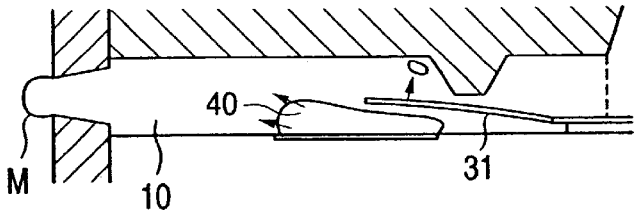

FIG. 14B shows the state where the liquid in the bubble generation area 11 is heated by the heating member 2, and the bubble is created along with the film boiling. In this state, the movable member 31 is displaced, and the meniscus M is expanded externally by the liquid shift in the liquid flow path 10 and the development of the bubble 40 along with bubbling.

Figure 14C:
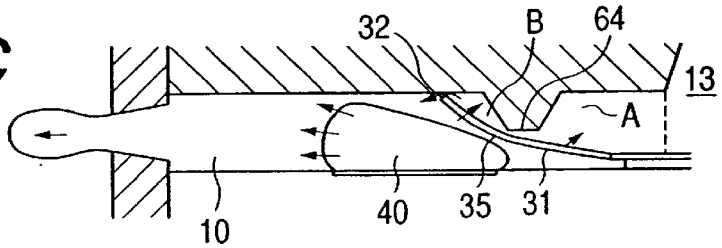

FIG. 14C shows the state where the created bubble 40 presents its maximum volume. In this state, the movable member 31 is displaced to be in contact with the fluid control portion 64. At the same time, the portion beginning at this contact point 35 to the free end 32 is further displaced upward with the contact point 35 as the bending point. When the free end 32 of the movable member 31 is displaced to approach the ceiling of the liquid flow path 10 or to be in contact with the ceiling thereof, any further displacement is regulated. Therefore, the upstream side of the bubble generation area 11, that is, the liquid shift in the direction toward the common liquid chamber 13 is restricted. Further, even on the upstream side of the fluid control portion 64, the liquid shift in the upstream direction is largely restricted.

Figure 14D:
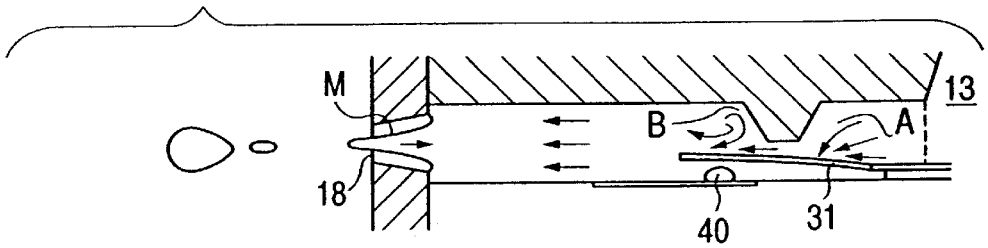

FIG. 14D shows the state where the bubble 40 is contracted. In this state, the rapid flow of the liquid in the vicinity of the upstream side of the fluid control portion 64 is dispersed along with the downward displacement of the movable member 31 as in the case described in conjunction with FIG. 13C. As a result, the liquid in the area A is provided with the velocity component in the direction toward the discharge port 18. At the same time, the eddy current takes place in the area B.

In accordance with the present embodiment, the volume of the liquid in the area B, which is surrounded by the movable member 31, the fluid control portion 64, and the side walls of the liquid flow path, is small. Therefore, the eddy current created by the downward displacement of the movable member 31 is faster than that in the case of the fifth embodiment. With the higher-speed eddy current, it becomes more difficult for the liquid in the area B to be stagnated, and joining with the liquid flow in the direction toward the discharge port 18 form the common liquid chamber 13 side, the eddy current is guided in the discharge port 18 direction. In this way, when the eddy current is joined, it is directed from the upstream toward the discharge port 18. As a result, the liquid flow toward the discharge port 18 is increased to accelerate the restoration of the meniscus M to the discharge port 18. In this manner, the refilling characteristics are further enhanced.

Figure 14E:
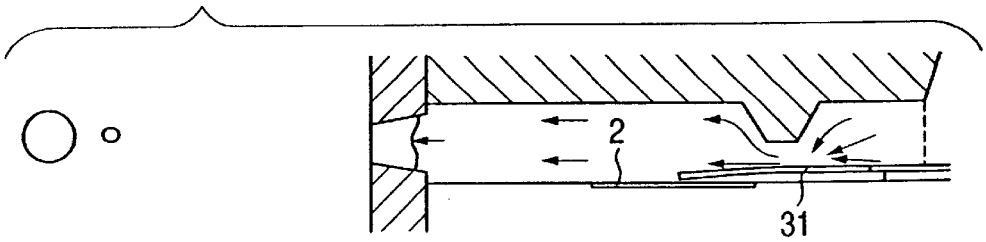
Figure 14F:
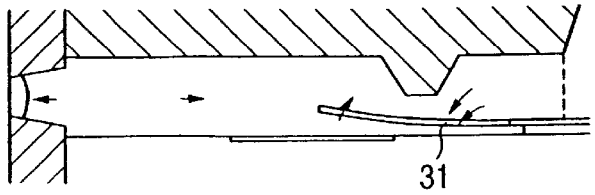

FIG. 14E shows the state where the movable member 31 has been overshot to the heating member 2 side more than the initial position. FIG. 14F shows the state where the movable member 31 which has been overshot downward is overshot upward by the resiliency thereof. The conditions shown in FIG. 14E and FIG. 14F are the same as those described in conjunction with FIG. 13D and FIG. 13E. Therefore, the detailed description thereof will be omitted.

Other Embodiments

Now, hereunder, the description will be made of various embodiments applicable to the head using the liquid discharge method described above.

Movable Member

Figure 15A:
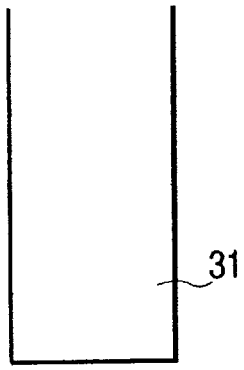
FIGS. 15A, 15B and 15C are views which illustrate another configuration of the movable member shown in FIG. 2.
Figure 15B:
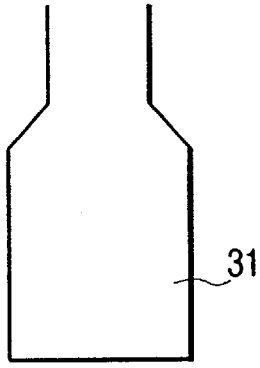
Figure 15C:
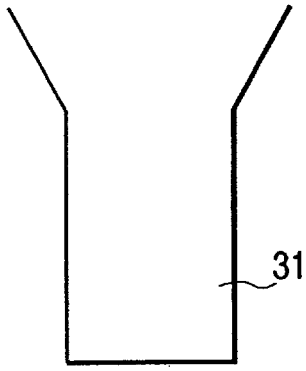

FIGS. 15A to 15C are views illustrate the other configurations of the movable member 31. FIG. 15A shows a rectangular one; FIG. 15B, the one having the narrower fulcrum side which makes the operation of the movable member easier; and FIG. 15C, the one having the wider fulcrum side to enhance the robustness of the movable member.

For the previous embodiment, the movable member 31 is formed by nickel of 5 $\mu$m thick. However, the material is not necessarily limited to it. As the one that forms the movable member, it should be good enough if only the material has the solvent resistance with respect to the discharge liquid, as well as it has the elasticity with which it can operate as the movable member in good condition.

As the material for the movable member 31, it is desirable to use the metal which has a high durability, such as silver, nickel, gold, iron, titanium, aluminum, platinum, tantalum stainless steel, phosphor bronze, or the alloy thereof; resins of nitrile group, such as acrylonitrile, butadiene, styrene; resins of amide group, such as polyamide; resins of carboxyl group, such as polycarbonate; resins of aldehyde group, such as polyacetal; resins of sulfone group, such as polysulfone, or liquid crystal polymer or other resin and the compound thereof; the metal which has high resistance to ink, such as gold, tungsten, tantalum, nickel, stainless steel, titanium, or the alloy thereof or any one of them having it coated on the surface to obtain resistance to ink; or resins of amide group, such as polyamide; resins of aldehyde group, such as polyacetal; resins of ketone group, such as polyether ketone; resins of imide group, such as polyimide; resins of hydroxyl group, such as phenol resin; resins of ethyl group, such as polyethylene; resins of epoxy group, such as epoxy resin; resins of amino group, such as melamine resin; resins of methylol group, such as xylene resin and the compound thereof; or ceramics, such as silicon dioxide, silicon nitride and the compound thereof. For the movable member 31 of the present invention, it is intended to use the one in a thickness of μm order to serve the purpose.

Now, the description will be made of the arrangement relations between the heating member and the movable member. With the optimal arrangement of the heating member and the movable member, it becomes possible to appropriately control the liquid flow when bubbling is performed by means of the heating member, and to effectively utilize the liquid flow as well.

Figure 16:
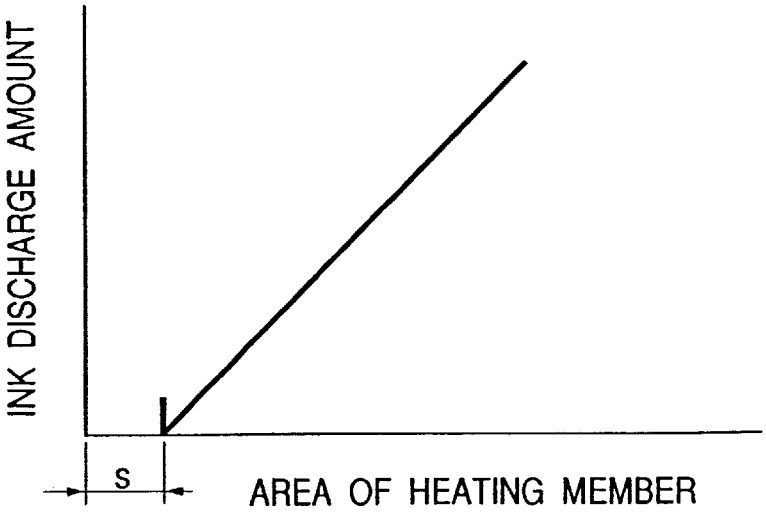
FIG. 16 is a graph which shows the correlations between the area of the heating member and the ink discharge amount.

In accordance with the conventional art that adopts the so-called bubble jet recording method, that is, with the application of thermal energy or the like to ink, the change of states is made, which is accompanied by the abrupt voluminal changes of ink (the creation of bubbles), and then, by the acting force based upon this change of states, ink is discharged from each of the discharge ports to cause it to adhere to a recording medium for the formation of images, it is clear from the representation of FIG. 16 that there is an area S in which no bubbling is effectuated, and which does not contribute to discharging ink, but it has bearing on the proportional relations between the area of the heating member and the amount of ink discharge. Also, from the burning condition observable on the heating member, it is understandable that this area S which does not effectuate bubbling is present on the circumference of each heating member. Then, it is assumed that a width of approximately 4 μm on the circumference of the heating member is not considered to participate in bubbling.

Therefore, in order to effectively utilize the bubbling pressure, the area should be arranged directly above the effective area of bubbling, which is inside the circumference of the heat member by approximately 4 μm or more, for the effective action of each movable member. However, for the present invention, attention is given to the bubble which should act on the liquid flow in the liquid flow path on the upstream side and the downstream side almost in the central portion of the bubble generation area (which is, in practice, a range of approximately ±10 μm in the direction of liquid flow from the center), thus dividing the bubbling action into the stage where it is effectuated individually and the stage where it is effectuated integrally. Then, what is most important here is to consider the arrangement which should be made to enable the movable member to face only the portion on the upstream side of the aforesaid central area. In accordance with the present embodiment, the effective area of bubbling is defined to be inside the circumference of the heating member by approximately 4 μm or more. However, this range is not necessarily limited to it. The range may be defined depending on the kinds of the heating member or the method of its formation.

Further, it is preferable to set the distance between the movable member and heating member is 10 μm or less on standby in order to form the aforesaid essentially closed space in good condition.

Elemental Substrate

Now, the structure of the elemental substrate will be described.

Figure 17A:
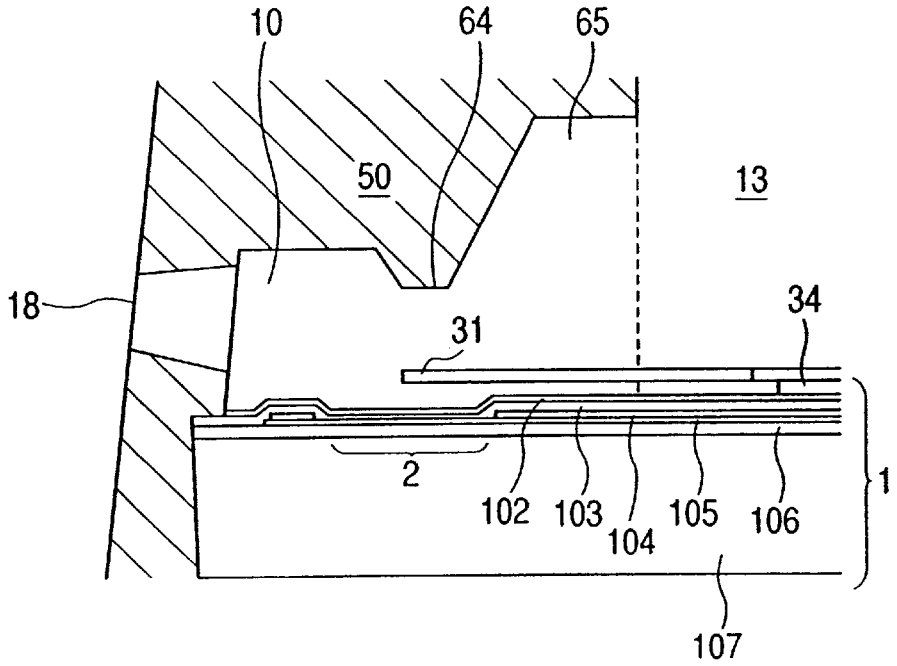
FIGS. 17A and 17B are vertically sectional views which illustrate the liquid discharge head in accordance with the present invention.
Figure 17B:
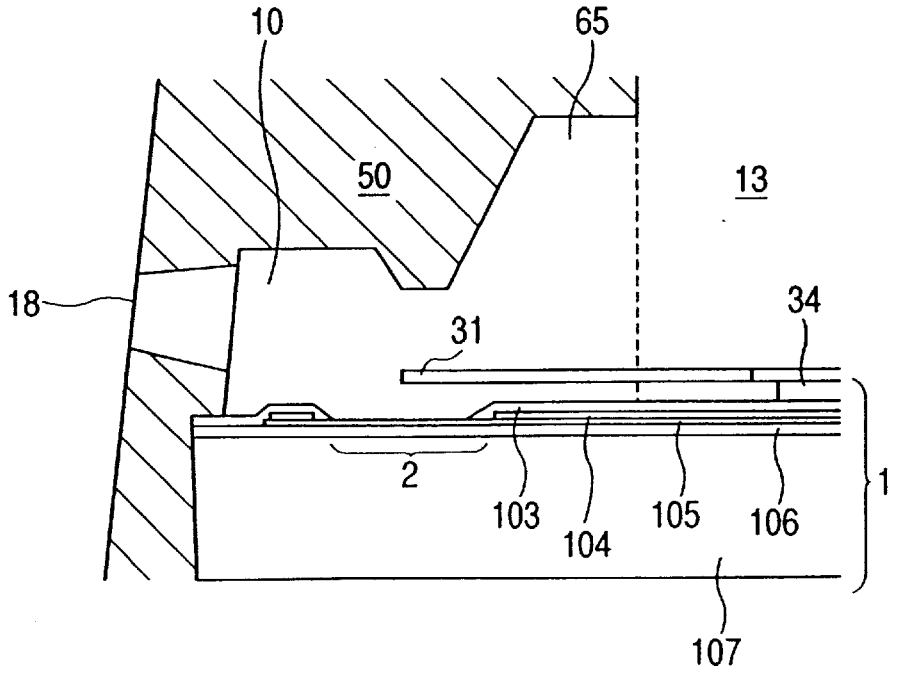

FIGS. 17A and 17B are vertically sectional views which illustrate the liquid jet head of the present invention. FIG. 17A shows the head which is provided with the protection film to be described later. FIG. 17B shows the one without the protection film.

The ceiling plate having the grooves that constitute each of the liquid flow paths 10, the discharge ports 18 communicated with the liquid flow paths 10, the lower flow path resistance areas 65, and the common liquid chamber 13 is arranged on the elemental substrate 1.

For the elemental substrate 1, the silicon oxide film or the silicon nitride film 106 is for the substrate 107 formed by silicon or the like for the purpose of insulation and heat accumulation. On this film, the electric resistive layer 105 (0.01 to 0.2 μm thick) formed by hafnium boride ($HfB_2$), tantalum nitride (TaN), tantalum aluminum (TaAl), and the wiring electrodes of aluminum or the like (0.2 to 1.0 μm thick) 104 are patterned to form the heating member 2 as shown in FIG. 17A. With the wiring electrodes 104, voltage is applied to the resistive layer 105 to energize it to generate heating. On the resistive layer between the wiring electrodes, the protection layer 103 is formed by silicon oxide, silicon nitride, or the like in a thickness of 0.1 to 2.0 μm. Further on that, the anticavitation layer 102 formed by tantalum or the like (0.1 to 0.6 μm thick) is filmed to protect the resistive layer 105 from ink or various other liquids.

Particularly, the pressure and impulsive waves generated at the time of creation and extinction of bubbles are extremely strong to cause the durability of the oxide film to be considerably lowered, because this film is hard but brittle. Therefore, metallic material, such as tantalum (Ta), is used for the anticavitation layer 102.

Also, by the combination of the liquid, the liquid flow path structure, and the resistive material, a structure may be arranged without any protection layer 103 provided for the aforesaid resistive layer 105. Such example is shown in FIG. 17B. For the material used for the resistive layer 105 that does not need any protection layer 103, an alloy of iridium-tantalum-aluminum or the like may be named.

In this way, the structure of the heating member may be formed only with the resistive layer (heating member) between the electrodes. Also, it may be possible to provide the protection layer that protects the resistive layer.

Here, as the heating member, it is arranged to use the one structured with the resistive layer which gives heat in accordance with the electric signals as the heating unit, but the heating member is not necessarily limited to it. It should be good enough if only the heating member can create bubbles in bubbling liquid, which are capable of discharging the discharge liquid. For example, it may be possible to use the heating member having the opto-thermal converting element that gives heat when receiving laser or other beams or having the heating unit that gives heat when receiving high frequency.

Here, for the aforesaid elemental substrate, it may be possible to incorporate in the semiconductor manufacturing process the transistors, diodes, latches, shift registers, or some other functional elements integrally for driving the electrothermal transducing devices selectively, besides such devices each of which is formed by the resistive layer 105 to constitute the heating unit as described earlier, and the wiring electrodes 104 to supply electric signals to the resistive layer.

Figure 18:
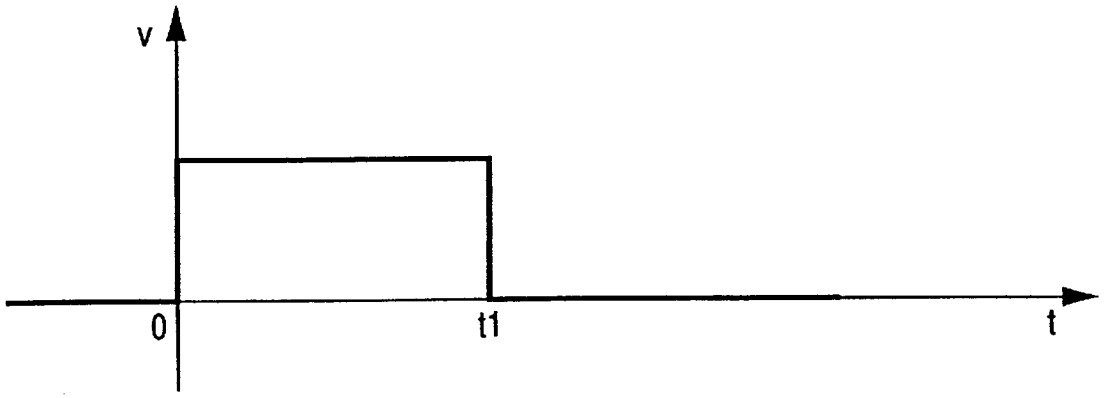
FIG. 18 is a view which shows the driving waveform of the heating member used for the present invention.

Also, in order to discharge liquid by driving the heating unit of the electrothermal transducing devices arranged for the elemental substrate as described above, the rectangular pulse as shown in FIG. 18 is applied to the resistive layer 105 though the wiring electrodes 104 to cause the resistive layer 105 to be heated abruptly between the wiring electrodes. For the head of each of the embodiments described earlier, the heating member is driven by the application of the voltage, 24V, the pulse width, approximately 4 μsec, the current, approximately 100 mA, and the electric signals at 6 kHz or more. Then, ink which serves as the liquid is discharged from each of the discharge ports by the operation as described earlier. However, the condition of the driving signal is not necessarily limited to it. It should be good enough if only the driving signal can bubble the bubbling liquid appropriately.

Discharge Liquid

Of the liquids described above, it is possible to use the ink having the composition usable for the conventional bubble jet apparatus as the liquid (recording liquid) used for recording.

Also, it is possible to utilize the liquid having a lower bubbling capability; the one whose property is easily changeable or deteriorated by the application of heat; or the highly viscose liquid, among some others, which cannot be used easily conventionally.

However, it is desirable to avoid using the liquid which tends to impede as the discharge liquid itself the discharge, the bubbling, the operation of the movable member, or the like as its property.

As the discharge liquid for recording use, it is possible to utilize the highly viscose ink or the like. Besides, in accordance with the present invention, the recording is made by use of the recording liquid having the following composition as the one usable for the discharge liquid:

Composition of Color Ink (Viscosity 2 cP)

| | |
|---|---|
| (C-1, Food black 2) color | 3 wt % |
| diethylene glycol | 10 wt % |
| thiodiglycol | 5 wt % |
| ethanol | 5 wt % |
| water | 77 wt % |

With the enhanced discharge power, the discharge velocity of ink becomes higher to make it possible to obtain recorded images in excellent condition with the enhanced impact precision of the liquid droplets.

The Structure of the Liquid Discharge Head

Figure 19:
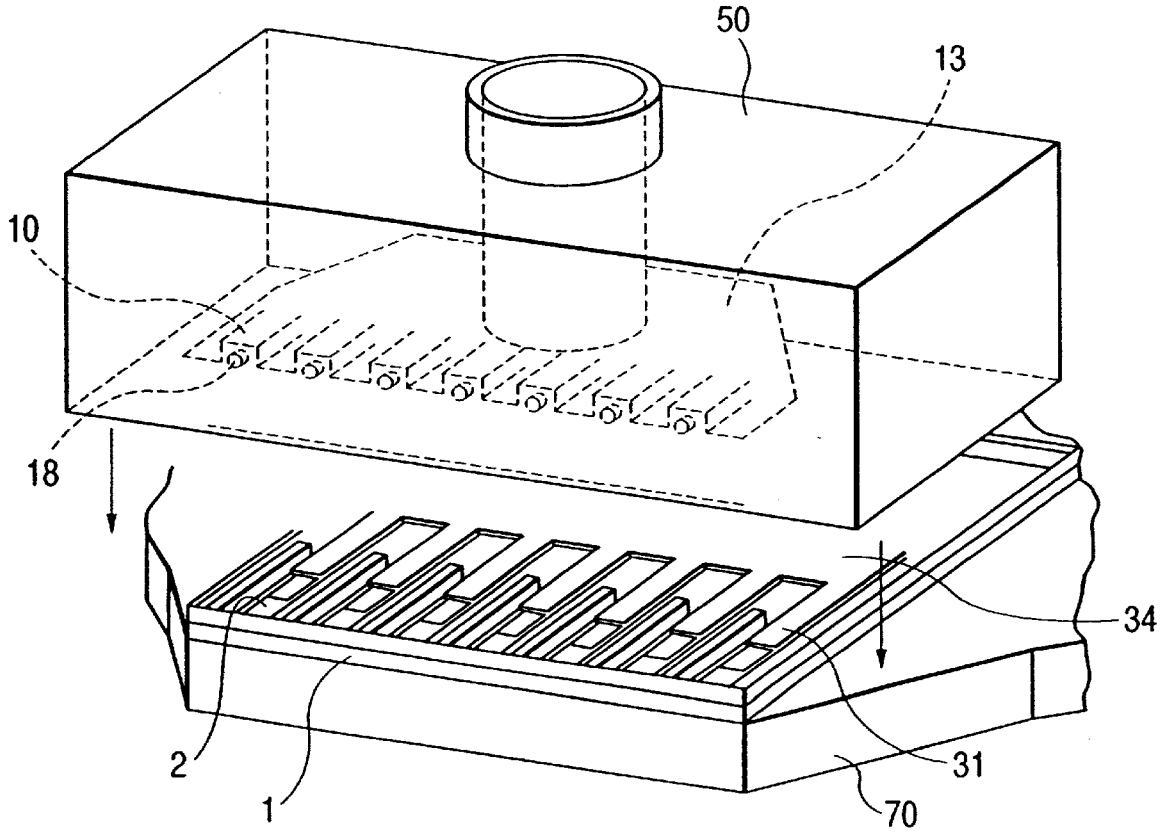
FIG. 19 is an exploded perspective view which shows the entire structure of the liquid discharge head in accordance with the present invention.

FIG. 19 is an exploded perspective view which shows the entire structure of the liquid discharge heat in accordance with the present invention.

The elemental substrate 1 having a plurality of heating members 2 provided therefor is arranged on the supporting member 70 formed by aluminum or the like. The supporting member 34 that supports movable members 31 is arranged so that each of the movable members faces a half of each of the heating members 2 on the common liquid chamber 13 side, respectively. Further on it, the ceiling plate 50 is arranged with a plurality of grooves that constitute the liquid flow paths 10, and a recessed groove of the common liquid chamber 13 as well.

Side Shooter Type

Figure 20A:
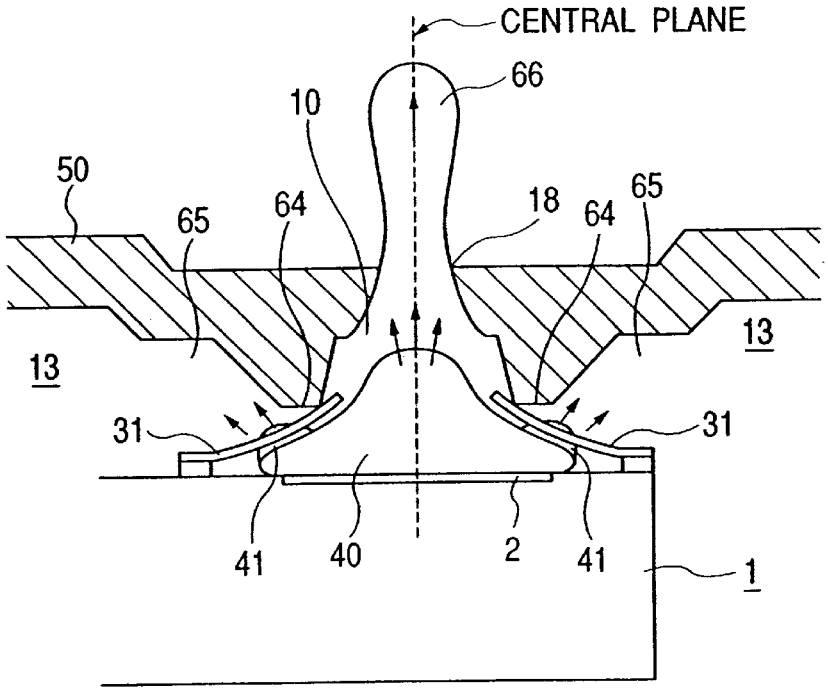
FIGS. 20A and 20B are views which illustrate the head of side shooter type to the liquid discharge method of the present invention is applicable.
Figure 20B:
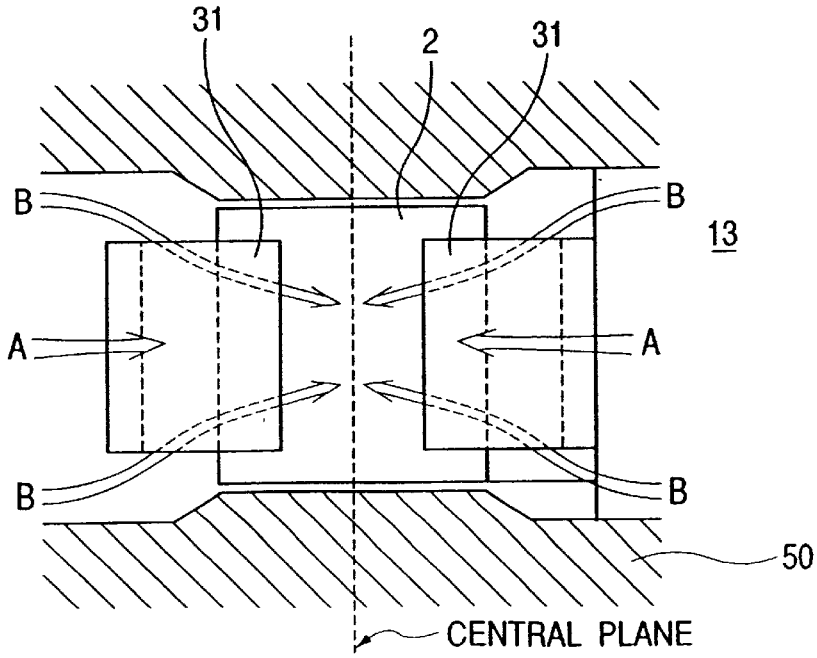

Here, the description will be made of the side shooter type head having the heating members and discharge ports facing each other on the parallel surfaces, to which the liquid discharge principle described in conjunction with FIGS. 1A to 1F and FIG. 2 is applied. FIGS. 20A and 20B are views which illustrate this side shooter type head.

In FIGS. 20A and 20B, the heating members 2 arranged on the elemental substrate 1 and the discharge ports 18 formed on the ceiling plate 50 are arranged to relatively face each other. The discharge port 18 is communicated with the liquid flow path 10 which passes on the heating member 2. In the vicinity of the area of the surface where liquid and the heating member 2 are in contact, the bubble generation area is present. Then, two movable members 31 are supported on the elemental substrate 1 each in the form to be in plane symmetry with respect to the surface that passes the center of the heating member. Each of the free ends of the movable member 31 are positioned to face each other on the heating member 2. Also, each of the movable members 31 has the same projection area to the heating member 2, and each of the free ends of the movable member 31 is apart from each other in a desired dimension. Here, if it is assumed that each of the movable members is separated by the separation wall that passes the center of the heating member, each of the free ends of the movable members is positioned in the vicinity of the center of the heating member, respectively.

Each of the stoppers 64 is arranged for the ceiling plate 50 to regulate the displacement of each movable member 31 within a certain range. In the flow from the common liquid chamber 13 to the discharge port 18, the lower flow path resistance area 65, which has the relatively low flow path resistance as compared with the liquid flow path 10, is arranged on the upstream side with the stopper 64 as the boundary. In this area 65, the structure of the flow path has a wider flow path section than that of the liquid flow path 10, hence making the resistance smaller that the liquid shift should receive from it.

Now, the description will be made of the characteristic functions and effects of the structure in accordance with the present embodiment.

FIG. 20A shows the state where a part of the liquid filled in the bubble generation area 11 is heated by the heating member 2, and the bubble 40 is developed to the maximum along with the film boiling. At this juncture, by the pressure exerted by the creation of the bubble 40, liquid in the liquid flow path 10 shifts in the direction toward the discharge port 18, and each of the movable member 31 is displaced by the development of the bubble 40 to cause the discharge liquid droplet 66 to be ready for its flight out of the discharge port 18. Here, the liquid shift in the direction toward the common liquid chamber 13 becomes a great flow by each of the lower flow path resistance areas 65. However, when the two movable members 31 are displaced to approach or to be in contact with each of the stoppers 64, any further displacement is regulated, and then, the liquid shift in the direction toward the common liquid chamber 13 is also greatly restricted there. At the same time, the development of the bubble 40 to the upstream side is also restricted by the movable members 31. Nevertheless, since the shifting force of the liquid to the upstream side is great, a part of the bubble 40 whose development is restricted by each of the movable member 31 is extruded on the upper surface side of the movable members through the gaps between the side walls that form the liquid flow path 10 and the side portions of the movable members 31. In other words, the extruded bubble 41 is formed.

When the contraction of the bubble 40 begins subsequent to a film boiling of the kind, the force of the liquid in the upstream direction remains greatly. As a result, each of the movable members 31 is still in contact with the stopper 64. Then, most of the contraction of the bubble 40 generated the liquid shift in the direction toward the upstream side from the discharge port 18. Therefore, the meniscus is largely drawn into the liquid flow path 10 from the discharge port 18 at that time, hence cutting off the liquid column connected with the discharged liquid droplet 66 quickly by the application of a strong force. Consequently, the satellites which are liquid droplets left outer side of the discharge port 18 become smaller.

When the disappearing process is almost completed, the resiliency (restoring force) of each movable member 31 overcomes the liquid shift in the upstream direction in each of the lower flow path resistance areas 65, the downward displacement of each movable member 31 begins, and then, the flow in the downstream direction also begins along with this displacement in the lower flow path resistance area 65. At the same time, since the flow path resistance is smaller in the flow in the downstream direction in the lower flow path resistance area 65, this flow becomes a large one rapidly to flows in the liquid flow path 10 through each of the stopper 64 portions. FIG. 20B shows the flows in the disappearing process of the bubble 40 as designated by the reference marks A and B. The flow A indicates the component of the liquid that flows from the common liquid chamber 13 in the direction toward the discharge port 18 through the upper side (the face opposite to the heating member) of the movable member 31. The flow B indicates the component of the liquid that flows through both sides of the movable member 31 and on the heating member 2.

As described above, in accordance with the present embodiment, the liquid for discharge use is supplied from the lower flow path resistance area 65 to enhance the refiling velocity of the liquid higher. Also, the flow path resistance is made smaller still by the presence of the common liquid chamber 13 which is arranged adjacent to each of the lower flow path resistance areas 65, hence making it possible to effectuate the higher refilling.

Moreover, in the disappearing process of the bubble 40, the extruded bubble 41 promotes the liquid flow from each of the lower flow path resistance areas 65 to the bubble generation area 11. Then, as described earlier, the disappearing is completed quickly in cooperation with the high speed drawing of the meniscus from the discharge port 18 side. Here, in particular, there is almost no possibility that bubbles are stagnated on the movable members 31 or in the corners of the liquid flow paths 10 by means of the liquid flow effectuated by the presence of the extruded bubble 41.

The Liquid Discharge Apparatus

Figure 21:
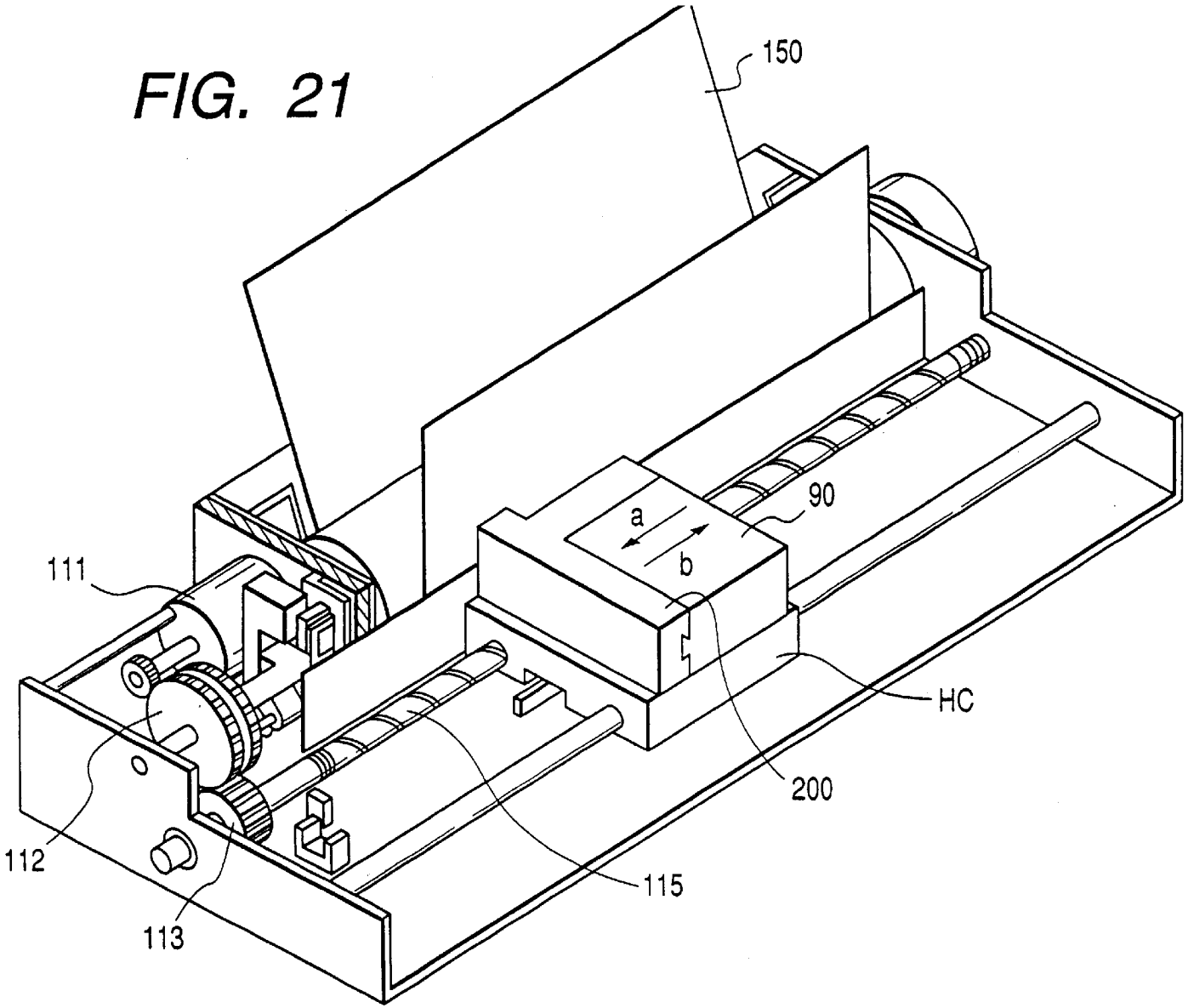
FIG. 21 is a view which schematically shows the structure of the liquid discharge apparatus having on it the liquid discharge head structured as illustrated in FIGS. 1A, 1B, 1C, 1D, 1E and 1F, and FIGS. 8A, 8B, 8C, 8D and 8E.

FIG. 21 is a view which schematically shows the structure of the liquid discharge apparatus having the liquid discharge head structured as described in conjunction with FIGS. 1A to 1F and FIGS. 20A and 20B. For the present embodiment, the description will be made particularly of an ink discharge recording apparatus that uses ink as the discharge liquid. The carriage HC of the liquid discharge apparatus mounts on it the head cartridge on which the liquid tank unit 90 that contains ink and the liquid discharge heat unit 200 are detachably mountable. The carriage is arranged to reciprocate in the width direction of the recording medium 150, such as a recording sheet, carried by means for carrying the recording medium.

When driving signals are supplied from driving signal supplying means (not shown) to liquid discharge means on the carriage, the recording liquid is discharged from the liquid discharge heat to the recording medium in accordance with the driving signals.

Also, in accordance with the liquid discharge apparatus of the present embodiment, there are provided the motor 111 serving as the driving source to drive the recording medium carrying means and the carriage; the gears 112, and 113 that transmit the driving power from the driving source to the carriage; and the carriage shaft 115, among others. With this recording apparatus and the liquid discharge method adopted for the recording apparatus, it is possible to obtain good images of recorded objects by discharging liquid onto various kinds of recording media.

Figure 22:
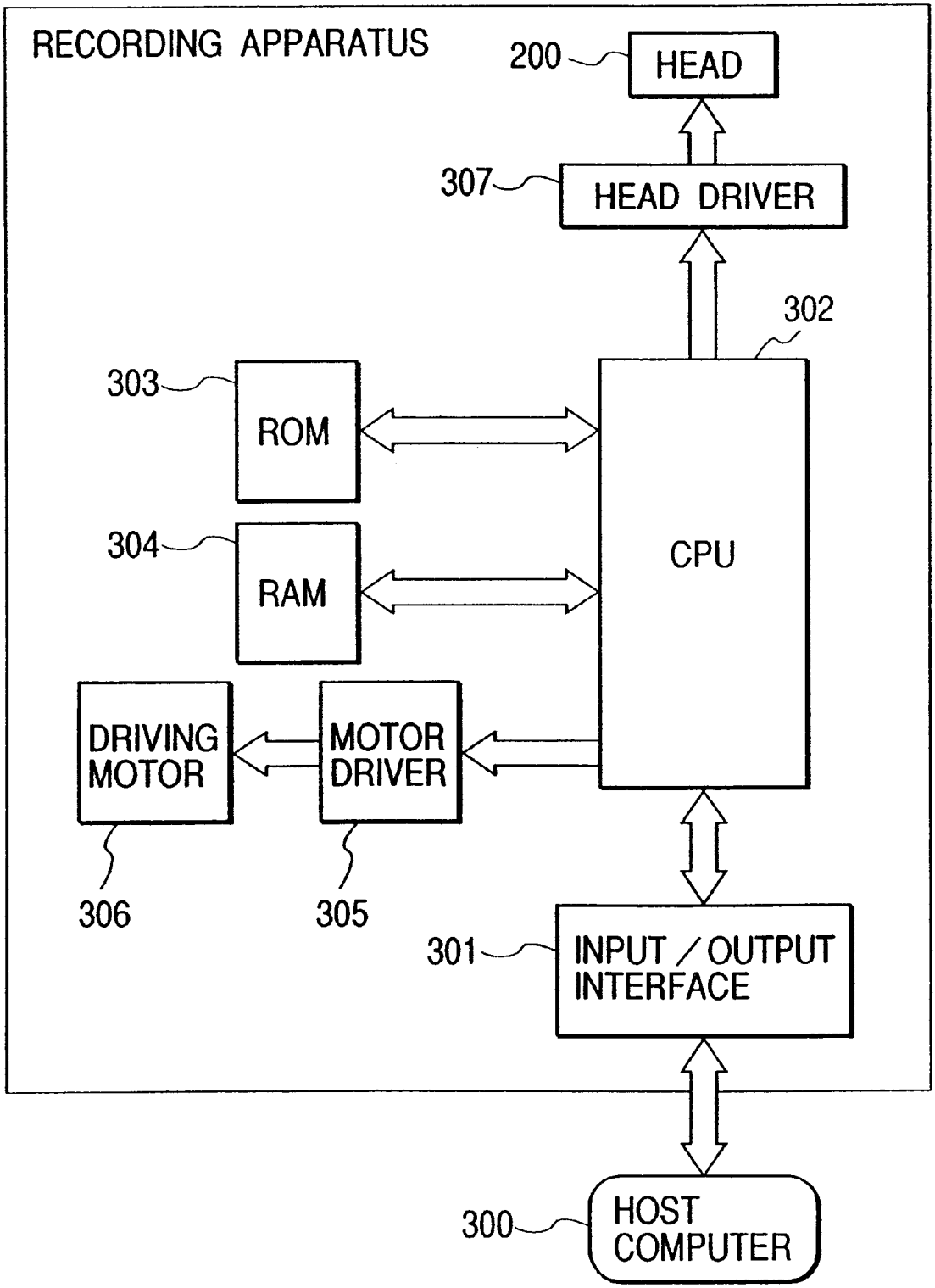
FIG. 22 is a block diagram which shows the apparatus as a whole whereby to operate the ink discharge recording in accordance with the liquid discharge method and liquid discharge head of the present invention.

FIG. 22 is a block diagram of the apparatus main body for operating the ink discharge recording by use of the liquid discharge method and liquid discharge head of the present invention.

The recording apparatus receives the printing information from the host computer 300 as the control signals. The printing information is provisionally held on the input interface 301 in the interior of the printing device, and at the same time, converted into the data which can be process in the recording apparatus, which are inputted into the CPU 302 which dually functions as means for supplying the head driving signals. The CPU 302 processes the data inputted into the CPU 302 by use of the RAM 304 and other peripheral devices in accordance with the control program stored on the ROM 303, hence converting them into the data (image data) used for printing.

Also, the CPU 302 produces the driving data for driving the driving motor which enables the recording medium and the recording head to shift in synchronism with the image data in order to record the image data on the appropriate positions on the recording medium. The image data and the motor driving data are transferred to the head 200 and the driving motor 306 through the head driver 307 and the motor driver 305, hence forming images by them to be driven by the controlled timing, respectively.

As the recording medium which is applicable to the recording apparatus described above to provide ink or other liquid therefor, there are various paper and OHP sheets, the plastic material usable for compact discs and ornamental boards, textile cloth, aluminum, copper, or some other metallic material, the leather material such as cowhide, pigskin, or artificial leather, wood material, such as woods, plywood, bamboo, ceramic material, such as tiles, and sponge or other three-dimensional structures, among some other objects.

Also, as the recording apparatus described above, there are a printing apparatus that records on various paper and OHP sheets or the like; the recording apparatus for use of plastics to recording on the plastic material, such as compact discs; the recording apparatus for use of metals to record on the metallic plates; the recording apparatus for use of leathers to recording on them; the recording apparatus for use of woods to record on them; the recording apparatus for use of ceramics to record on ceramic materials; the recording apparatus for recording on sponge or some other three-dimensionally netted structures. Here, also, the textile printing apparatus is included for recording on cloths or the like.

Also, as discharge liquid used for each of these liquid discharge apparatuses, it should be good enough to use the liquid which is suitable for the respective recording media and recording conditions.

What is claimed is:

1. A liquid discharge head comprising:

a heating member for generating thermal energy to create a bubble in a liquid;

a discharge port to discharge the liquid;

a liquid flow path communicating with said discharge port and having a bubble generating area for enabling the liquid to create the bubble;

a movable member arranged in said bubble generating area to be displaced along with the development of the bubble; and a regulating portion to regulate the displacement of said movable member within a desired range, and with energy generated by bubble creation, the liquid being discharged from said discharge port, wherein with essential contact of said movable member with said regulating portion, said liquid flow path having the bubble generating area becomes an essentially closed space with the exception of said discharge port, and when said movable member opens said essentially closed space, liquid flows in said bubble generating area, and the flowing-in liquid joins with the liquid shifting to the heating member side along with the bubble disappearing in the area between said discharge port and said heating member.

2. A liquid discharge head according to claim 1, wherein said heating member and said discharge port are in the linearly communicated state.

3. A liquid discharge head according to claim 1, wherein said movable member is arranged to suppress only the bubble to be developed in the upstream direction with respect to the liquid flow in the direction toward said discharge port.

4. A liquid discharge head according to claim 1, wherein said movable member is provided with a free end, and said free end is positioned substantially on the central portion of said bubble generating area.

5. A liquid discharge head according to claim 1, wherein the flow resistance of said liquid flow path is lower on the upstream side than that on the downstream side with said regulating portion as boundary when said movable member is on standby.

6. A liquid discharge head according to claim 4, wherein the contact of said movable member with said regulating portion is made in the vicinity of said free end.

7. A liquid discharge head according to claim 1, wherein said regulating portion is formed by making distance locally smaller from the movable member in said liquid flow path.

8. A liquid discharge head according to claim 1, wherein said discharge port is arranged above said heating member.

9. A liquid discharge head according to claim 8, wherein said movable members are formed in the plural per heating member, and said plural movable members are formed symmetrically with respect to the bubbling center of said heating member.

10. A liquid discharge method using a liquid discharge head provided with:

a heating member for generating thermal energy to create a bubble in liquid;

a discharge port to discharge the liquid;

a liquid flow path communicating with the discharge port and having a bubble generating area for enabling the liquid to create the bubble;

a movable member arranged in the bubble generating area to be displaced along with the development of the bubble; and a regulating portion to regulate the displacement of the movable member within a desired range, with energy generated by bubble creation, the liquid being discharged from the discharge port, comprising the following steps of:

forming a substantially closed space in the liquid flow path having the bubble generating area therein with the exception of the discharge port when the movable member is essentially in contact with the regulating portion before the bubble is bubbled to the maximum;

enabling liquid to flow into the bubble generating area when the movable member opens the substantially closed space; and joining the flowing-in liquid with the liquid shifting to the heating member side along with the bubble disappearing in the area between the discharge port and the heating member.

11. A liquid discharge method according to claim 10, further comprising the following step of:

initiating said disappearing of said bubble after receiving the stress in the form of being pulled in the upstream direction by the liquid shift in said upstream direction and the development of the bubble after said movable member is essentially in contact with said regulating portion.

12. A liquid discharge method according to claim 10, further comprising the following step of:

contracting said bubble while said movable member is still essentially in contact with said regulating portion.

13. A liquid discharge method according to claim 12, wherein in the step of contracting said bubble while said movable member is still essentially in contact with said regulating portion, the liquid shift along with said contraction of the bubble is mostly directed from said discharge port in the upstream direction to draw the meniscus rapidly into said discharge port.

14. A liquid discharge method according to claim 13, wherein during said bubble contraction process, said movable member is caused to separate from said regulating portion to create the liquid flow in the downstream direction in said bubble generating area for abruptly braking said drawing of the meniscus.

* * * * *

UNITED STATES PATENT AND TRADEMARK OFFICE

CERTIFICATE OF CORRECTION

PATENT NO. : 6,585,491 B2
DATED : July 1, 2003
INVENTOR(S) : Yoichi Taneya et al.

It is certified that error appears in the above-identified patent and that said Letters Patent is hereby corrected as shown below:

Column 1,
Line 24, “the” should read -- The --.

Column 2,
Line 27, “any idea is” should read -- is any idea --; and
Line 29, “present” should read -- presents --.

Column 3,
Line 33, “for the” should read -- for --; and
Line 48, “each” should read -- neither each --.

Column 4,
Line 45, “that” should be deleted; and
Line 62, “that” should be deleted.

Column 6,
Line 2, “become” should read -- becomes --;
Line 5, “join” should read -- joins --;
Lines 45 and 66, “during” should read -- during the time --; and
Line 47, “is settled” should read -- are settled --;

Column 7,
Line 1, “member is” should read -- members are --.

Column 9,
Line 21, “during” should read -- during the time --; and
Line 23, “is settled” should read -- are settled --.

Column 12,
Line 18, “correspond” should read -- corresponds --.

Column 16,
Line 59, “having it” should read -- having its --.

UNITED STATES PATENT AND TRADEMARK OFFICE

CERTIFICATE OF CORRECTION

PATENT NO. : 6,585,491 B2
DATED : July 1, 2003
INVENTOR(S) : Yoichi Taneya et al.

It is certified that error appears in the above-identified patent and that said Letters Patent is hereby corrected as shown below:

Column 17,
Line 45, “microdots” should read -- microdots, --; and
Line 46, “charged” should read -- charge --.

Column 18,
Line 40, “entire” should read -- enter --; and
Line 51, “corporation” should read -- cooperation --.

Column 19,
Line 8, “as a” should read -- As a --.

Column 20,
Line 31, “correspond” should read -- corresponds --.

Column 22,
Line 60, “talks” should read -- talk --.

Column 24,
Line 18, “in” should read -- on --.

Column 25,
Line 21, “is made” should read -- are made --; and
Line 37, “having it” should read -- having its --.

Column 26,
Line 22, “reaches” should read -- reach --;
Line 25, “charged” should read -- charge --.

Column 27,
Line 29, “arrange” should read -- arranged --; and
Line 59, “correspond” should read -- corresponds --.

UNITED STATES PATENT AND TRADEMARK OFFICE

CERTIFICATE OF CORRECTION

PATENT NO. : 6,585,491 B2
DATED : July 1, 2003
INVENTOR(S) : Yoichi Taneya et al.

It is certified that error appears in the above-identified patent and that said Letters Patent is hereby corrected as shown below:

Column 30,
Line 16, “port 10” should read -- port 18 --; and
Line 59, “having it” should read -- having its --.

Column 31,
Line 13, “conventual” should read -- conventional --; and
Line 27, “form” should read -- from --.

Column 34,
Line 4, “correspond” should read -- corresponds --.

Column 37,
Line 4, “it spherical” should read -- its spherical --;
Line 24, “conventual” should read -- conventional --; and
Line 38, “form” should read -- from --.

Column 39,
Line 33, “along” should read -- Along --.

Column 40,
Line 20, “correspond” should read -- corrresponds --; and
Line 60, “on the” should read -- more --.

Column 41,
Line 66, “articular,” should read -- particular, --.

Column 42,
Line 37, “discharged” should read -- discharge --; and
Line 45, “push” should read -- pushes --.

Column 43,
Line 21, “resent” should read -- present --.

UNITED STATES PATENT AND TRADEMARK OFFICE

CERTIFICATE OF CORRECTION

PATENT NO. : 6,585,491 B2
DATED : July 1, 2003
INVENTOR(S) : Yoichi Taneya et al.

It is certified that error appears in the above-identified patent and that said Letters Patent is hereby corrected as shown below:

Column 44,
Line 8, “form” should read -- from --;
Line 31, “illustrate” should read -- which illustrate --; and
Line 44, “its has” should be deleted.

Column 46,
Line 61, “though” should read -- through --.

Column 47,
Line 43, “heat” should read -- head --.

Column 48,
Line 26, “that” should read -- than --;
Line 59, “greatly” should be deleted; and
Line 61, “generated” should read -- generates --.

Column 49,
Line 25, “refiling” should read -- refilling --;
Line 52, “heat” should read -- head --; and
Line 60, “heat” should read -- head --.

Column 50,
Line 13, “process” should read -- processed --;
Line 43, “recording” should read -- record --; and
Line 46, “recording” should read -- record --.

Signed and Sealed this

Eighteenth Day of November, 2003

JAMES E. ROGAN
*Director of the United States Patent and Trademark Office*